US012460518B2

(12) United States Patent
Ursi et al.

(10) Patent No.: US 12,460,518 B2
(45) Date of Patent: Nov. 4, 2025

(54) PERFORATING GUN WITH SELF-ORIENTING CHARGE CARTRIDGE

(71) Applicant: Oso Perforating, LLC, Irving, TX (US)

(72) Inventors: Jeremy Ursi, Frisco, TX (US); Nathan McFarland, Euless, TX (US); Kerron James, Fort Worth, TX (US); David Knecht, Colleyville, TX (US); Peter Galligan, Grapevine, TX (US); Varun Garg, Dallas, TX (US)

(73) Assignee: Oso Perforating, LLC, Irving, TX (US)

( * ) Notice: Subject to any disclaimer, the term of this patent is extended or adjusted under 35 U.S.C. 154(b) by 0 days.

(21) Appl. No.: 18/886,370

(22) Filed: Sep. 16, 2024

(65) Prior Publication Data

US 2025/0092764 A1 Mar. 20, 2025

Related U.S. Application Data

(60) Provisional application No. 63/686,404, filed on Aug. 23, 2024, provisional application No. 63/582,880, filed on Sep. 15, 2023.

(51) Int. Cl.
*E21B 43/1185* (2006.01)
*E21B 43/117* (2006.01)
*E21B 43/119* (2006.01)

(52) U.S. Cl.
CPC ..... *E21B 43/1185* (2013.01); *E21B 43/117* (2013.01); *E21B 43/119* (2013.01)

(58) Field of Classification Search
CPC .. E21B 43/1185; E21B 43/119; E21B 43/117; E21B 43/116; E21B 43/11; E21B 17/1057
See application file for complete search history.

(56) References Cited

U.S. PATENT DOCUMENTS 3,923,105 A 12/1975 Lands, Jr.
4,269,278 A 5/1981 Vann
(Continued)

FOREIGN PATENT DOCUMENTS

CN 108661609 A 10/2018
GB 2428708 A 7/2007

OTHER PUBLICATIONS

International Search Report and Written Opinion for corresponding International Application No. PCT/US2021/021152, dated May 20, 2021; 11 pages.

*Primary Examiner* — Daniel P Stephenson
(74) *Attorney, Agent, or Firm* — HAYNES AND BOONE, LLP

(57) ABSTRACT

A perforating gun with a self-orienting charge cartridge is disclosed for use in oil and gas completions operations. In one or more embodiments, the perforating gun may include a carrier tube within which the self-orienting charge cartridge extends and a conductor sub coupled to the carrier tube. In one or more embodiments, the self-orienting charge cartridge includes a perforating charge, a bearing, and a ground conductor, and is configured so that the perforating charge is initiable via the conductor sub, the bearing rotationally supports the perforating charge within the carrier tube, and the ground conductor provides grounding electrical contact with the conductor sub in order to ground the self-orienting charge cartridge directly to the conductor sub. A gun string including the perforating gun and one or more additional perforating guns substantially identical to the perforating gun is also disclosed.

32 Claims, 68 Drawing Sheets

(56) References Cited

U.S. PATENT DOCUMENTS

| | | | | |
|---|---|---|---|---|
| 4,554,976 | A | 11/1985 | Hynes et al. | |
| 4,726,431 | A | 2/1988 | Oestreich et al. | |
| 5,273,121 | A | 12/1993 | Kitney et al. | |
| 5,603,379 | A | 2/1997 | Henke et al. | |
| 5,964,294 | A | 10/1999 | Edwards et al. | |
| 6,595,290 | B2 | 7/2003 | George et al. | |
| 6,942,033 | B2 | 9/2005 | Brooks et al. | |
| 7,000,699 | B2 | 2/2006 | Yang et al. | |
| 7,934,558 | B2 | 5/2011 | Hales et al. | |
| 8,002,035 | B2 | 8/2011 | Hales et al. | |
| 8,181,718 | B2 | 5/2012 | Burleson et al. | |
| 8,443,886 | B2 * | 5/2013 | Torres | E21B 43/119 175/4.53 |
| 8,591,205 | B2 | 11/2013 | Brown et al. | |
| 9,903,185 | B2 | 2/2018 | Ursi et al. | |
| 11,078,762 | B2 * | 8/2021 | Mauldin | E21B 43/1185 |
| 11,555,385 | B2 | 1/2023 | Ursi et al. | |
| 11,674,371 | B1 * | 6/2023 | Bradley | E21B 43/117 89/1.15 |
| 2003/0098158 | A1 * | 5/2003 | George | E21B 43/116 175/4.53 |
| 2005/0022999 | A1 | 2/2005 | Hughes | |
| 2005/0155770 | A1 | 7/2005 | Parrott | |
| 2005/0229805 | A1 | 10/2005 | Myers, Jr. et al. | |
| 2005/0279513 | A1 | 12/2005 | Eppink | |
| 2007/0034381 | A1 | 2/2007 | Campbell et al. | |
| 2013/0008639 | A1 | 1/2013 | Tassaroli | |
| 2015/0226044 | A1 * | 8/2015 | Ursi | E21B 43/117 166/55 |
| 2016/0208587 | A1 * | 7/2016 | Hardesty | E21B 43/117 |
| 2017/0275975 | A1 | 9/2017 | Hardesty | |
| 2018/0171725 | A1 | 6/2018 | Cook et al. | |
| 2019/0063649 | A1 | 2/2019 | Snyder, II | |
| 2019/0153829 | A1 | 5/2019 | Roessler | |
| 2019/0257158 | A1 | 8/2019 | Langford et al. | |
| 2019/0330962 | A1 | 10/2019 | Hardesty et al. | |
| 2021/0277753 | A1 | 9/2021 | Ursi et al. | |
| 2022/0205344 | A1 * | 6/2022 | Hoelscher | E21B 43/117 |
| 2023/0203923 | A1 * | 6/2023 | Eitschberger | E21B 43/119 166/297 |
| 2023/0265748 | A1 | 8/2023 | Bradley et al. | |
| 2023/0304362 | A1 | 9/2023 | Garg et al. | |
| 2023/0304384 | A1 * | 9/2023 | Rajaram | E21B 43/119 |
| 2024/0003200 | A1 * | 1/2024 | Knight | E21B 17/1057 |

* cited by examiner

PERFORATING GUN WITH SELF-ORIENTING CHARGE CARTRIDGE

CROSS-REFERENCE TO RELATED APPLICATIONS

This application claims the benefit of the filing date of, and priority to, U.S. Patent Application No. 63/582,880 ("the '880 Application"), filed Sep. 15, 2023, the entire disclosure of which is hereby incorporated herein by reference.

This application also claims the benefit of the filing date of, and priority to, U.S. Patent Application No. 63/686,404 ("the '404 Application"), filed Aug. 23, 2024, the entire disclosure of which is hereby incorporated herein by reference.

This application is also related to U.S. patent application Ser. No. 18/785,398 ("the '398 Application"), filed Jul. 26, 2024, which is a continuation of U.S. patent application Ser. No. 18/317,188 ("the '188 Application"), filed May 15, 2023, now issued as U.S. Pat. No. 12,049,791, which is a continuation of U.S. patent application Ser. No. 17/869,320 ("the '320 Application"), filed Jul. 20, 2022, now issued as U.S. Pat. No. 11,649,684, which claims the benefit of the filing date of, and priority to, U.S. Patent Application No. 62/224,338, filed Jul. 21, 2021, and U.S. Patent Application No. 63/355,440, filed Jun. 24, 2022, the entire disclosures of which are hereby incorporated herein by reference.

This application is also related to U.S. patent application Ser. No. 18/644,275 ("the '275 Application"), filed Apr. 24, 2024, which claims the benefit of the filing date of, and priority to, U.S. Patent Application No. 63/497,900 ("the '900 Application"), filed Apr. 24, 2023, the entire disclosures of which are hereby incorporated herein by reference.

TECHNICAL FIELD

The present disclosure relates generally to perforating guns used in oil and gas completions operations, and, more particularly, to a perforating gun with a self-orienting charge cartridge.

DETAILED DESCRIPTION

Figure 1:
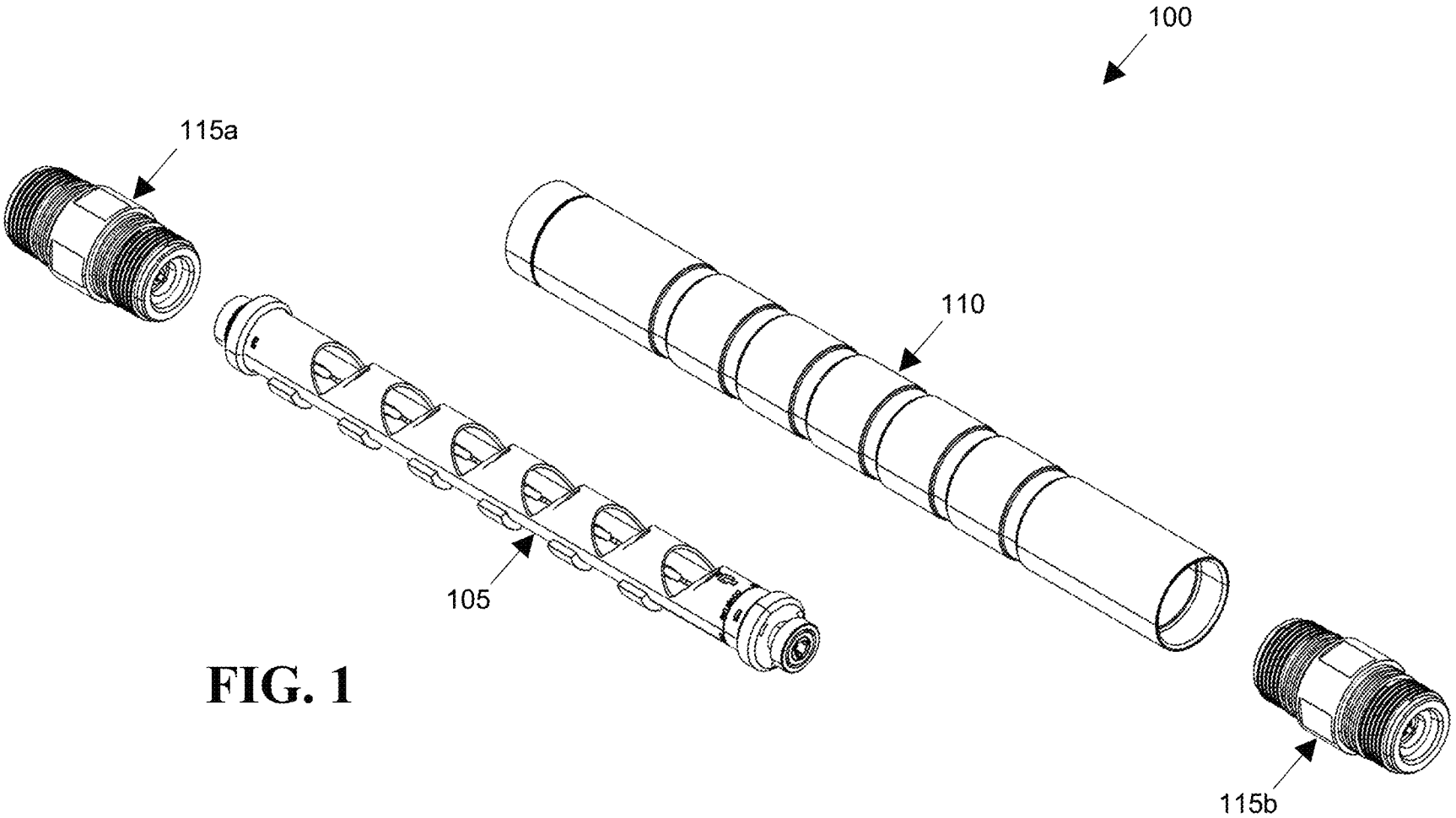
FIG. 1 is an exploded perspective view of a perforating gun according to one or more embodiments of the present disclosure.

Referring to FIG. 1, in one or more embodiments, a perforating gun is generally referred to by the reference numeral 100. The perforating gun 100 includes a self-orienting charge cartridge 105, a carrier tube 110, and conductor subs 115*a-b*. The self-orienting charge cartridge 105 is adapted to house ballistic(s), which ballistic(s) include a singular or plurality of perforating charges and detonator cord, detonable to perforate a wellbore proximate a subterranean formation. The carrier tube 110 receives the assembled self-orienting charge cartridge 105, including the ballistic(s), a detonator, and (optionally) a switch. The conductor subs 115*a-b* are adapted to: axially trap the self-orienting charge cartridge 105 within the carrier tube 110; and conduct electricity to and/or from the self-orienting charge cartridge 105 to facilitate detonation of the ballistic(s).

Figure 2:
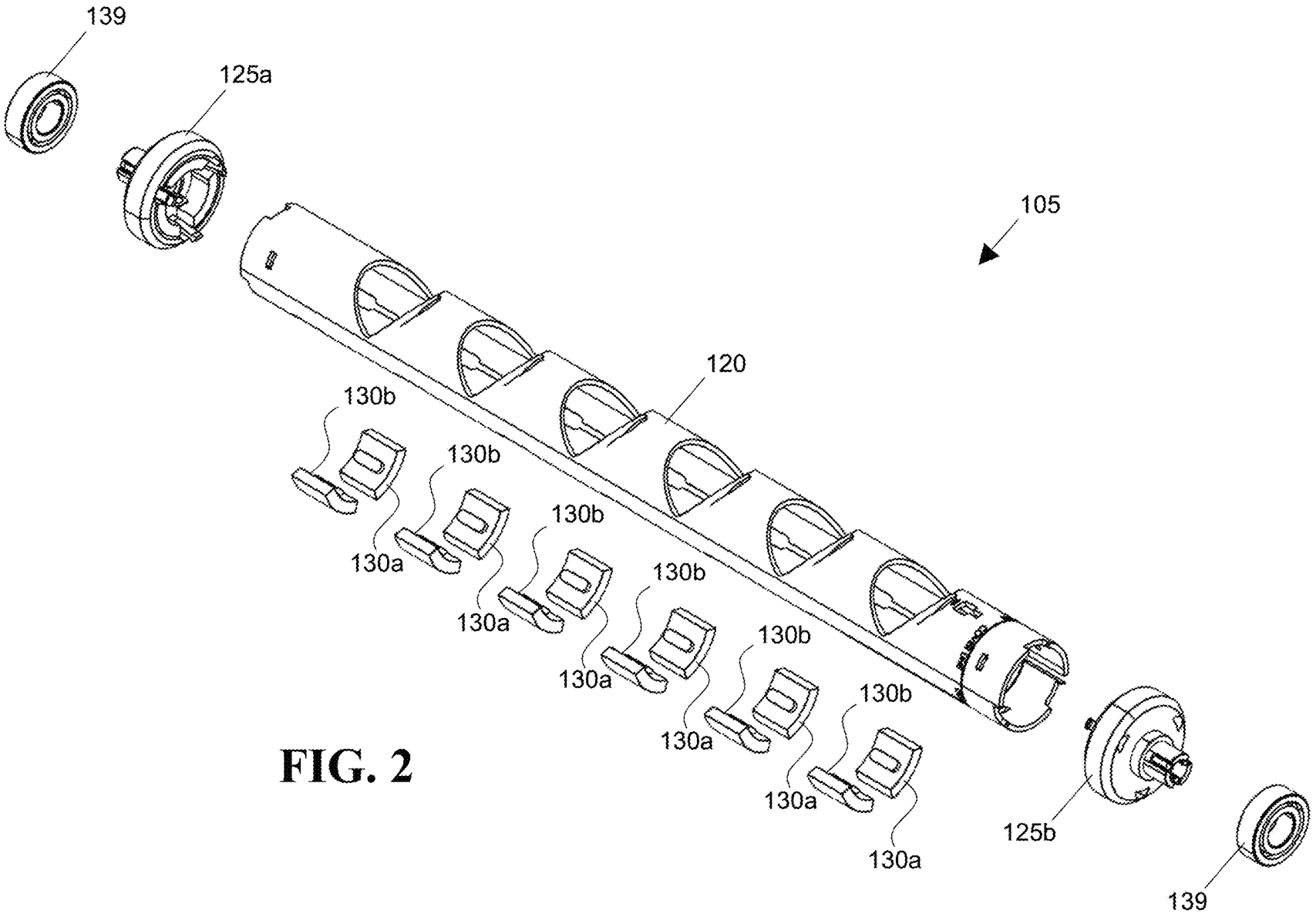
FIG. 2 is an exploded perspective view of a self-orienting charge cartridge of the perforating gun of FIG. 1 according to one or more embodiments of the present disclosure.

Referring to FIG. 2, in one or more embodiments, the self-orienting charge cartridge 105 includes a charge tube 120, cap assemblies 125*a-b*, orienting weights 130*a-b*, and (optionally) the switch (e.g., an addressable switch). The cap assemblies 125*a-b*, the orienting weights 130*a-b*, and (optionally) the switch are configured to be toollessly assembled with the charge tube 120 (e.g., without fastener(s)).

Figure 3:
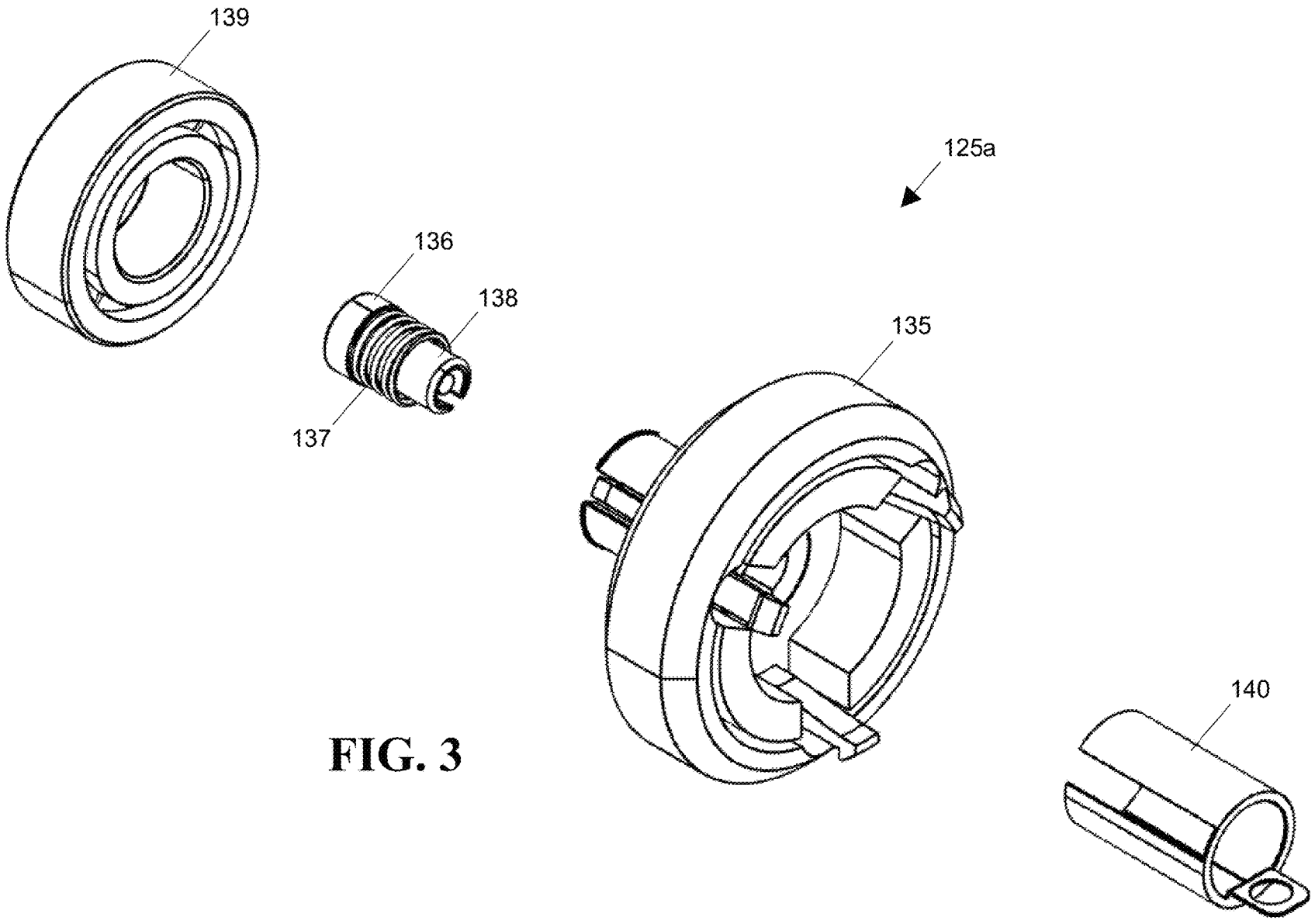
FIG. 3 is an exploded perspective view of a cap assembly of the self-orienting charge cartridge of FIG. 2 according to one or more embodiments of the present disclosure.

Referring to FIG. 3, in one or more embodiments, the cap assembly 125*a* includes an end cap 135, a conductor body 136 (or "contact conductor"), a biasing member 137 (e.g., a spring), a connector retainer 138, and an electrical connector (not shown). In one or more embodiments, the connector retainer 138 is substantially identical, or at least similar, to the connector retainer 505 shown and described in the '900 Application. In one or more embodiments, the electrical connector (not shown) is substantially identical, or at least similar, to the electrical connector 185 shown and described in the '900 Application, the '320 Application, and the '188 Application. The cap assembly 125*a* further includes a self-orienting bearing 139 and a ground conductor 140 (e.g., toollessly coupled to the cap assembly 125*a*, and/or coupled to the cap assembly 125*a* without fastener(s)), which are together adapted to provide grounding electrical contact between the charge tube 120 and the conductor sub 115*a* (and/or the carrier tube 110) when the charge tube 120 is received within the carrier tube 110. In one or more embodiments, the ground conductor 140 is electrically coupled to ground (e.g., a ground "button" within the perforating gun 100) via a quick-connect wire (e.g., enabling toolless coupling of the ground conductor 140 to ground, and/or coupling of the ground conductor 140 to ground with (or without) fastener(s)). In addition to being adapted to provide grounding electrical contact as discussed, the self-orienting bearing 139 is adapted to be received by the conductor sub 115*a* to rotatably support the end cap 135 of the cap assembly 125*a* while maintaining contact with the ground conductor 140, as will be described in more detail below. In one or more embodiments, the self-orienting bearing 139 is, includes, or is part of a roller bearing, a sleeve bearing, another type of bearing, the like, or any combination thereof.

Figure 4A:
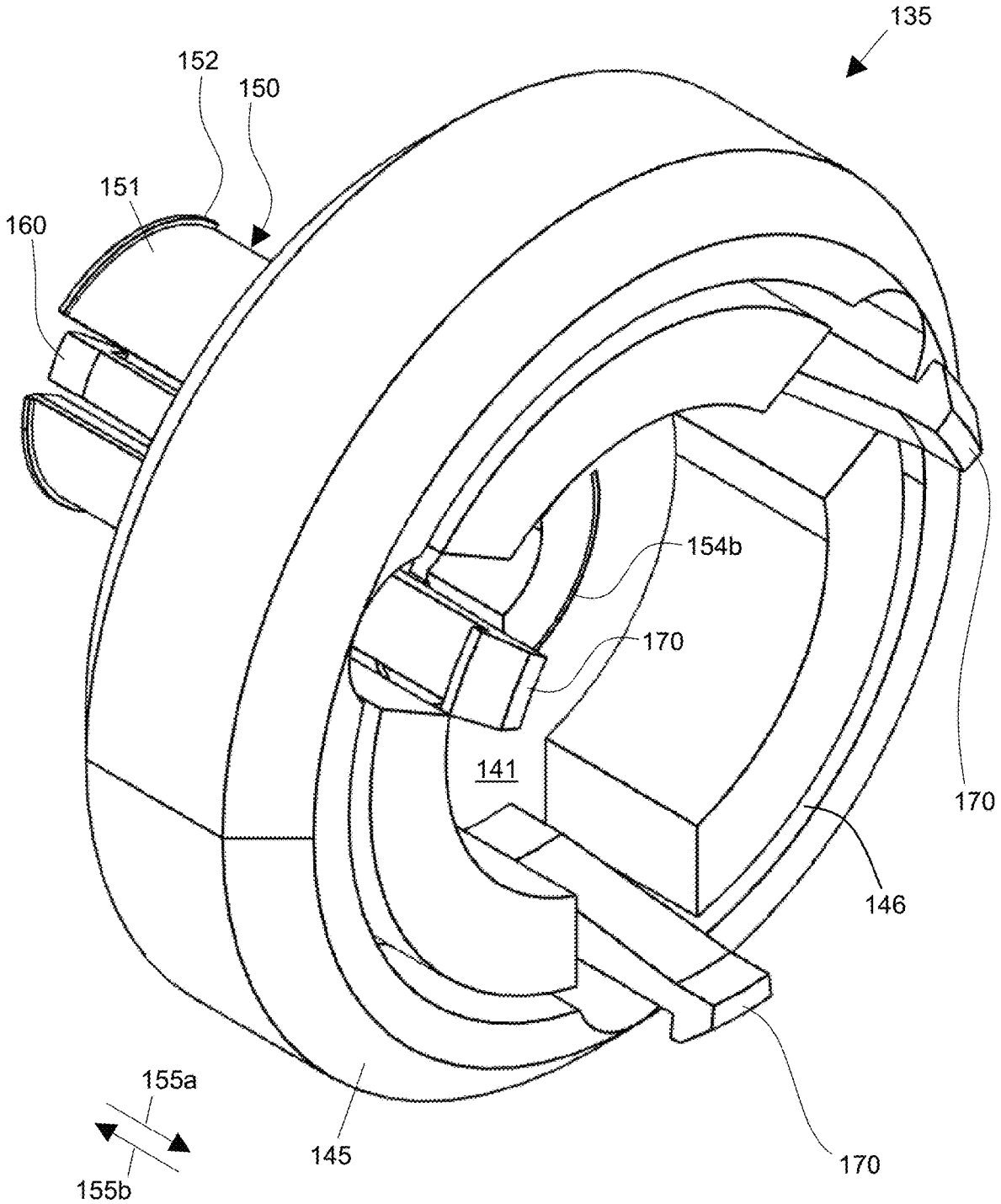
FIG. 4A is a perspective view of an end cap of the cap assembly of FIG. 3 according to one or more embodiments of the present disclosure.
Figure 4B:
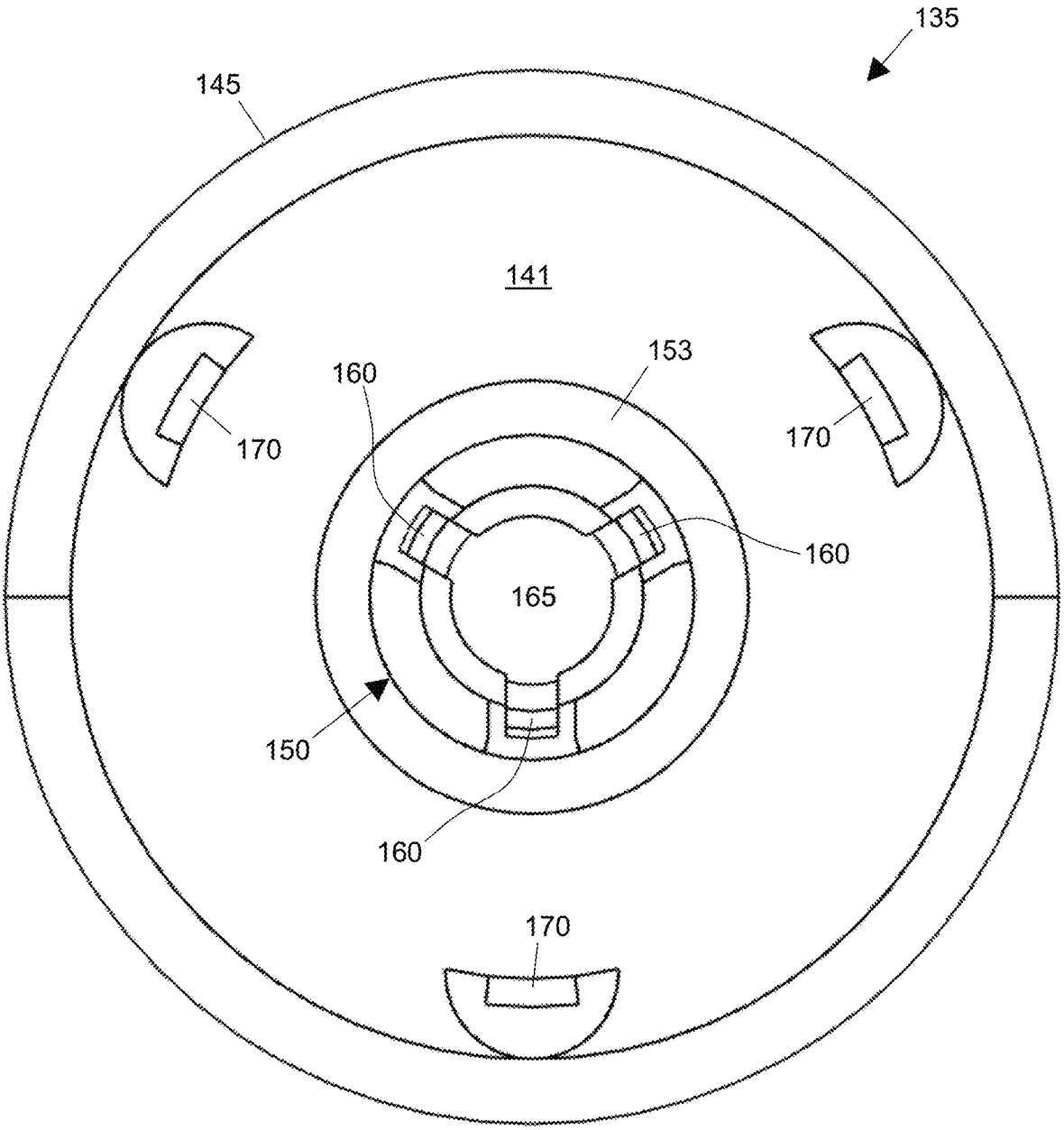
FIG. 4B is an elevational view of the end cap of FIG. 4A according to one or more embodiments of the present disclosure.
Figure 4C:
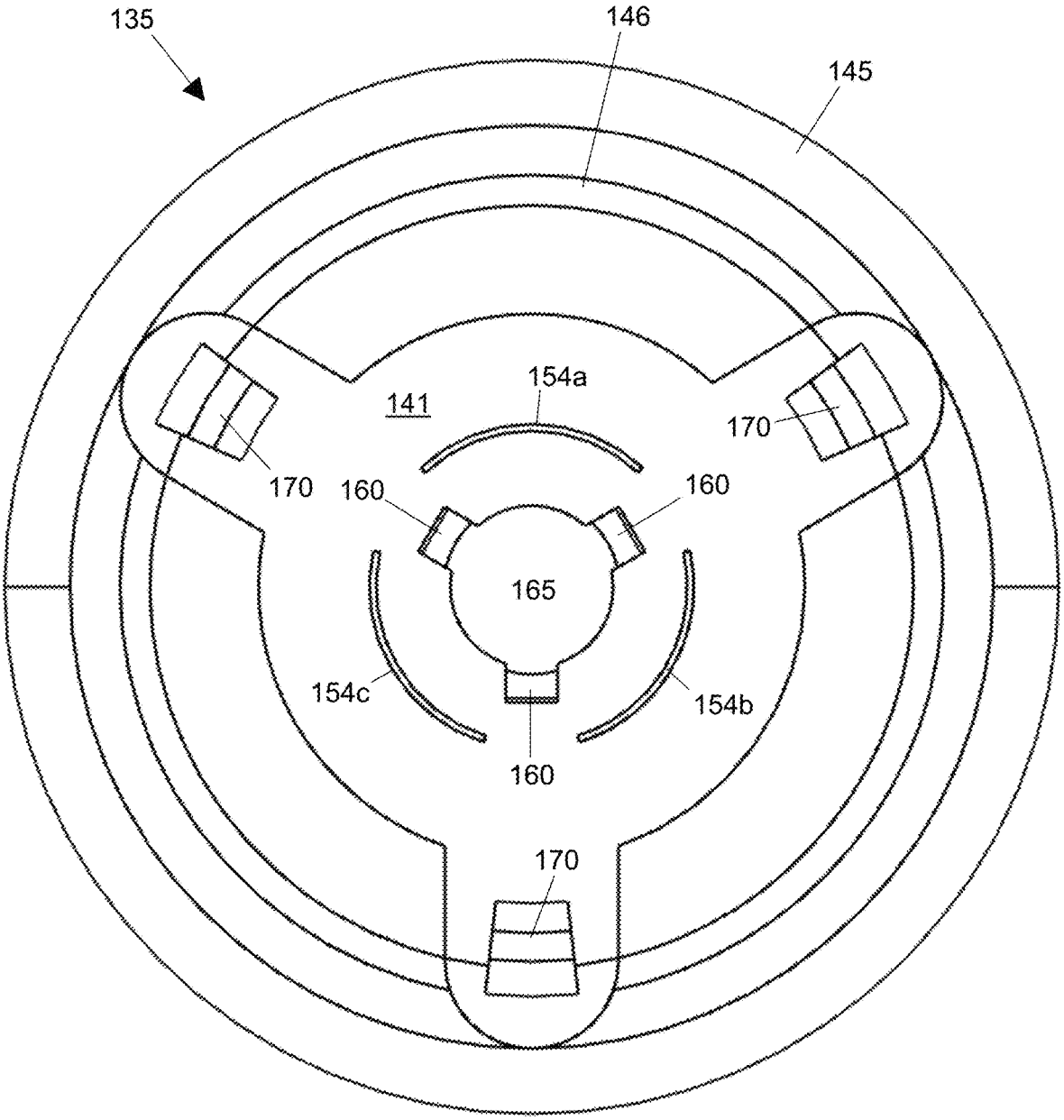
FIG. 4C is another elevational view of the end cap of FIG. 4A according to one or more embodiments of the present disclosure.
Figure 8:
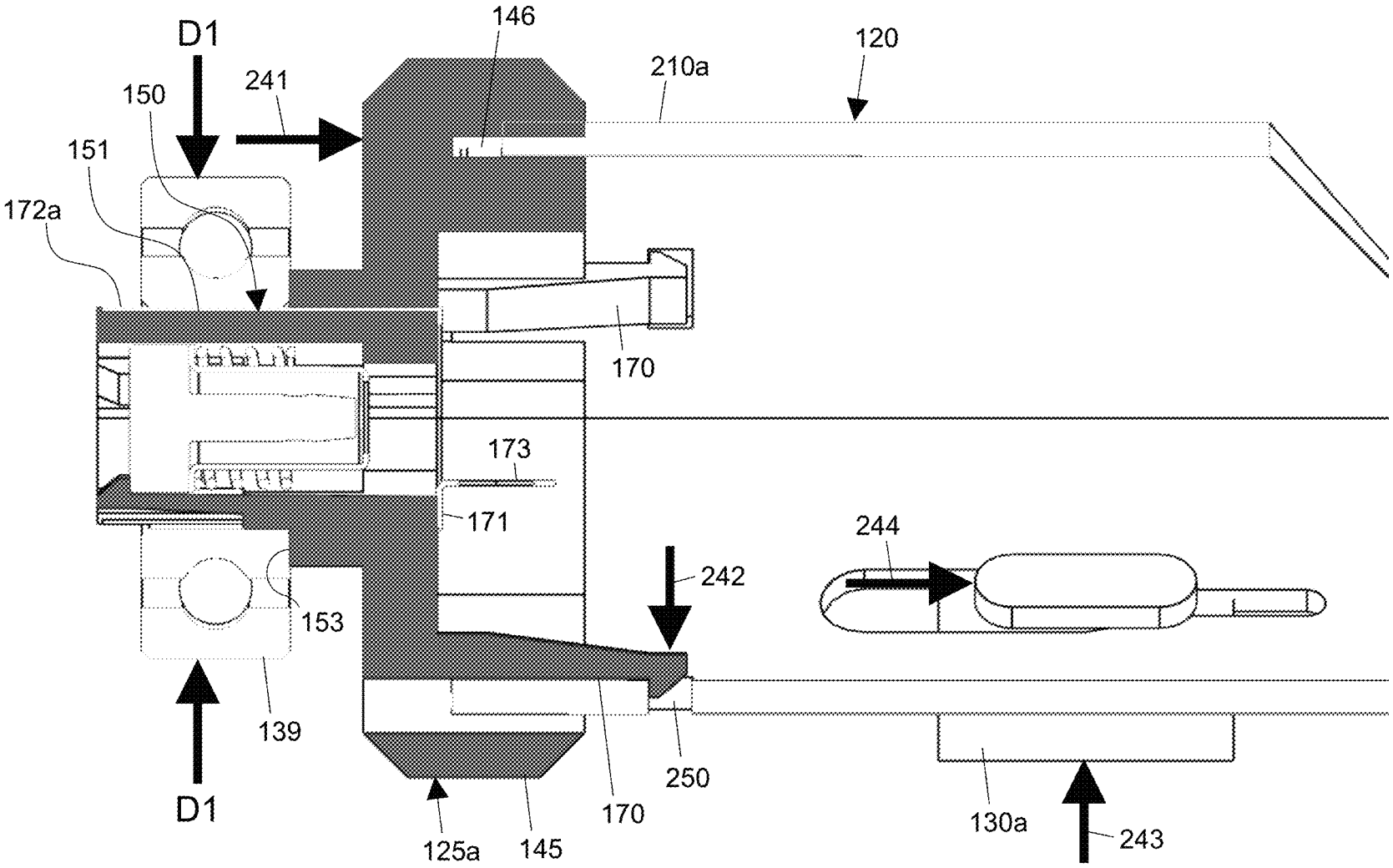
FIG. 8 is a cross-sectional view of a portion of the self-orienting charge cartridge of FIG. 2 according to one or more embodiments of the present disclosure.

Referring to FIGS. 4A through 4C, in one or more embodiments, the end cap 135 includes an end plate 141, which end plate 141 is disk-shaped. A coupling hub 145 extends axially from an outer periphery of the end plate 141 in a direction 155*a*. An annular groove 146 is formed axially into the coupling hub 145 in a direction 155*b*, opposite the direction 155*a*; the annular groove 146 is adapted to receive the charge tube 120 (as shown in FIG. 8 and described in more detail below). A conductor housing 150 extends axially from the end plate 141 in the direction 155*b*, opposite the coupling hub 145. The conductor housing defines an external surface 151. In one or more embodiments, the external surface is cylindrical. An external lip 152 extends radially from the external surface 151 at a distal end portion of the conductor housing 150. An external (e.g., annular) shoulder 153 extends radially from the external surface 151 at a proximal end portion of the conductor housing 150. The external shoulder 153 is spaced apart from the end plate 141 in the direction 155*b*. Grounding slots 154*a-c* are formed axially through the end plate 141 and the external shoulder 153. In one or more embodiments, the grounding slots 154*a-c* are distributed circumferentially (e.g., evenly) around the conductor housing 150, and are axially aligned along the external surface 151. One or more latching features 160 extend axially from (and along) the conductor housing 150 in the direction 155*b*. In one or more embodiments, the latching feature(s) 160 are located along, or proximate, a circumference of a central aperture 165 of the end plate 141. In one or more embodiments, the latching feature(s) 160 are radially-inwardly-facing. Additionally, one or more latching features 170 extend axially from the outer periphery of the end plate 141 in the direction 155*a*. In one or more embodiments, the latching feature(s) 170 are located along, or proximate, an outer circumference of the end plate 141. In one or more embodiments, the latching feature(s) 170 are radially-outwardly-facing. The cap assembly 125*b* is substantially identical to the cap assembly 125*a*, and, therefore, will not be described in further detail.

Figure 5A:
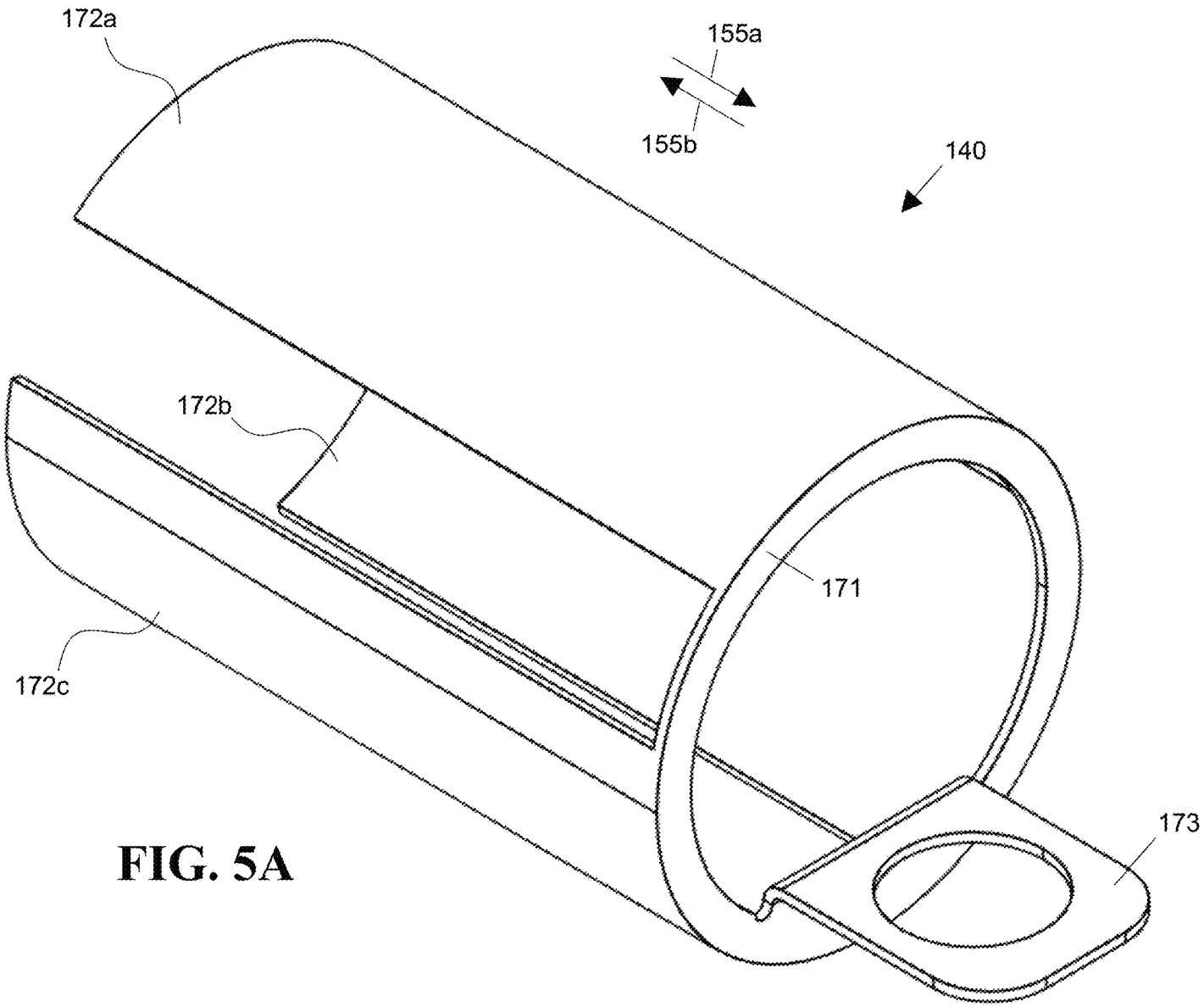
FIG. 5A is a perspective view of a ground conductor of the cap assembly of FIG. 3 according to one or more embodiments of the present disclosure.
Figure 5B:
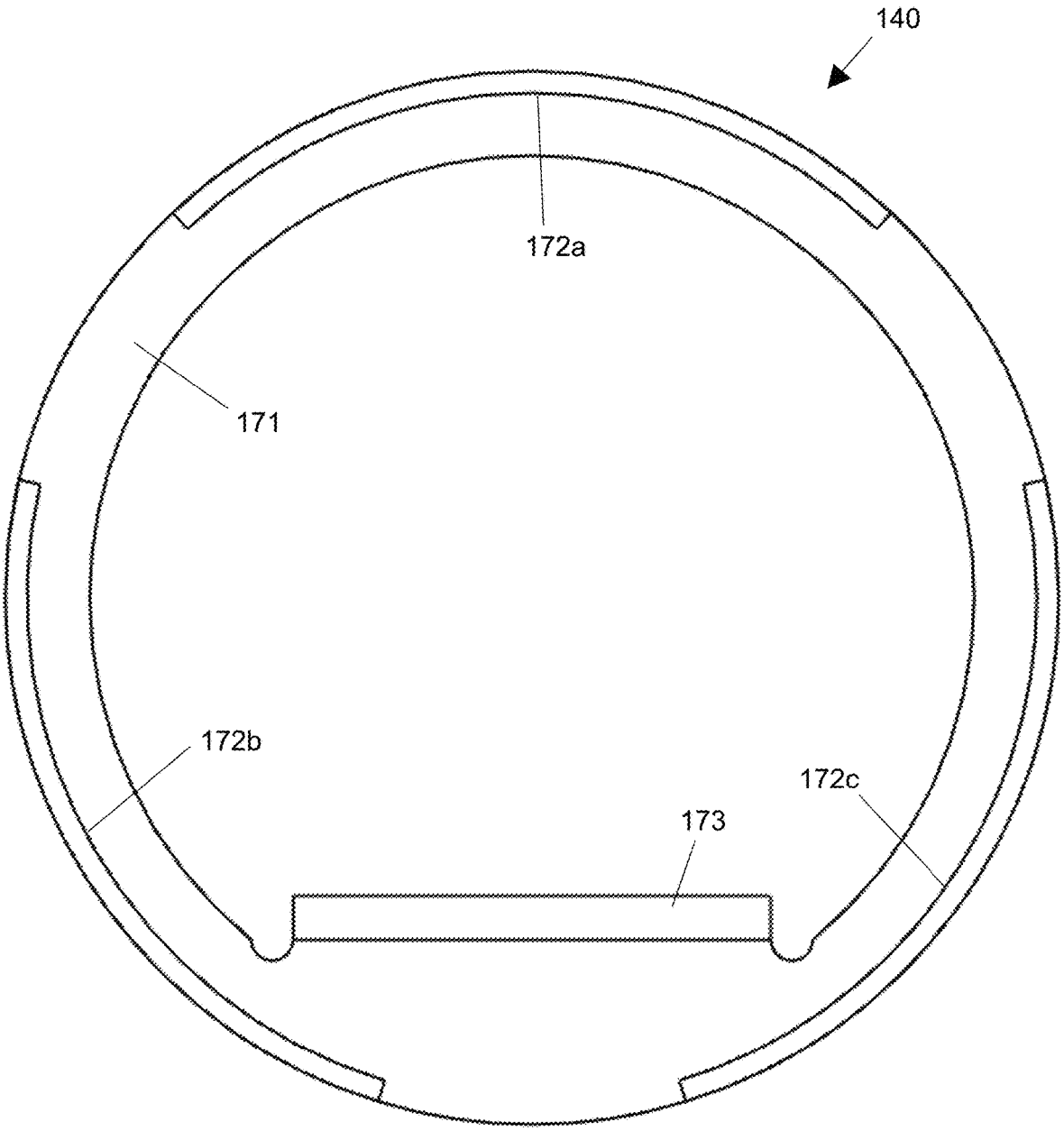
FIG. 5B is an elevational view of the ground conductor of FIG. 5A according to one or more embodiments of the present disclosure.
Figure 5C:
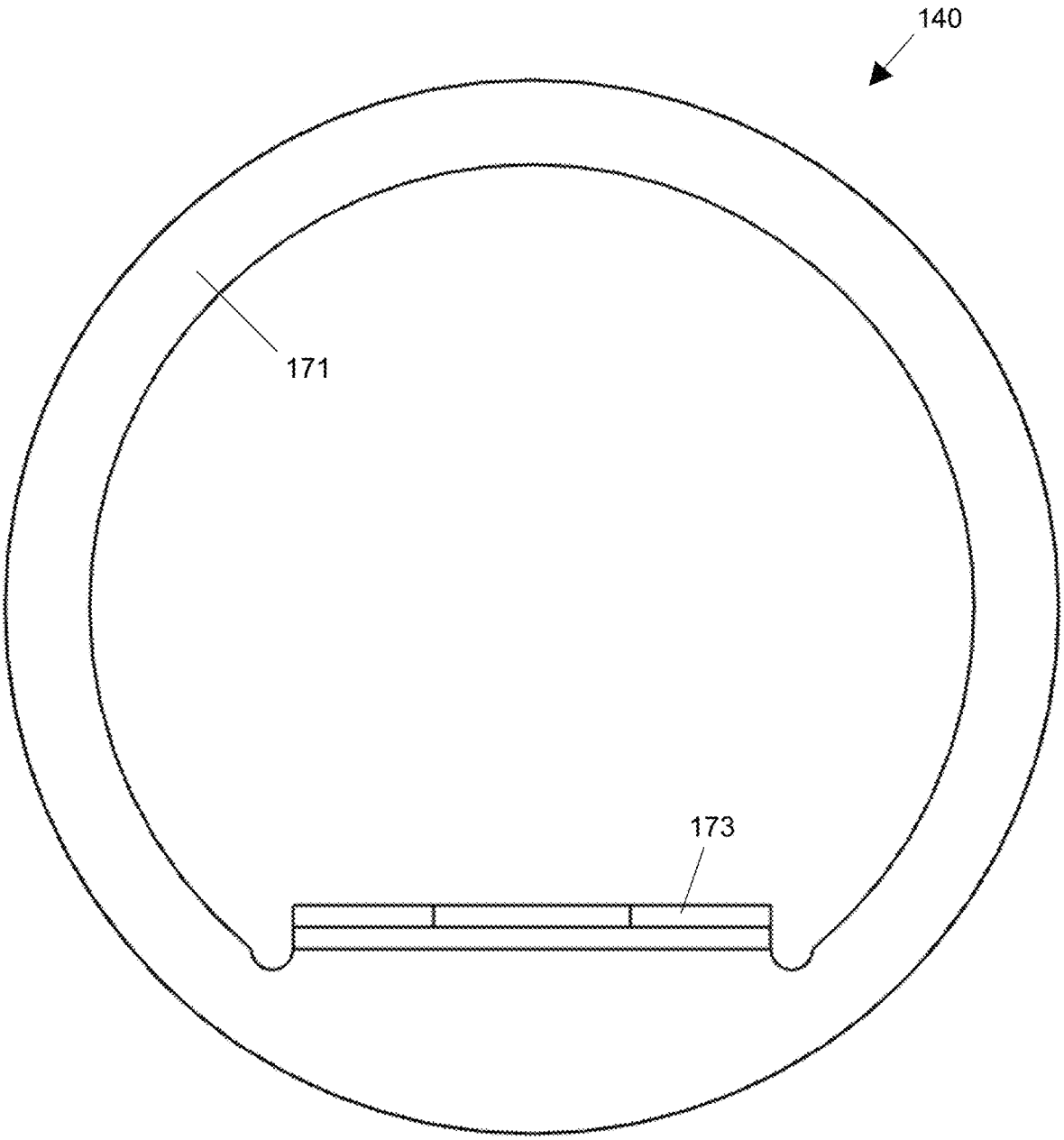
FIG. 5C is another elevational view of the ground conductor of FIG. 5A according to one or more embodiments of the present disclosure.

Referring to FIGS. 5A through 5C, in one or more embodiments, the ground conductor 140 includes a grounding ring 171, grounding tangs 172*a-c* extending axially from the grounding ring 171 in the direction 155*b*, and a grounding tab 173 extending axially from the grounding ring 171 in the direction 155*a*. In one or more embodiments, the grounding tangs 172*a-c* are distributed circumferentially (e.g., evenly) around the grounding ring 171. The grounding tangs 172*a-c* are receivable: through the grounding slots 154*a-c*, respectively; along the external surface 151 of the conductor housing 150; and against the external lip 152 extending radially from the external surface 151 at the distal end portion of the conductor housing 150. Moreover, when the grounding tangs 172*a-c* are so received, the self-orienting bearing 139 (e.g., an inner race of the self-orienting bearing 139) is receivable: around the grounding tangs 172*a-c* (and thus the external surface 151 of the conductor housing 150); and against the external shoulder 153 extending radially from the external surface 151 at the proximal end portion of the conductor housing 150.

Figure 6:
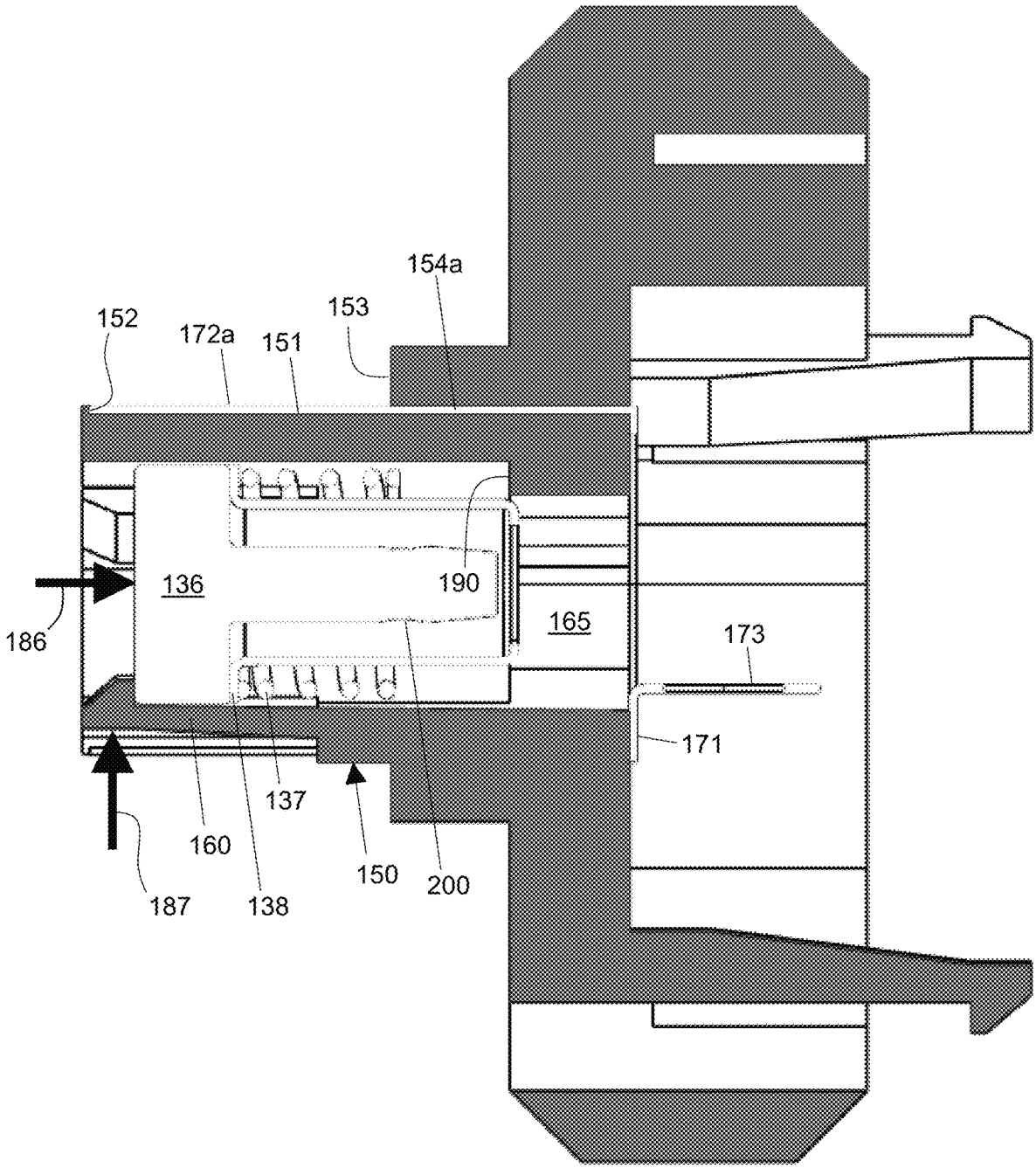
FIG. 6 is a cross-sectional view of the cap assembly of FIG. 3 according to one or more embodiments of the present disclosure.
Figure 7A:
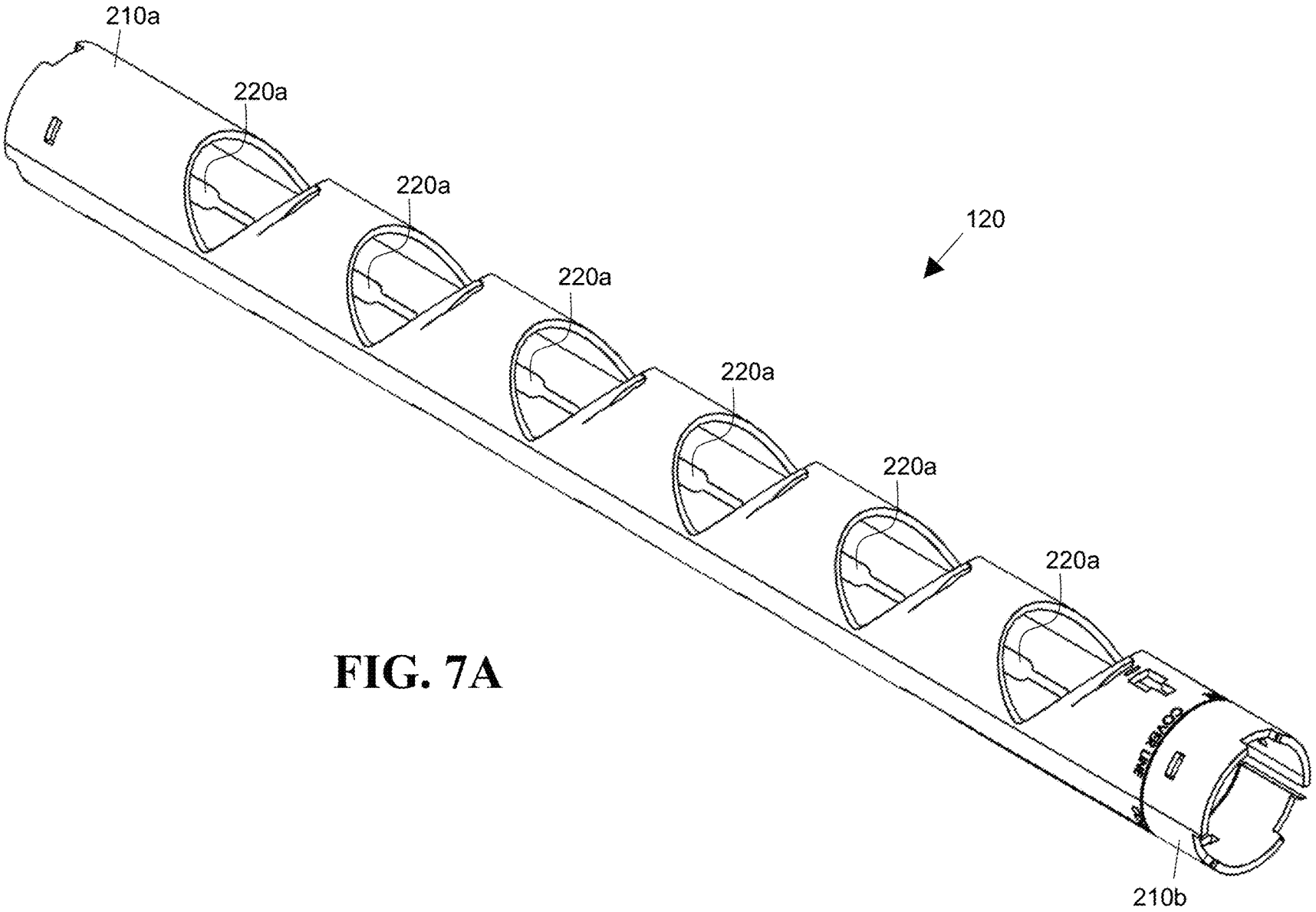
FIG. 7A is a perspective view of a charge tube of the self-orienting charge cartridge of FIG. 2 according to one or more embodiments of the present disclosure.
Figure 7B:
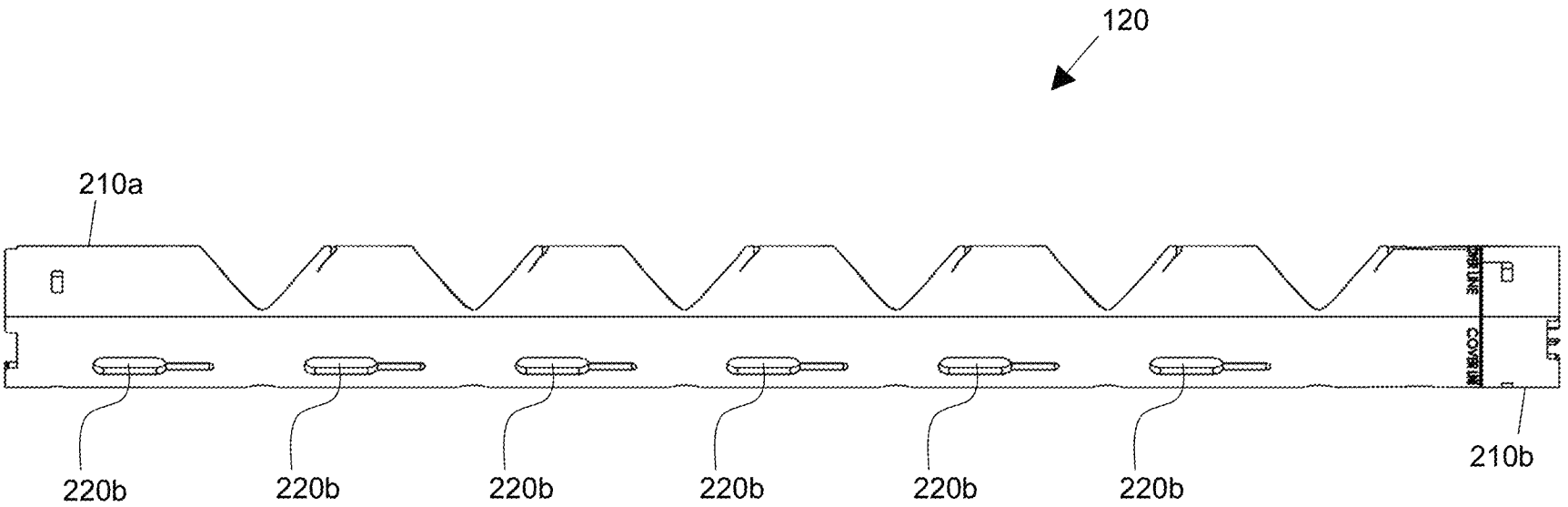
FIG. 7B is an elevational view of the charge tube of FIG. 7A according to one or more embodiments of the present disclosure.
Figure 7C:
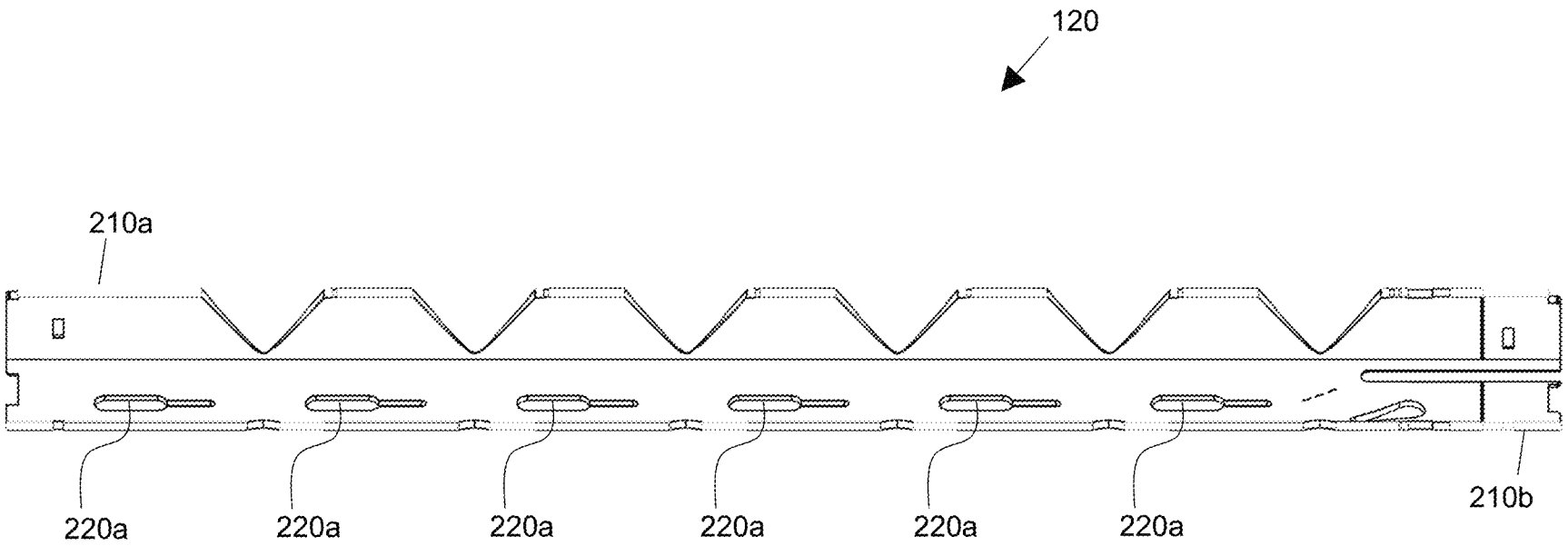
FIG. 7C is a cross-sectional view of the charge tube of FIG. 7B according to one or more embodiments of the present disclosure.
Figure 7D:
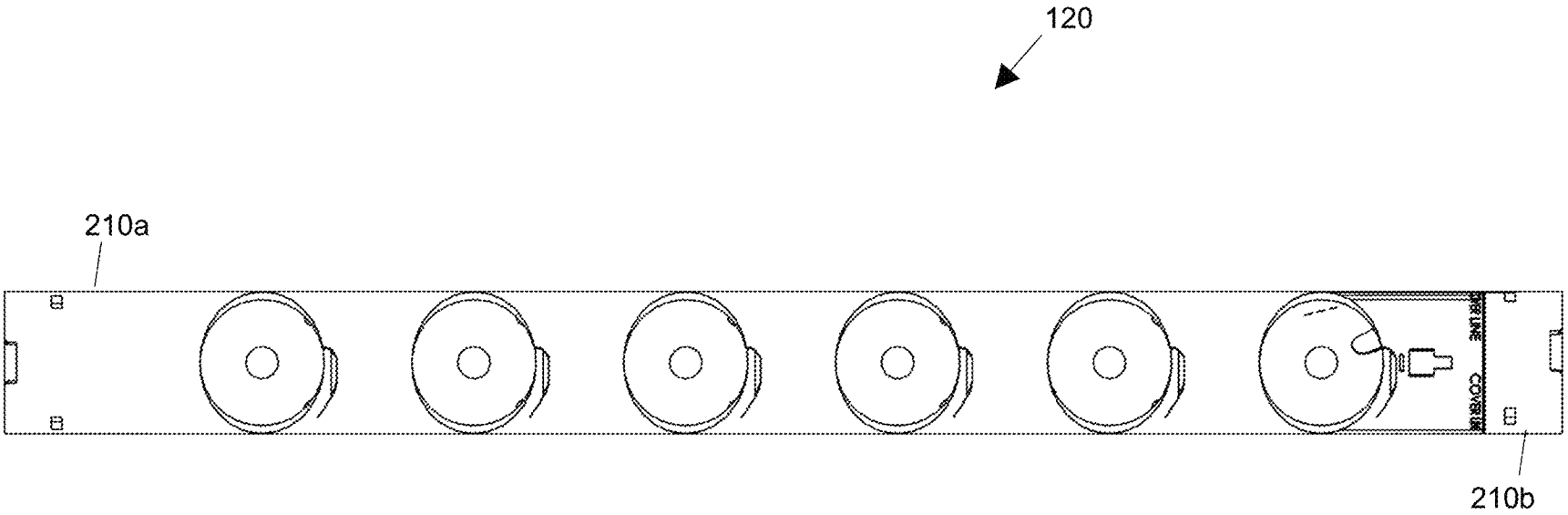
FIG. 7D is a top plan view of the charge tube of FIG. 7A according to one or more embodiments of the present disclosure.
Figure 7E:
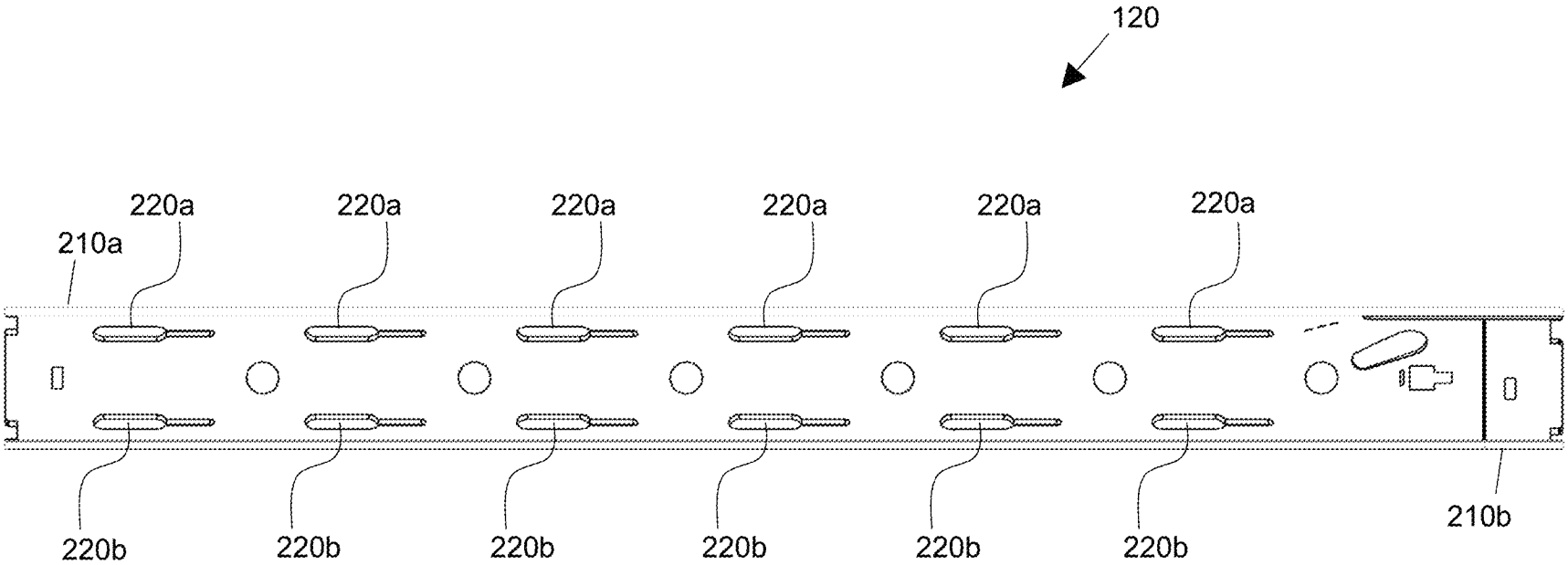
FIG. 7E is a cross-sectional view of the charge tube of FIG. 7D according to one or more embodiments of the present disclosure.

Referring to FIG. 6, the cap assembly 125*a* is illustrated in an assembled state according to one or more embodiments. To assemble the cap assembly 125*a*, the conductor body 136, the biasing member 137, the connector retainer 138, and the electrical connector (not shown) are assembled (e.g., toollessly) with the end cap 135 (e.g., without fastener(s)). More particularly, the conductor body 136 and the biasing member 137 are inserted axially into the conductor housing 150, as indicated by arrow 186, via the central aperture 165 of the end plate 141, causing the latching feature(s) 160 of the end cap 135 to latch onto the conductor body 136, as indicated by arrow 187, thereby trapping the conductor body 136 between the latching feature(s) 160 and an internal annular shoulder 190 of the end cap 135. The electrical connector (not shown) extends through a central aperture 165 of the conductor housing 150, opposite the central aperture 165 of the end plate 141, is retained on a reduced-diameter end portion 200 of the conductor body 136 by the connector retainer 138, and is adapted to electrically connect a wire from the detonator and/or the switch to the conductor body 136. To further assemble the cap assembly 125*a*, the grounding tangs 172*a-c* of the ground conductor 140 are received: through the grounding slots 154*a-c*, respectively; along the external surface 151 of the conductor housing 150; and against the external lip 152 extending radially from the external surface 151 at the distal end portion of the conductor housing 150.

Referring to FIGS. 7A through 7E, in one or more embodiments, the charge tube 120 defines opposing end portions 210*a-b*. Although shown as a single integrally formed body, the charge tube 120 may instead be broken into two or more interconnected components. A plurality of slots 220*a* are formed radially through the charge tube 120, and are axially distributed (e.g., evenly) along the charge tube 120 between the end portions 210*a-b*, via which slots 220*a* the respective orienting weights 130*a* are partially insertable transversely into, and detachably couplable to, the charge tube 120. Similarly, a plurality of slots 220*b* are formed radially through the charge tube 120, and are axially distributed (e.g., evenly) along the charge tube between the end portions 210*a-b*, via which slots 220*b* the respective orienting weights 130*b* are partially insertable transversely into, and detachably couplable to, the charge tube 120 (as shown in FIG. 8). The charge tube 120 illustrated in FIGS. 7A through 7E is configured to rotationally align the perforating charges in a substantially straight line (i.e., a non-phased relationship) with adjacent one(s) of the perforating charges.

Referring to FIG. 8, in one or more embodiments, the cap assembly 125*a* and the orienting weight 130*a* are assembled (e.g., toollessly and/or without fastener(s)) into the end portion 210*a* of the charge tube 120. More particularly, the cap assembly 125*a* is inserted axially onto the end portion 210*a* of the charge tube 120, as indicated by arrow 241, causing: the annular groove 146 formed axially into the coupling hub 145 to receive the end portion 210*a* of the charge tube 120; and the latching feature(s) 170 of the end cap 135 to latch onto the charge tube 120 at corresponding slots 250 formed through the charge tube 120, as indicated by arrow 242. Additionally, the self-orienting bearing 139 (e.g., the inner race of the self-orienting bearing 139) is received: around the grounding tangs 172*a-c* (and thus the external surface 151 of the conductor housing 150); and against the external shoulder 153 extending radially from the external surface 151 at the proximal end portion of the conductor housing 150. Finally, the orienting weight 130*a* is partially inserted transversely into the charge tube 120, via the slot 220*a*, as indicated by arrow 243, and, once so partially inserted, is axially movable as indicated by arrow 244 to detachably couple the orienting weight 130*a* to the charge tube 120.

Figure 9:
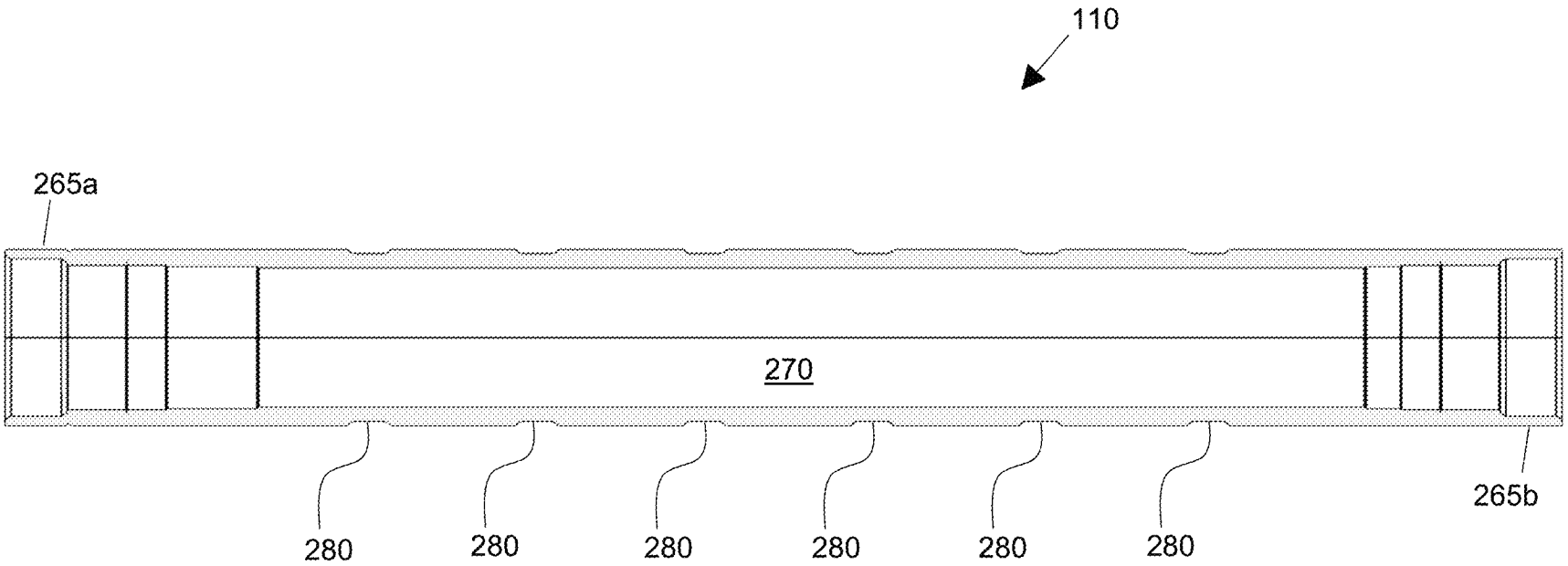
FIG. 9 is a cross-sectional view of a carrier tube of the perforating gun of FIG. 1 according to one or more embodiments of the present disclosure.

Referring to FIG. 9, in one or more embodiments, the carrier tube 110 defines opposing end portions 265*a-b* and a central passageway 270 extending axially therethrough. Although shown as a single integrally formed body, the carrier tube 110 may instead be broken into two or more interconnected components. A plurality of banded scallops 280 are formed externally into, and circumferentially around, the carrier tube 110. The plurality of banded scallops 280 eliminate the need to rotationally align the perforating charges (each of which is rotationally aligned in a substantially straight line (i.e., a non-phased relationship) with adjacent one(s) of the perforating charges) with respective ones of the plurality of banded scallops 280 formed externally into the carrier tube 110, as will be described in further detail below.

Figure 10:
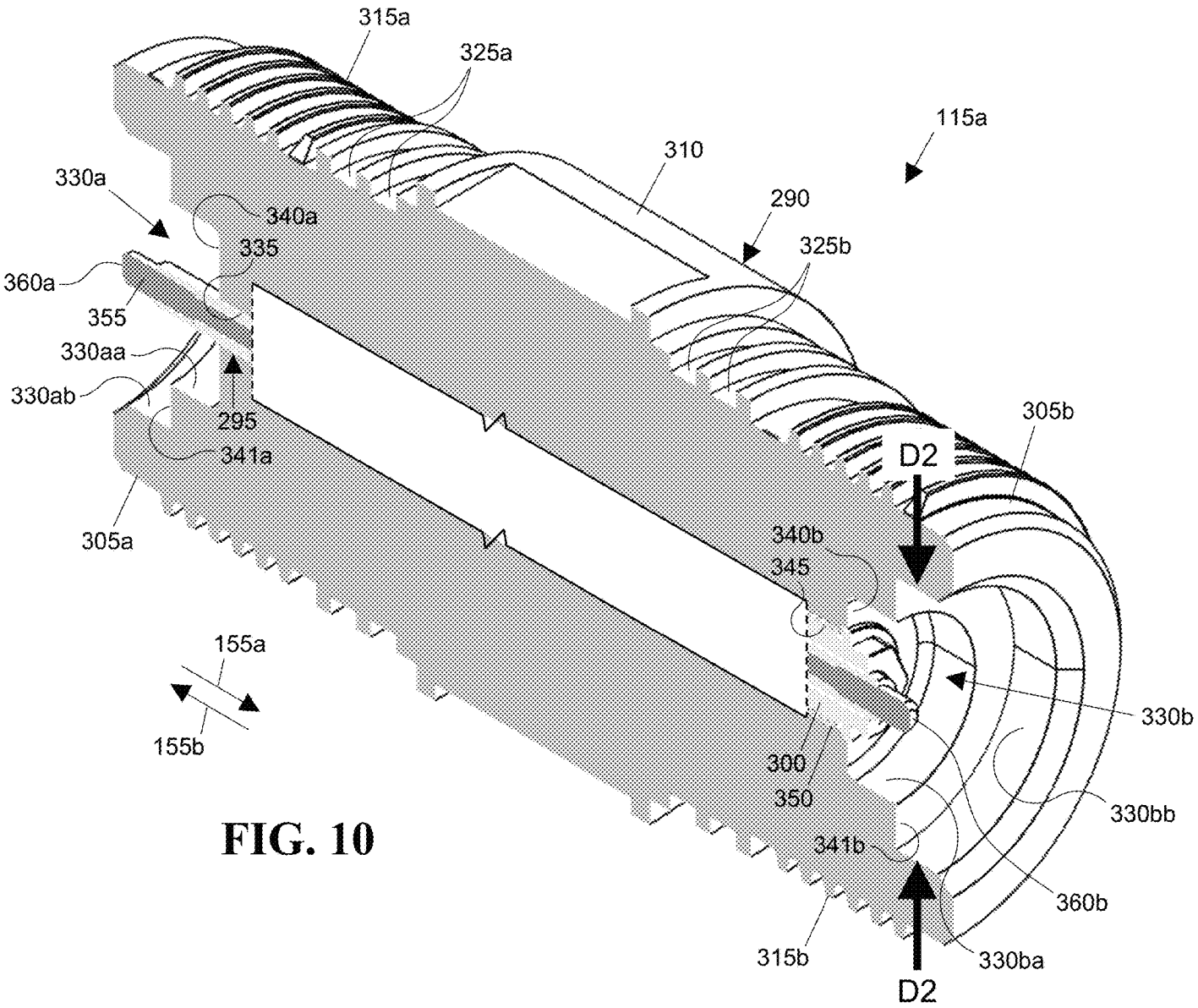
FIG. 10 is a perspective cross-sectional view of a conductor sub of the perforating gun of FIG. 1 according to one or more embodiments of the present disclosure.

Referring to FIG. 10, in one or more embodiments, the conductor sub 115*a* includes a sub body 290, a conductor assembly 295 (or "feedthrough"), and a retainer 300. The sub body 290 defines opposing end portions 305*a-b*. The sub body 290 includes an enlarged-diameter portion 310 located between the end portions 305*a-b* of the sub body 290. An external threaded connection 315*a* is formed in the sub body 290 proximate the end portion 305*a* of the sub body 290. One or more seals are adapted to extend within one or more external annular grooves 325*a* formed into the sub body 290 between the enlarged-diameter portion 310 and the external threaded connection 315*a*. Similarly, an external threaded connection 315*b* is formed in the sub body 290 proximate the end portion 305*b* of the sub body 290. One or more seals are adapted to extend within one or more external annular grooves 325*b* formed into the sub body 290 between the enlarged-diameter portion 310 and the external threaded connection 315*b*.

Opposing axial recesses 330*a-b* are formed into the sub body 290 at the end portions 305*a-b*, respectively, of the sub body 290. An internal bore 335 is formed through the sub body 290 between the axial recesses 330*a-b*. The axial recesses 330*a-b* are substantially larger in diameter than the internal bore 335; as a result, an internal face 340*a* is formed in the sub body 290 where the internal bore 335 intersects the axial recess 330*a*, and an internal face 340*b* is formed in the sub body 290 where the internal bore 335 intersects the axial recess 330*b*. The axial recess 330*a* includes a reduced-diameter portion 330*aa* adjacent the internal face 340*a* and an enlarged-diameter portion 330*ab* proximate the end portion 305*a* of the sub body 290. The enlarged-diameter portion 330*ab* defines an internal annular shoulder 341*a* in the sub body 290, which internal annular shoulder 341*a* is spaced apart from the internal face 340*a* in the direction 155*b*. Similarly, the axial recess 330*b* includes a reduced-diameter portion 330*ba* adjacent the internal face 340*b* and an enlarged-diameter portion 330*bb* proximate the end portion 305*b* of the sub body 290. The enlarged-diameter portion 330*bb* defines an internal annular shoulder 341*b* in the sub body 290, which internal annular shoulder 341*b* is spaced apart from the internal face 340*b* in the direction 155*a*.

An internal threaded connection 345 is formed in the sub body 290 at the internal bore 335, proximate the axial recess 330*a*. The retainer 300 includes an external threaded connection 350 threadably engaged with the internal threaded connection 345 of the sub body 290 to retain the conductor assembly 295 within the sub body 290. The conductor assembly 295 includes a conductor body 355 defining opposing end portions 360*a-b* disposed within the axial recesses 330*a-b*, respectively, so as not to extend beyond the opposing end portions 305*a-b* of the sub body 290 when the retainer 300 retains the conductor assembly 295 within the sub body 290.

Figure 11:
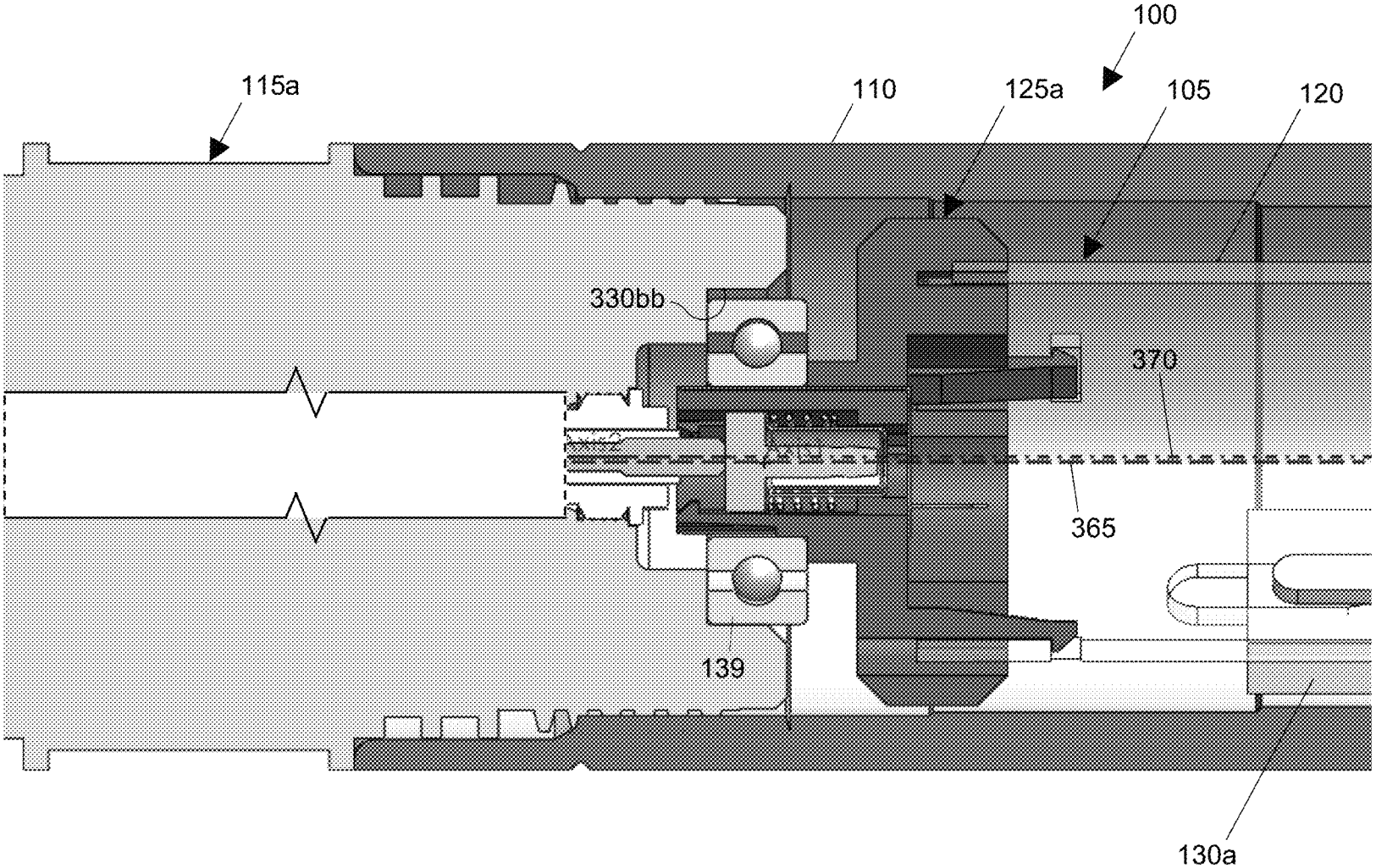
FIG. 11 is a cross-sectional view of a portion of the perforating gun of FIG. 1 in an assembled state according to one or more embodiments of the present disclosure.

Referring to FIG. 11, in one or more embodiments, the self-orienting bearing 139 has an outer diameter D1 (shown in FIG. 8) smaller than a corresponding inner diameter D2 (shown in FIG. 10) of the enlarged-diameter portion 330*bb* of the axial recess 330*b*. As a result, during operation, when the perforating gun 100 extends horizontally, gravity acts on the self-orienting charge cartridge 105, causing: the self-orienting bearing 139 to rest in the bottom of the enlarged-diameter portion 330*bb* of the axial recess 330*b*; the self-orienting bearing 139 to be spaced apart from the top of the enlarged-diameter portion 330*bb* of the axial recess 330*b*; and the self-orienting charge cartridge 105 (including the charge tube 120, the cap assemblies 125*a-b*, and the self-orienting bearings 139) to extend along a central axis 365 that is offset in a parallel relation to a corresponding central axis 370 of the conductor sub 115*a* (and the carrier tube 110). Moreover, when the perforating gun 100 extends horizontally, gravity acts on the orienting weights 130*a-b*, rotating the self-orienting charge cartridge 105 via the self-orienting bearings 139 so the perforating charges (each of which is rotationally aligned in a substantially straight line (i.e., a non-phased relationship) with adjacent one(s) of the perforating charges in FIG. 11, but could instead be phased in any configuration as needed) are aimed in a desired direction (vertically upward in FIG. 11, but could instead be aimed in another vertical and/or horizontal direction).

Figure 12:
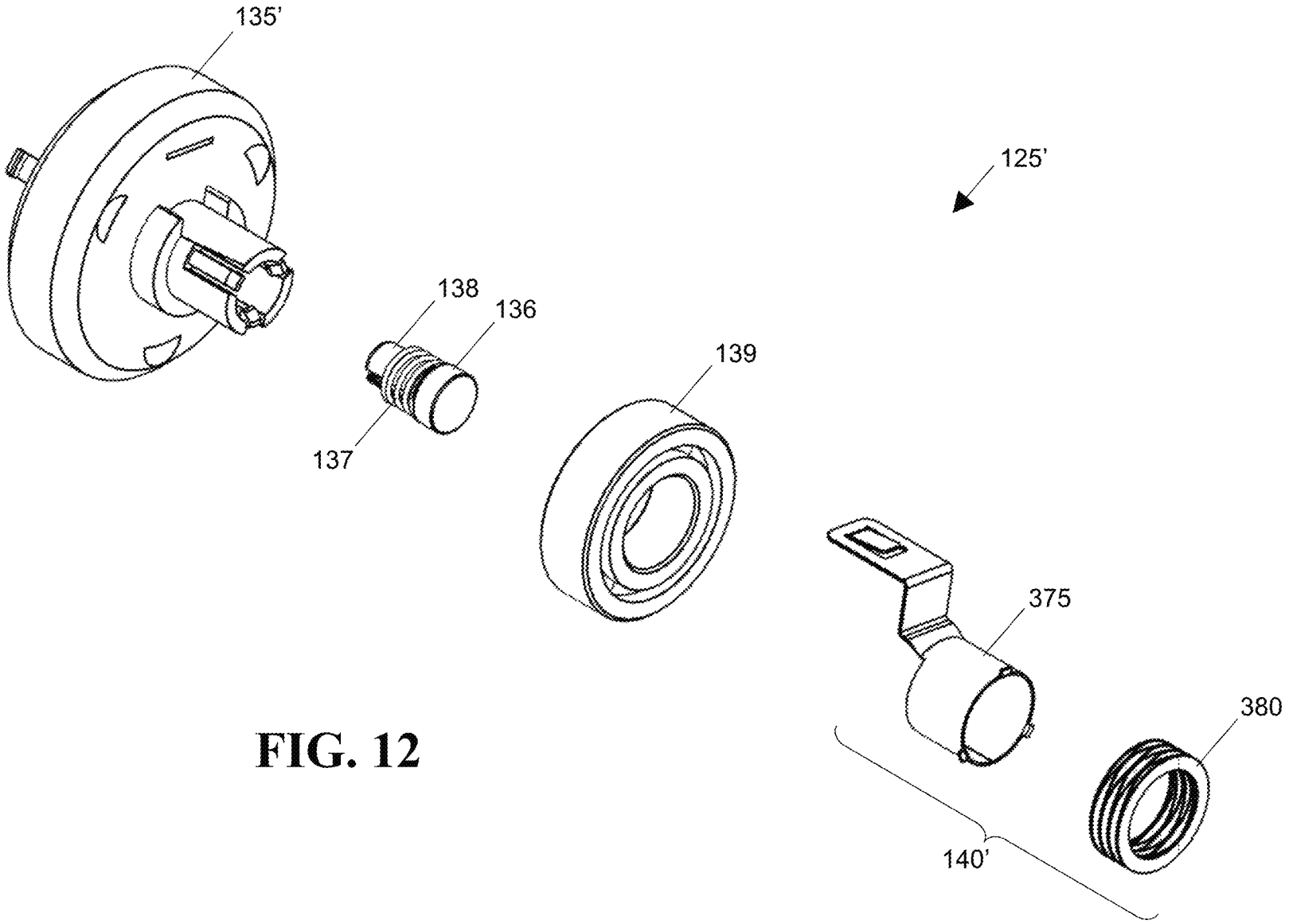
FIG. 12 is an exploded perspective view of another cap assembly according to one or more embodiments of the present disclosure.

Referring to FIG. 12, in one or more embodiments, the cap assembly 125*b* (and/or the cap assembly 125*a*) is omitted and replaced with a cap assembly 125'. The cap assembly 125' includes feature(s)/component(s) that are substantially identical to corresponding feature(s)/component(s) of the cap assemblies 125*a-b*, which substantially identical feature(s)/component(s) are given the same reference numerals. However, rather than including the end cap 135 and the ground conductor 140, the cap assembly 125' includes an end cap 135' and a ground conductor 140' (e.g., toollessly coupled to the cap assembly 125', and/or coupled to the cap assembly 125' without fastener(s)). The ground conductor 140' includes a conductor hub 375 and a ground spring 380, which are together adapted to provide grounding electrical contact between the charge tube 120 and the conductor sub 115*b* (and/or the carrier tube 110) when the charge cartridge 105 is assembled together with the carrier tube 110 and the conductor sub 115*b* is received within the carrier tube 110, as will be described in more detail below. The self-orienting bearing 139 is adapted to be received by the conductor sub 115*b* to rotatably support the end cap 135' of the cap assembly 125'.

Figure 13A:
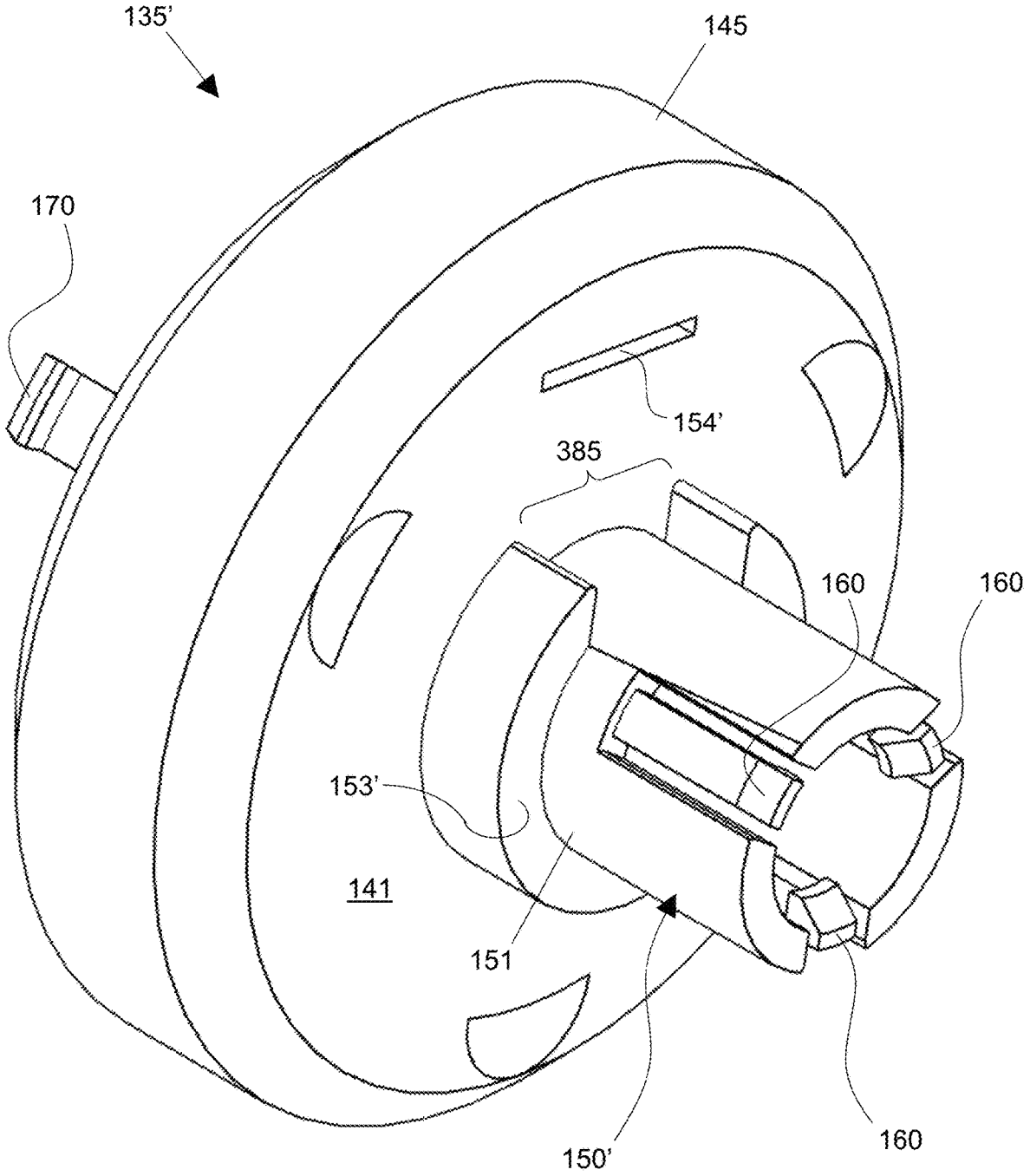
FIG. 13A is a perspective view of another end cap of the another cap assembly of FIG. 12 according to one or more embodiments of the present disclosure.
Figure 13B:
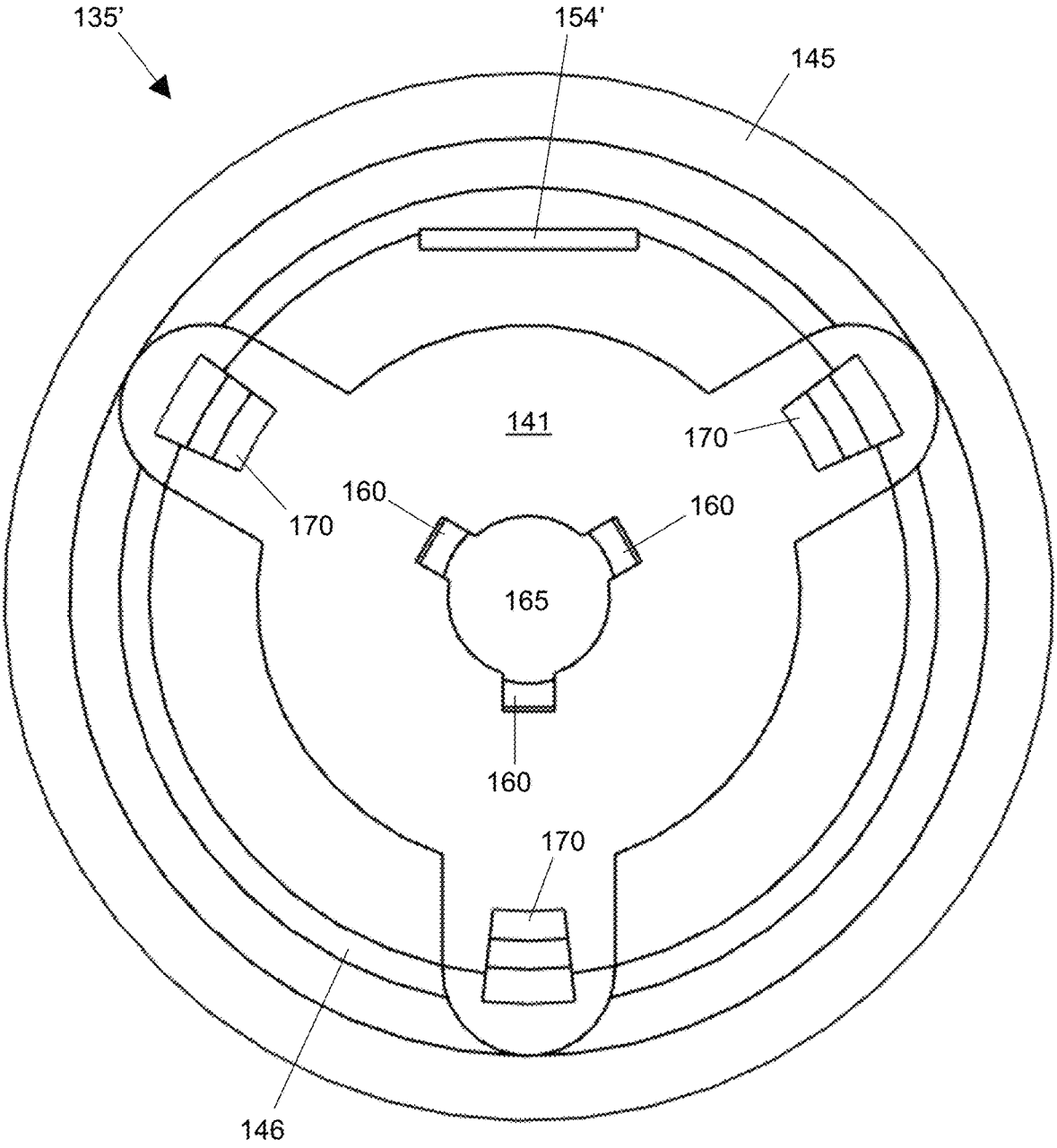
FIG. 13B is an elevational view of the another end cap of FIG. 13A according to one or more embodiments of the present disclosure.
Figure 13C:
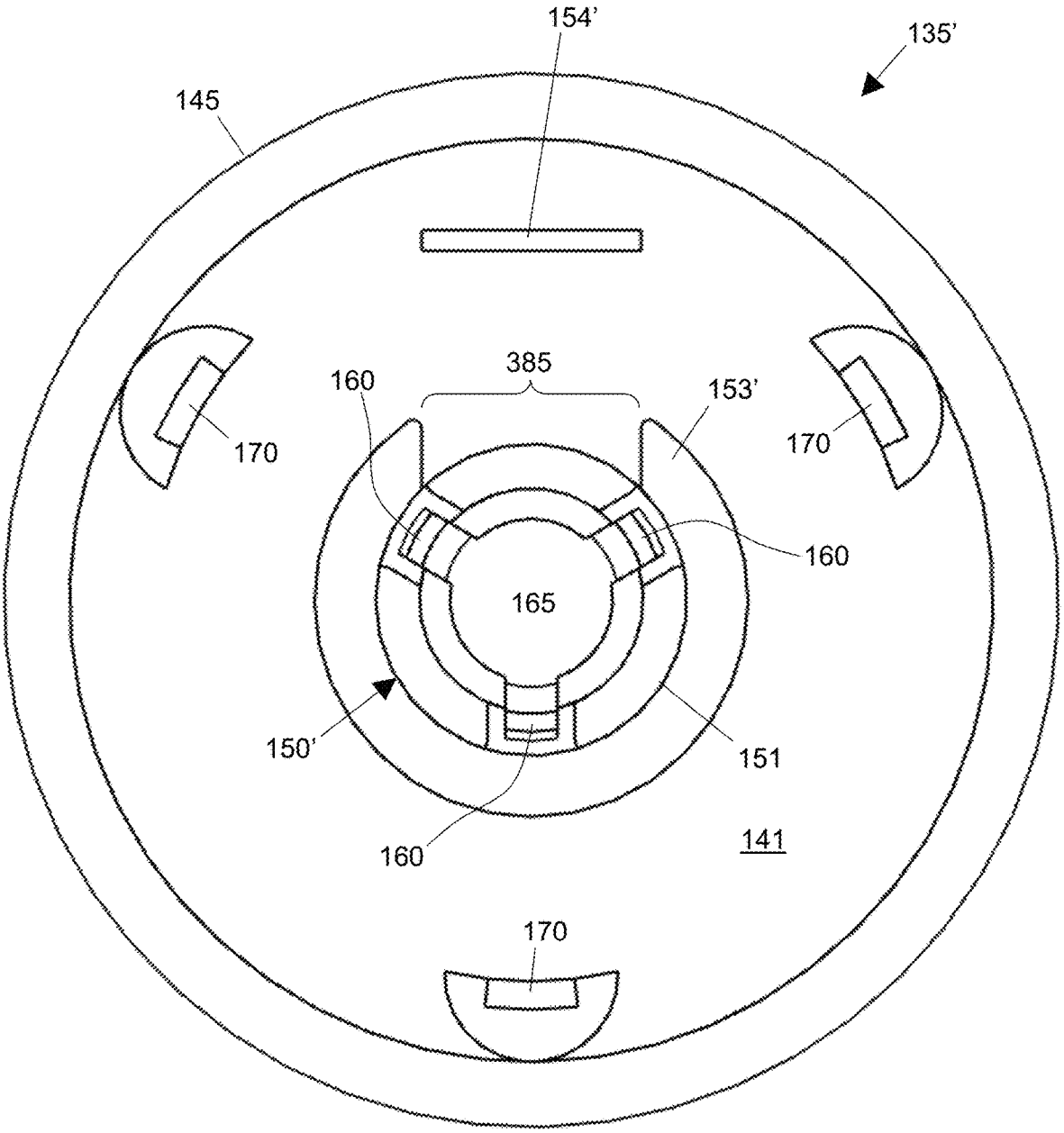
FIG. 13C is another elevational view of the another end cap of FIG. 13A according to one or more embodiments of the present disclosure.

Referring to FIGS. 13A through 13C, in one or more embodiments, the end cap 135' includes feature(s)/component(s) that are substantially identical to corresponding feature(s)/component(s) of the end cap 135, which substantially identical feature(s)/component(s) are given the same reference numerals. However, rather than including the conductor housing 150, external shoulder 153, and grounding slots 154*a-c*, the end cap 135' includes a conductor housing 150', an external shoulder 153', and a grounding slot 154'. More particularly, the conductor housing 150' defines the external surface 151, but the external lip 152 is omitted. The external shoulder 153' defines a grounding slot 385. The grounding slot 154' is formed axially through the end plate 141, radially outwardly from the grounding slot 154'. In one or more embodiments, the grounding slot 154' is radially aligned with the slot 385.

Figure 14A:
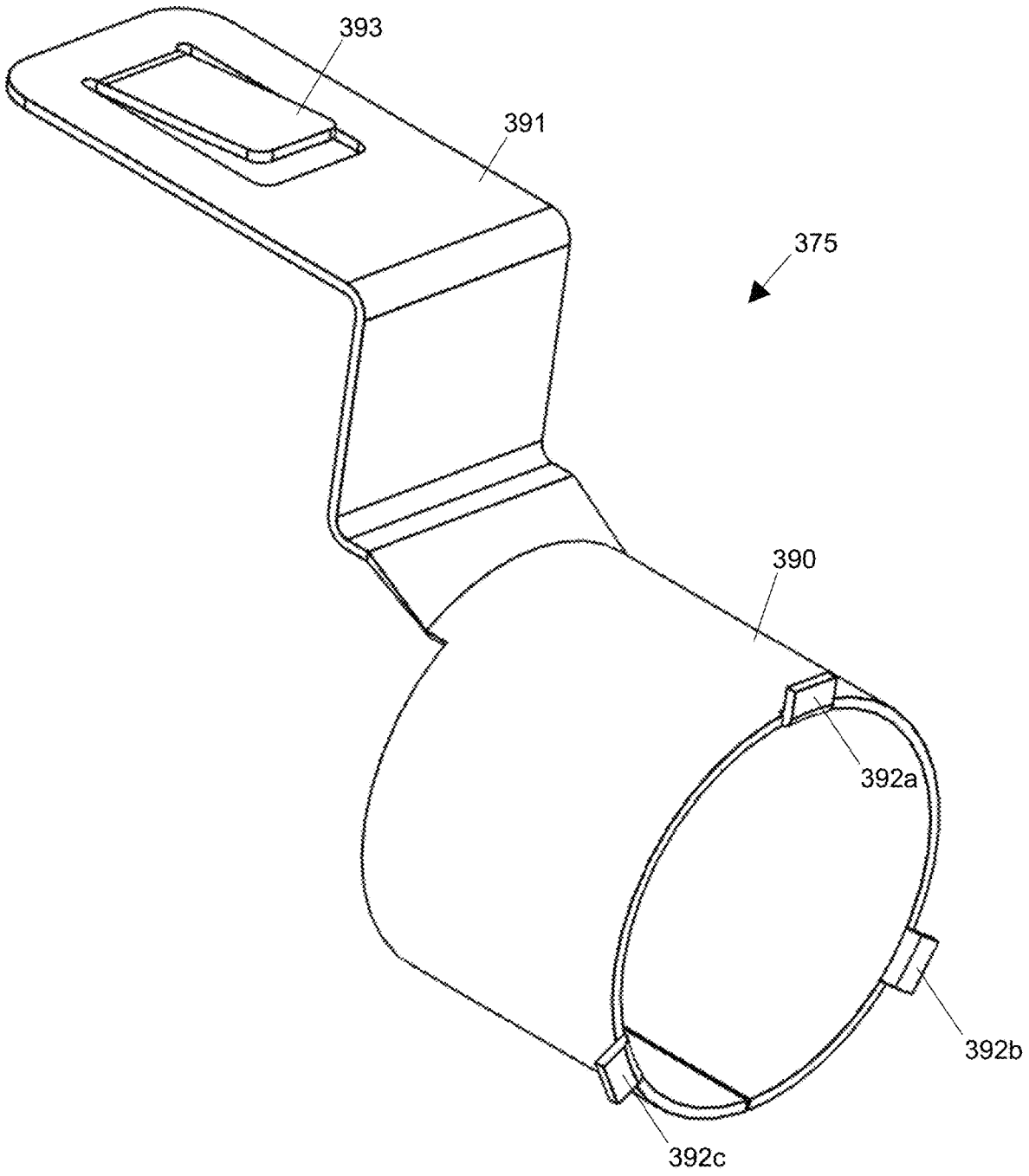
FIG. 14A is a perspective view of another ground conductor of the another cap assembly of FIG. 12 according to one or more embodiments of the present disclosure.
Figure 14B:
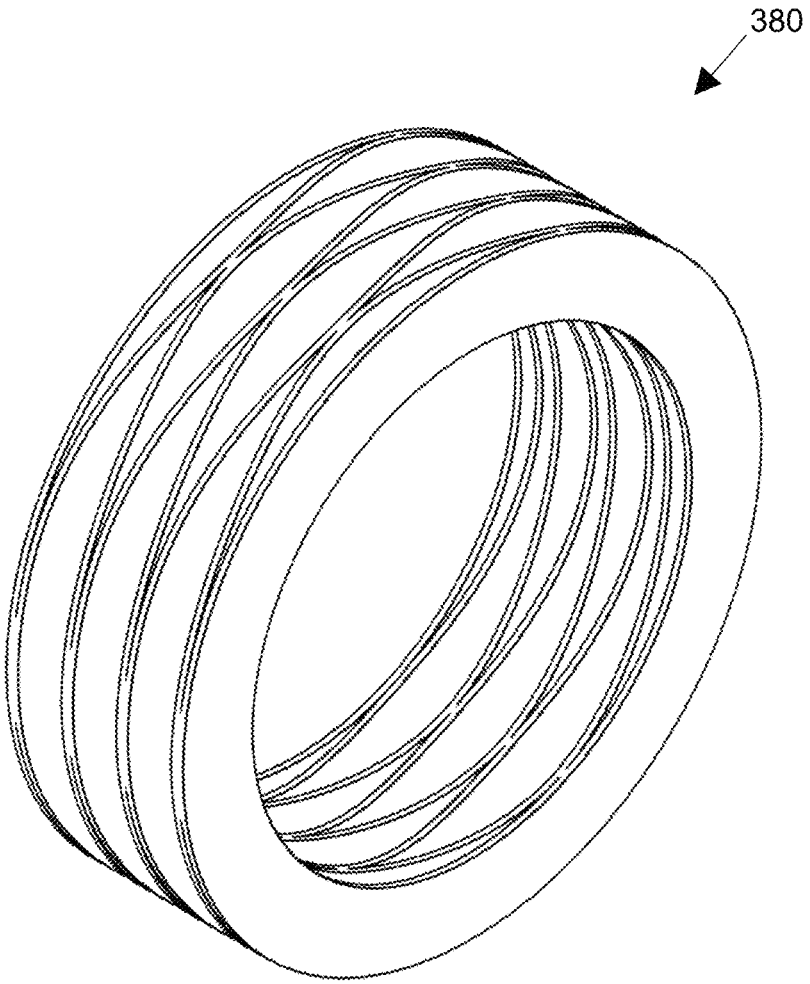
FIG. 14B is a perspective view of yet another ground conductor of the another cap assembly of FIG. 12 according to one or more embodiments of the present disclosure.

Referring to FIGS. 14A and 14B, in one or more embodiments, the conductor hub 375 (shown in FIG. 14A) of the ground conductor 140' includes a grounding ring 390, a grounding tang 391, and grounding tabs 392*a-c*. The grounding tang 391 is receivable: into the grounding slot 385; through the grounding slot 154'; and against the charge tube 120. Specifically, the grounding tang 391 includes a latching feature 393, opposite the grounding ring 390, adapted to retain the grounding tang 391 within the grounding slot 154'. Moreover, when the grounding tang 391 is so received, the self-orienting bearing 139 (e.g., an inner race of the self-orienting bearing 139) is receivable: around the grounding ring 390 (and thus the external surface 151 of the conductor housing 150'); and against the external shoulder 153' extending radially from the external surface 151 at the proximal end portion of the conductor housing 150'. The grounding tabs 392*a-c* extend radially from, and are distributed (e.g., evenly) circumferentially about, the grounding ring 390, opposite the grounding tang 391. The ground spring 380 (shown in FIG. 14B) is retained by the grounding tabs 392*a-c*, and is adapted to contact the internal face 340*a* of the of the sub body 290 of the conductor sub 115*b*. In one or more embodiments the ground spring 380 is or includes a wave spring.

Figure 15:
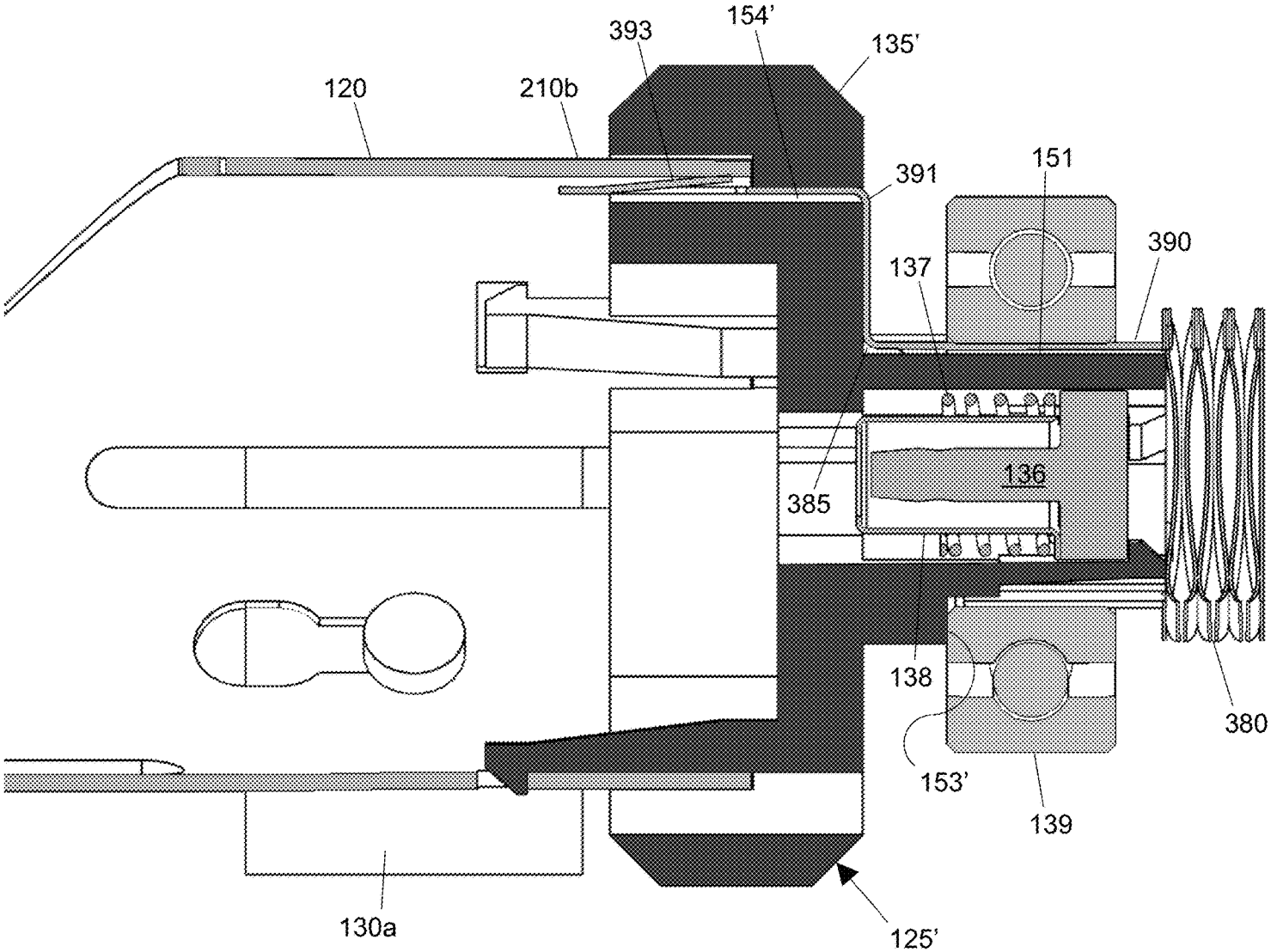
FIG. 15 is a cross-sectional view of the another cap assembly of FIG. 12 assembled into an end of a charge tube to at least partially form a self-orienting charge cartridge according to one or more embodiments of the present disclosure.

Referring to FIG. 15, the cap assembly 125' is illustrated in an assembled state according to one or more embodiments. The manner in which the cap assembly 125' is assembled (e.g., toollessly and/or without fastener(s)) into the end portion 210*b* of the charge tube 120 is substantially identical to the above-described manner in which the cap assembly 125*a* is assembled into the end portion 210*a* of the charge tube 120, and thus will not be described in any more detail. Likewise, the manner in which the conductor body 136, the biasing member 137, the connector retainer 138, and the electrical connector (not shown) are assembled (e.g., toollessly) with the end cap 135' (e.g., without fastener(s)) of the cap assembly 125' is substantially identical to the above-described manner in which these feature(s)/component(s) are assembled with the end cap 135 of the cap assembly 125*a*, and thus will not be described in any more detail. To further assemble the cap assembly 125', the grounding tang 391 of the ground conductor 140' is received: into the grounding slot 385; through the grounding slot 154'; and against the charge tube 120. The latching feature 393 retains the grounding tang 391 within the grounding slot 154'. Furthermore, the self-orienting bearing 139 (e.g., the inner race of the self-orienting bearing 139) is received: around the grounding ring 390 (and thus the external surface 151 of the conductor housing 150'); and against the external shoulder 153' extending radially from the external surface 151 at the proximal end portion of the conductor housing 150'.

Figure 16:
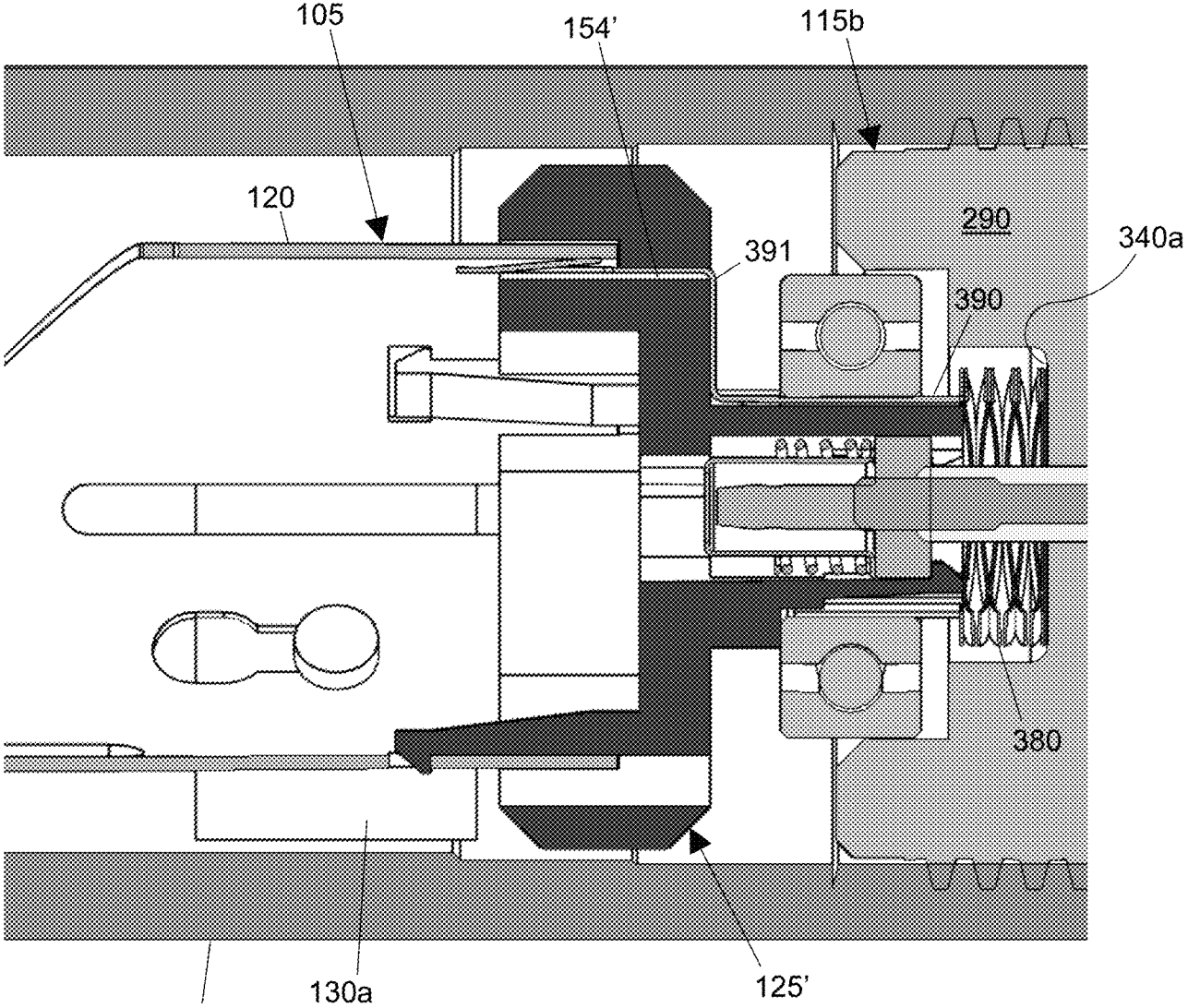
FIG. 16 is a cross-sectional view of the self-orienting charge cartridge of FIG. 16 assembled together with a conductor sub and a carrier tube according to one or more embodiments of the present disclosure.

Referring to FIG. 16, in one or more embodiments, when the charge cartridge 105 including the cap assembly 125' is assembled together with the carrier tube 110 and the conductor sub 115*b*, the ground spring 380, which is retained by the grounding tabs 392*a-c* (shown in FIG. 14A), contacts the internal face 340*a* of the of the sub body 290 of the conductor sub 115*b*. Moreover, the grounding tang 391, which extends through the grounding slot 154', contacts the charge tube 120. As a result, the ground conductor 140', including the conductor hub 375 and the ground spring 380, provides grounding electrical contact between the charge tube 120 and the conductor sub 115*b* (and/or the carrier tube 110) when the charge cartridge 105 is assembled together with the carrier tube 110 and the conductor sub 115*b*.

Figure 17:
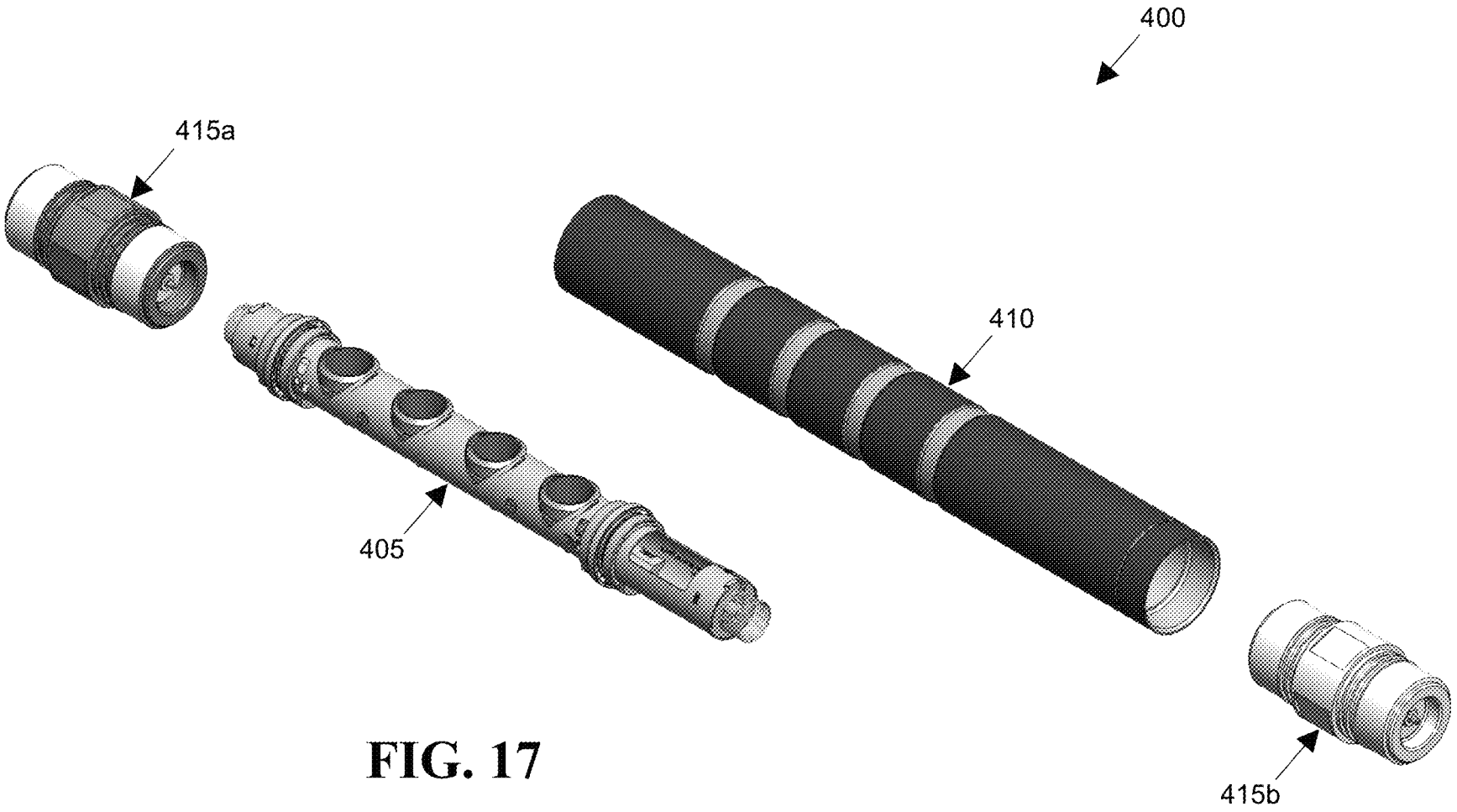
FIG. 17 is an exploded perspective view of a perforating gun according to one or more embodiments of the present disclosure.

Referring to FIG. 17, in one or more embodiments, a perforating gun is generally referred to by the reference numeral 400. The perforating gun 400 includes a self-orienting charge cartridge 405, a carrier tube 410, and conductor subs 415*a-b*. The self-orienting charge cartridge 405 is adapted to house ballistic(s), which ballistic(s) include a singular or plurality of perforating charges and detonator cord, detonable to perforate a wellbore proximate a subterranean formation. The carrier tube 410 receives the assembled self-orienting charge cartridge 405, including the ballistic(s), a detonator, and (optionally) a switch. The conductor subs 415*a-b* are adapted to: axially contain the self-orienting charge cartridge 405 within the carrier tube 410; and conduct electricity to and/or from the self-orienting charge cartridge 405 to facilitate detonation of the ballistic(s).

Figure 18:
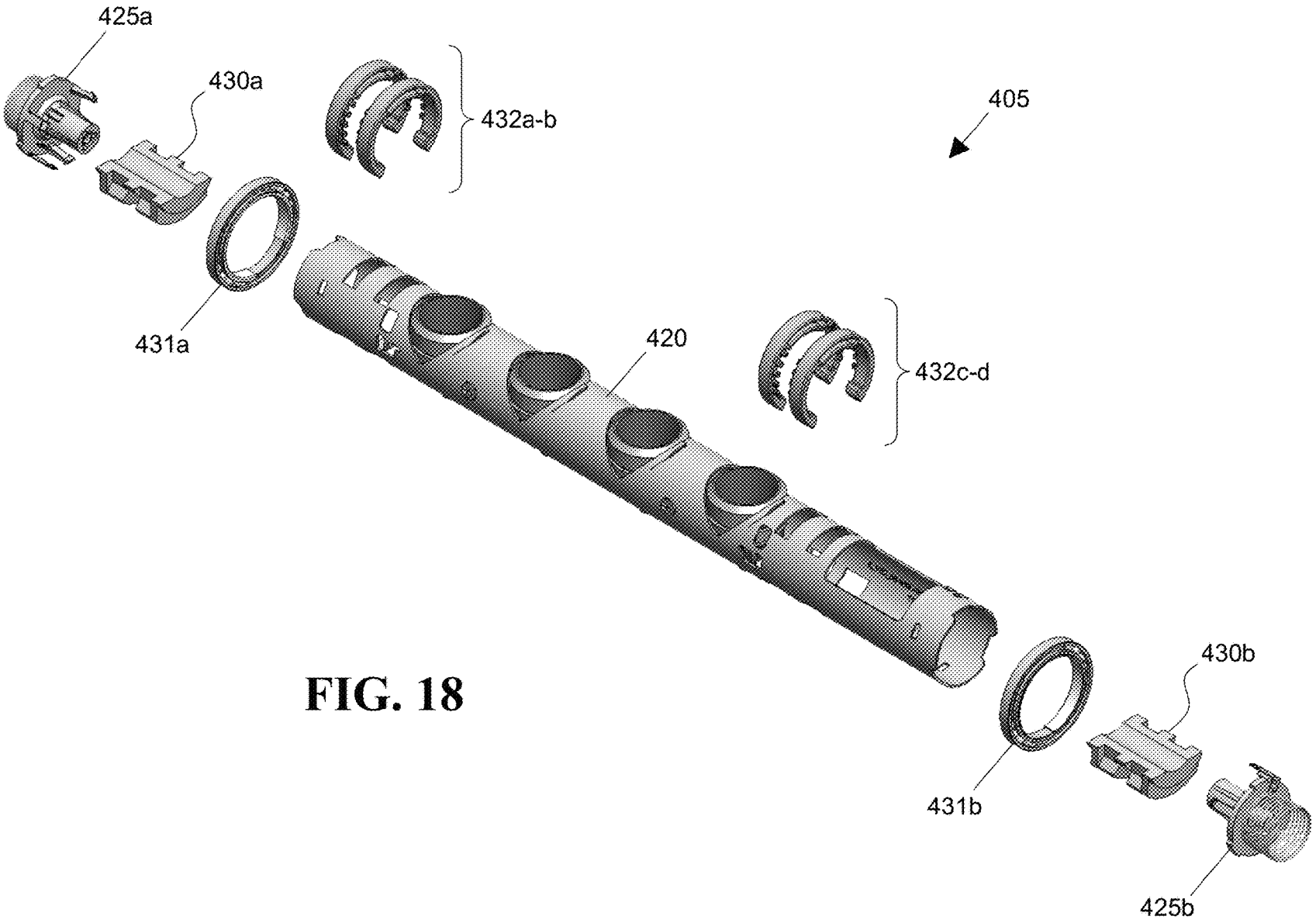
FIG. 18 is an exploded perspective view of a self-orienting charge cartridge of the perforating gun of FIG. 17 according to one or more embodiments of the present disclosure.

Referring to FIG. 18, in one or more embodiments, the self-orienting charge cartridge 405 includes a charge tube 420, cap assemblies 425*a-b*, orienting weights 430*a-b*, self-orienting bearings 431*a-b*, retaining inserts 432*a-d* (or "centralizing inserts"), and (optionally) the switch (e.g., an addressable switch). The cap assemblies 425*a-b*, the orienting weights 430*a-b*, the self-orienting bearings 431*a-b*, the retaining inserts 432*a-d*, and (optionally) the switch are configured to be toollessly assembled with the charge tube 420 (e.g., without fastener(s)).

Figure 19:
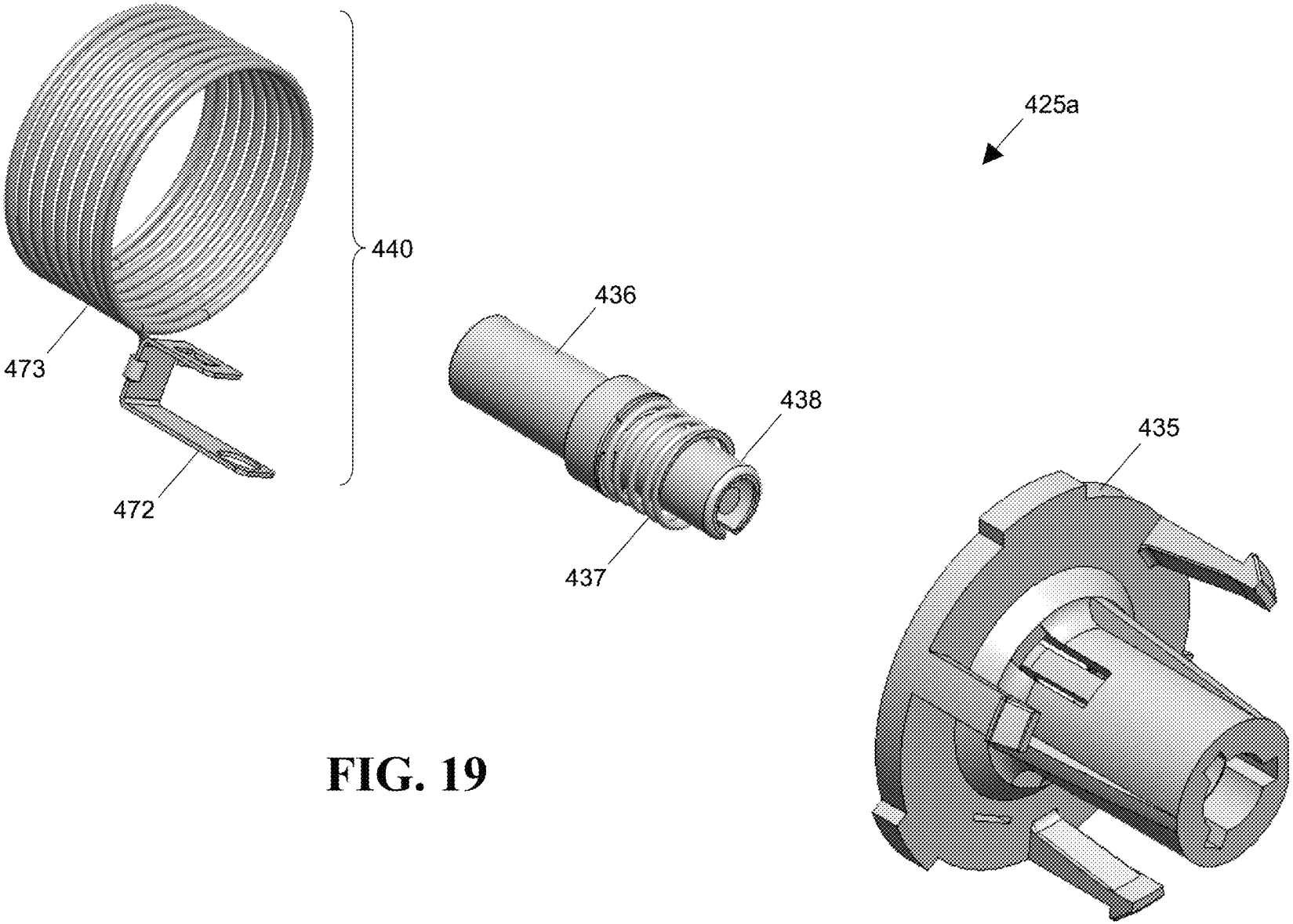
FIG. 19 is an exploded perspective view of a cap assembly of the self-orienting charge cartridge of FIG. 18 according to one or more embodiments of the present disclosure.

Referring to FIG. 19, in one or more embodiments, the cap assembly 425*a* includes an end cap 435, a conductor body 436 (or "contact conductor"), a biasing member 437, a connector retainer 438, and an electrical connector (not shown. In one or more embodiments, the connector retainer 438 is substantially identical, or at least similar, to the connector retainer 505 shown and described in the '900 Application. In one or more embodiments, the electrical connector (not shown) is substantially identical, or at least similar to the electrical connector 185 shown and described in the '900 Application, the '320 Application, and the '188 Application. The cap assembly 425*a* further includes a ground conductor 440 (e.g., toollessly coupled to the cap assembly 425*a*, and/or coupled to the cap assembly 425*a* without fastener(s)), which is adapted to provide grounding electrical contact between the charge cartridge 405 and the conductor sub 415*a* when the charge tube 420 is received within the carrier tube 410.

Figure 20A:
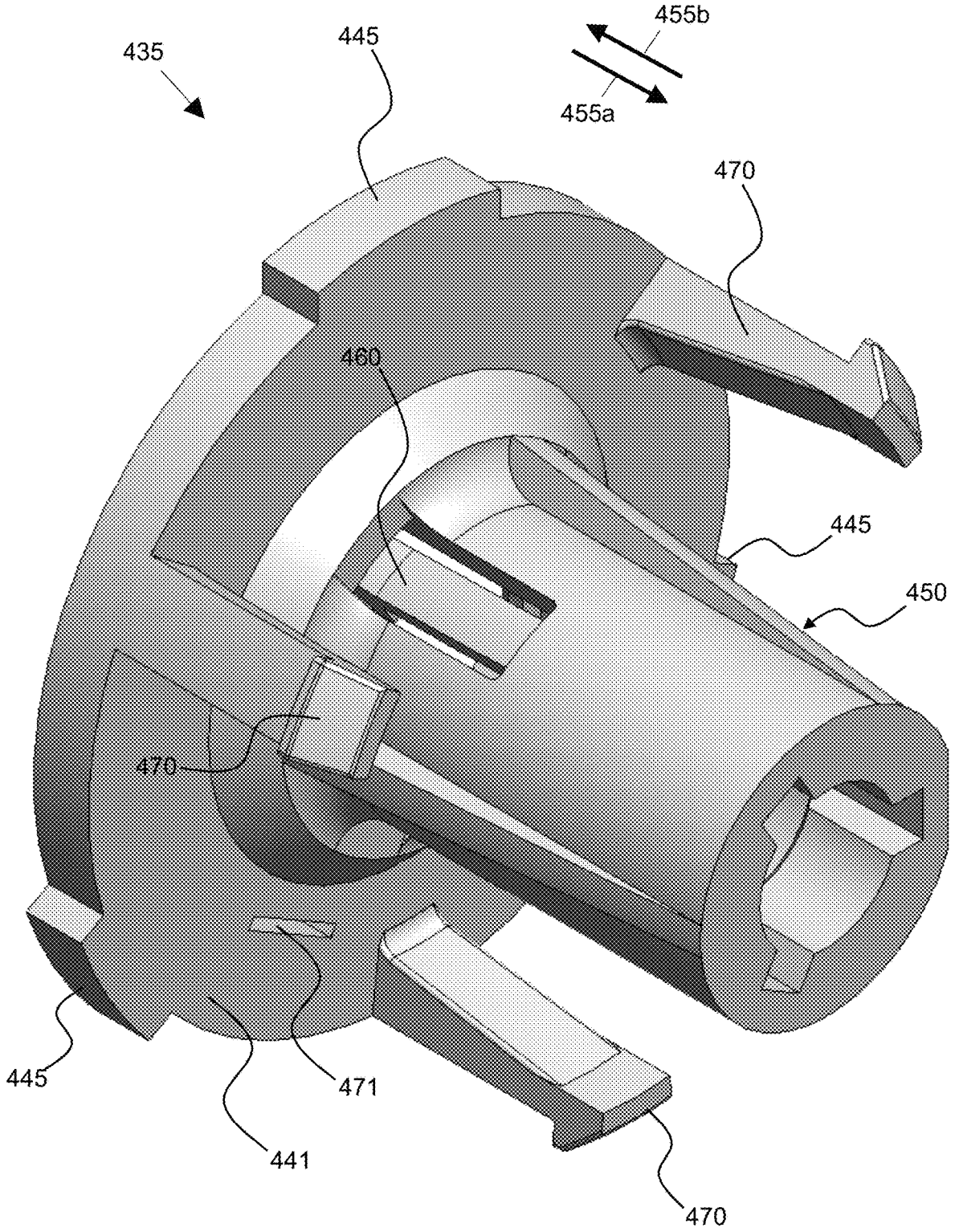
FIG. 20A is a perspective view of an end cap of the cap assembly of FIG. 19 according to one or more embodiments of the present disclosure.
Figure 20B:
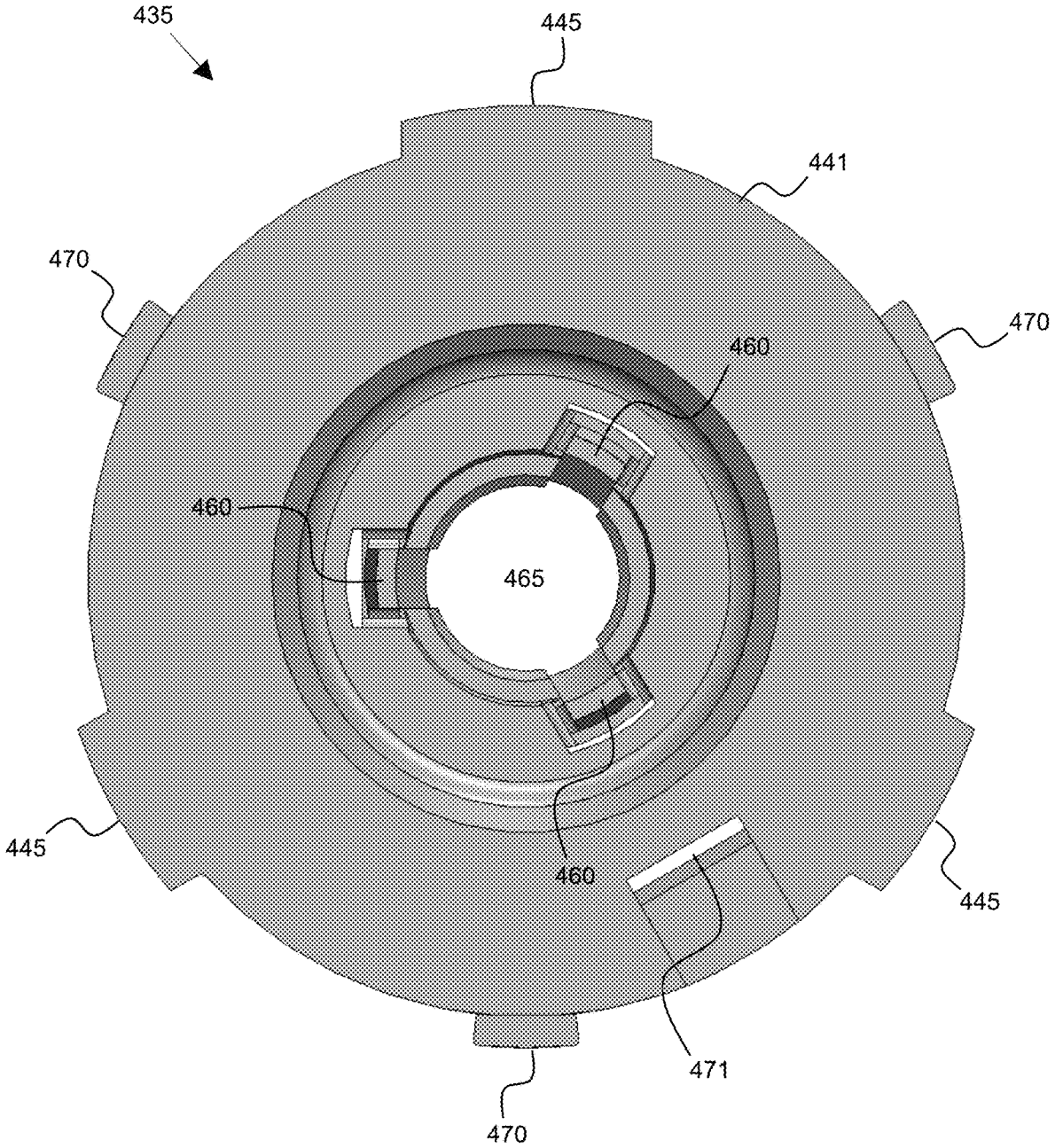
FIG. 20B is an elevational view of the end cap of FIG. 20A according to one or more embodiments of the present disclosure.
Figure 20C:
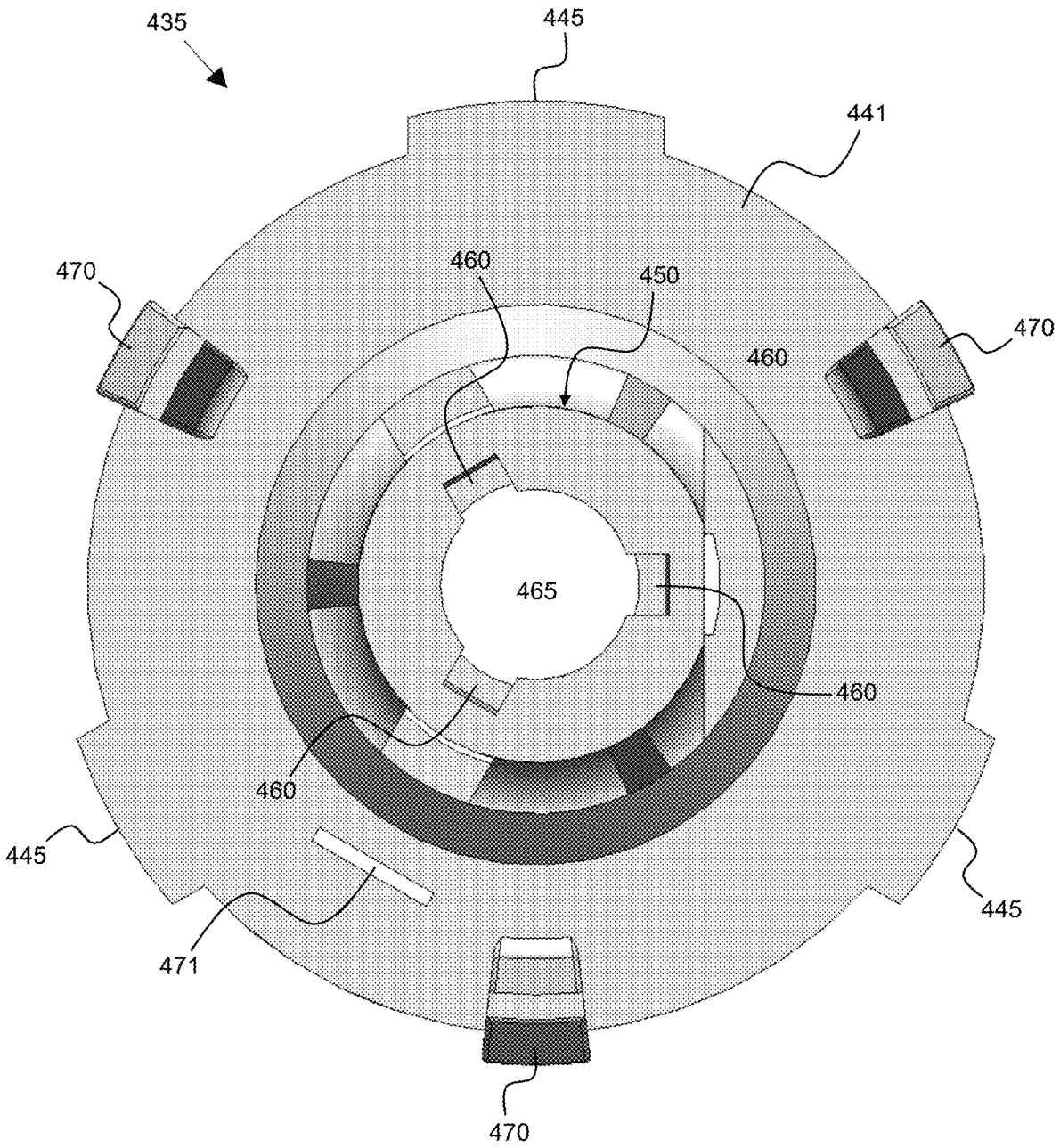
FIG. 20C is another elevational view of the end cap of FIG. 20A according to one or more embodiments of the present disclosure.

Referring to FIGS. 20A through 20C, in one or more embodiments, the end cap 435 of the cap assembly 425*a* includes an end plate 441, which end plate 441 is disk-shaped. One or more tabs 445 extend radially outwardly from an outer periphery of the end plate 441. A conductor housing 450 extends axially from the end plate 441 in a direction 455*a*. One or more latching features 460 extend axially from the conductor housing 450 in a direction 455*b*, opposite the direction 455*a*. In one or more embodiments, the latching feature(s) 460 are located along, or proximate, a circumference of a central aperture 465 of the end plate 441. In one or more embodiments, the latching feature(s) 460 are radially-inwardly-facing. Additionally, one or more latching features 470 extend axially from the outer periphery of the end plate 441 in the direction 455*a*. In one or more embodiments, the latching feature(s) 470 are located along, or proximate, an outer circumference of the end plate 441. In one or more embodiments, the latching feature(s) 470 are outwardly-facing. A grounding slot 471 is formed axially through the end plate 441. The cap assembly 425*b* is substantially identical to the cap assembly 425*a*, and, therefore, will not be described in further detail.

Figure 21A:
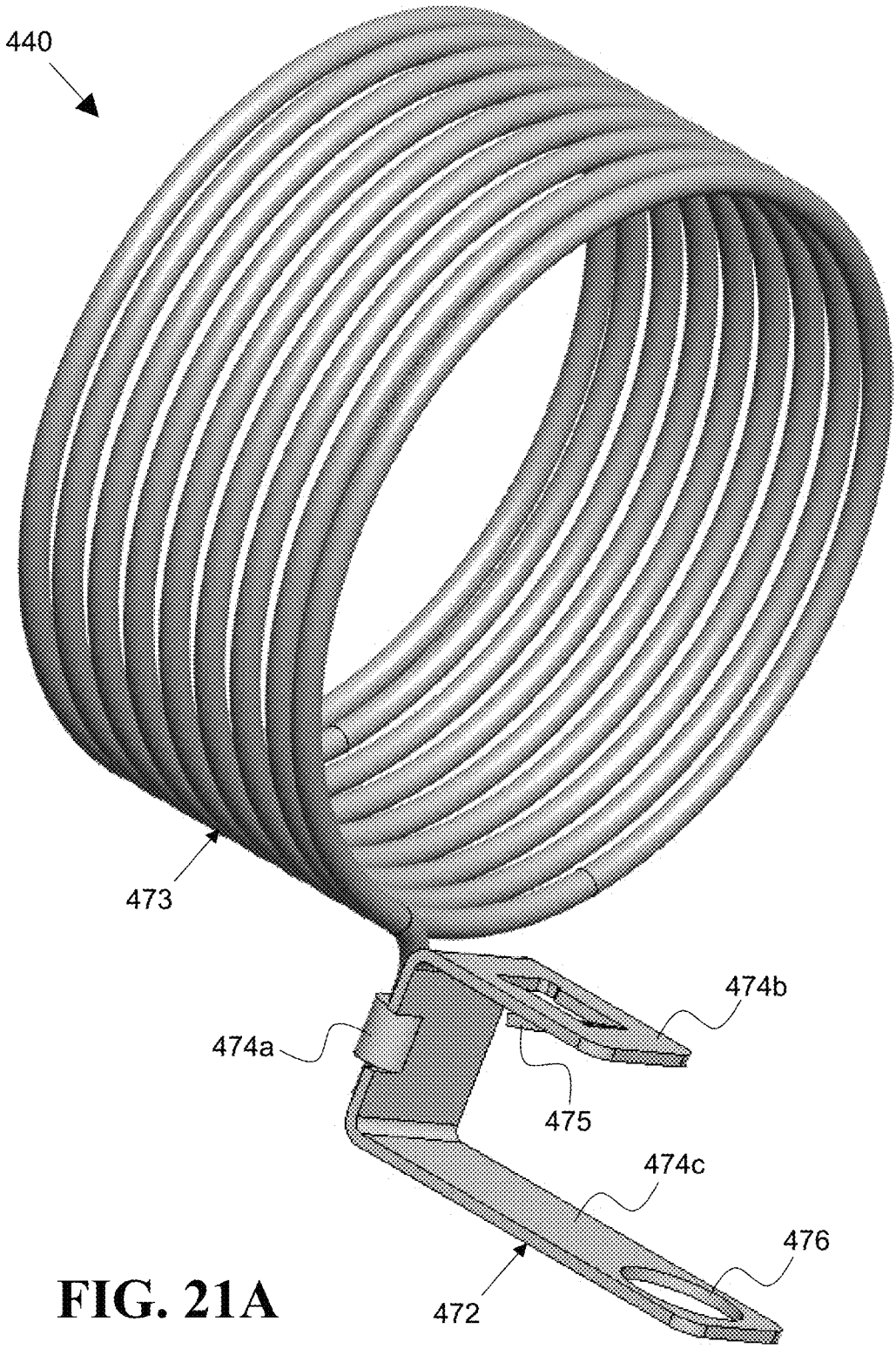
FIG. 21A is a perspective view of a ground conductor of the cap assembly of FIG. 19 according to one or more embodiments of the present disclosure.
Figure 21B:
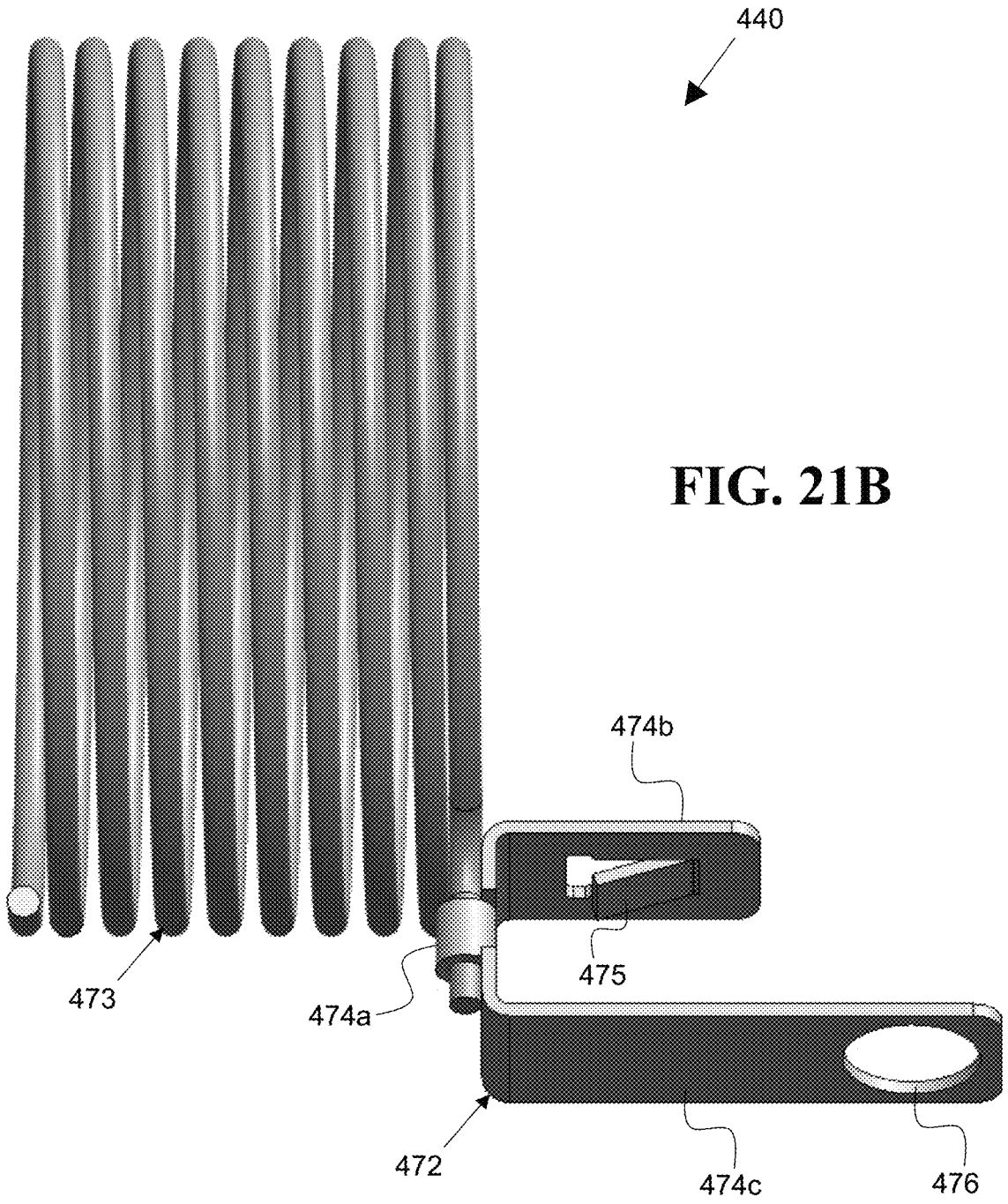
FIG. 21B is an elevations view of the ground conductor of FIG. 21A according to one or more embodiments of the present disclosure.
Figure 22A:
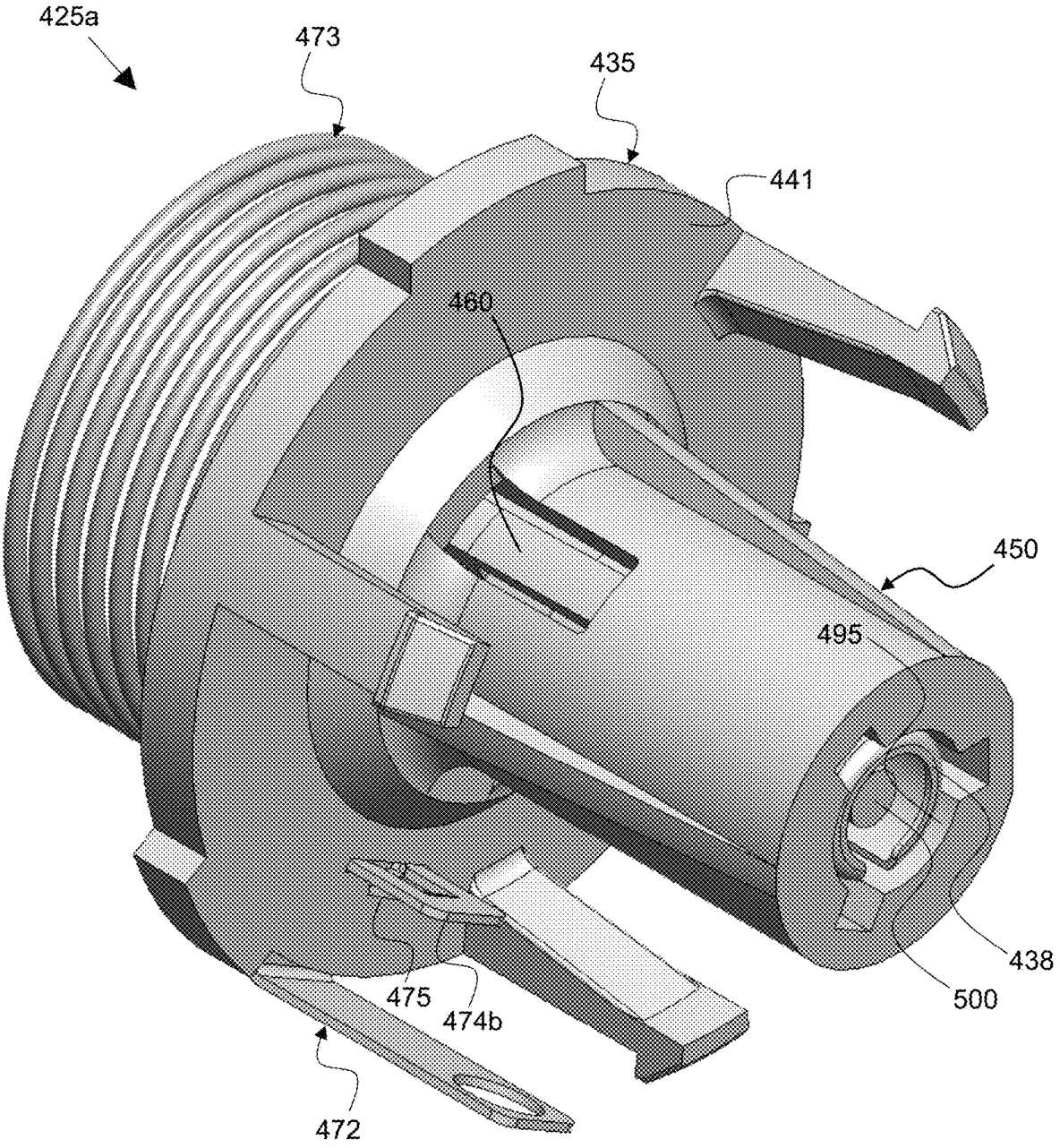
FIG. 22A is a perspective view of the cap assembly of FIG. 19 according to one or more embodiments of the present disclosure.
Figure 22B:
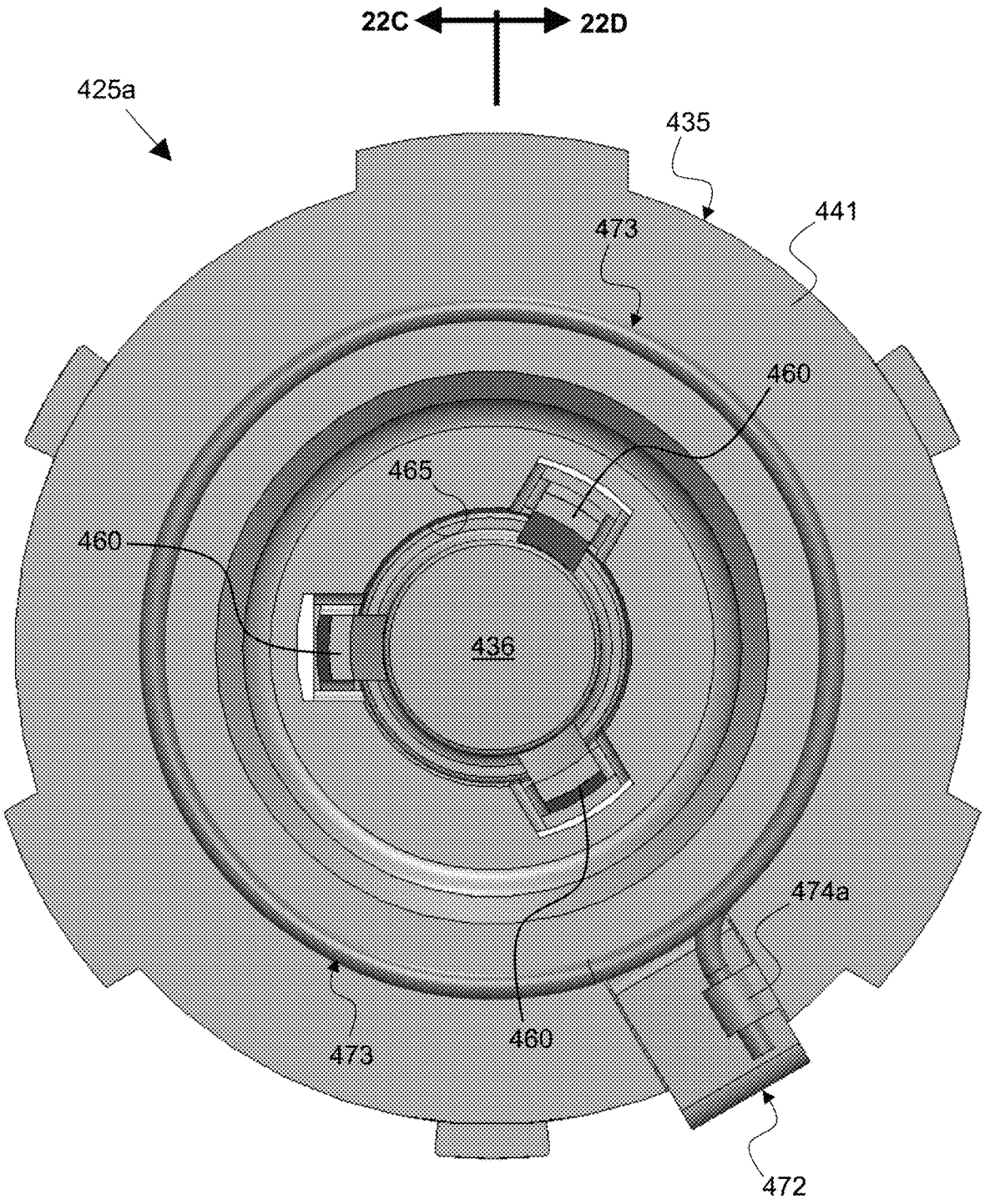
FIG. 22B is an elevational view of the cap assembly of FIG. 22A according to one or more embodiments of the present disclosure.
Figure 22C:
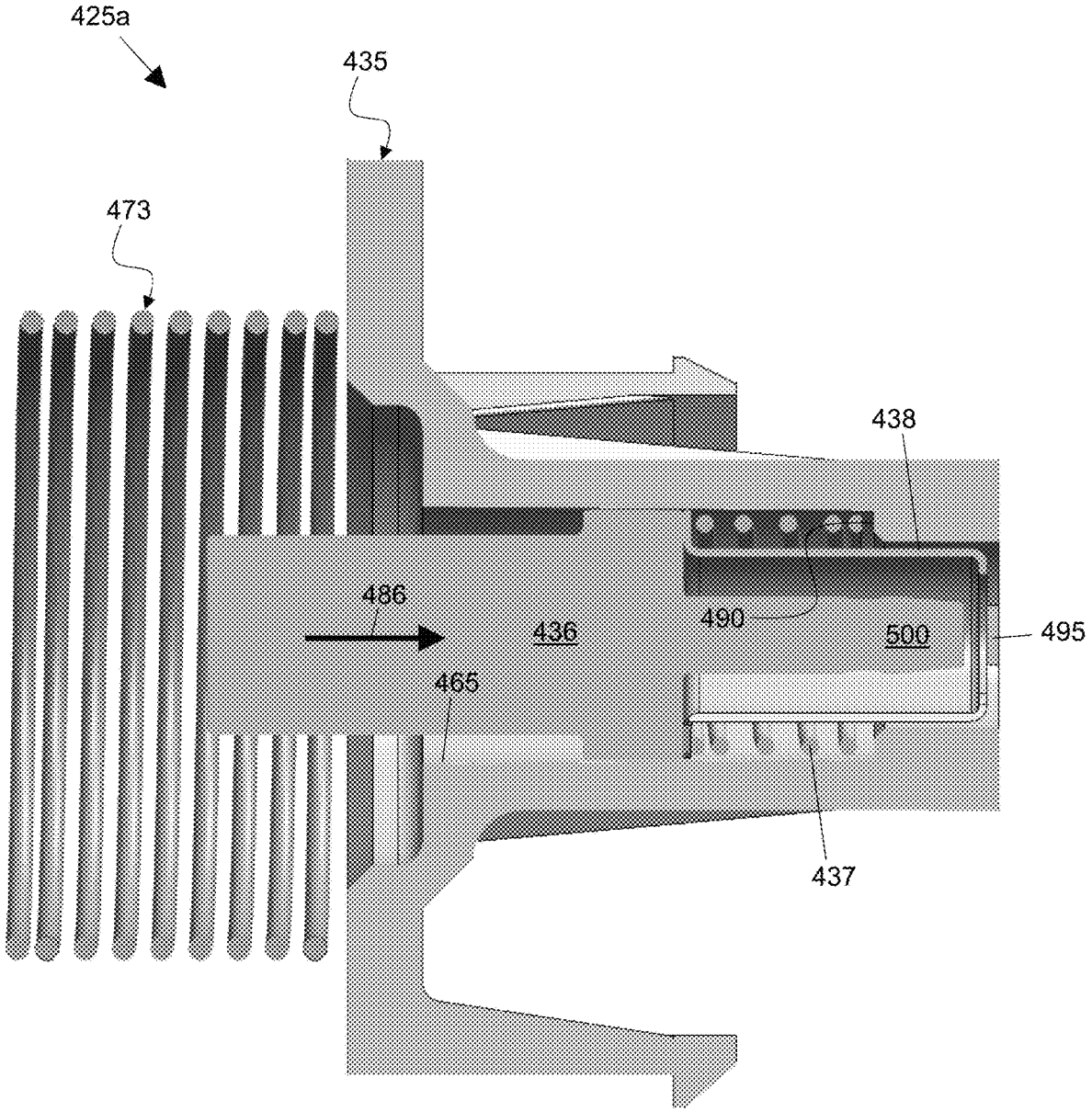
FIG. 22C is a cross-sectional view of the cap assembly of FIG. 22A taken along the line 22C-22C of FIG. 22B according to one or more embodiments of the present disclosure.
Figure 22D:
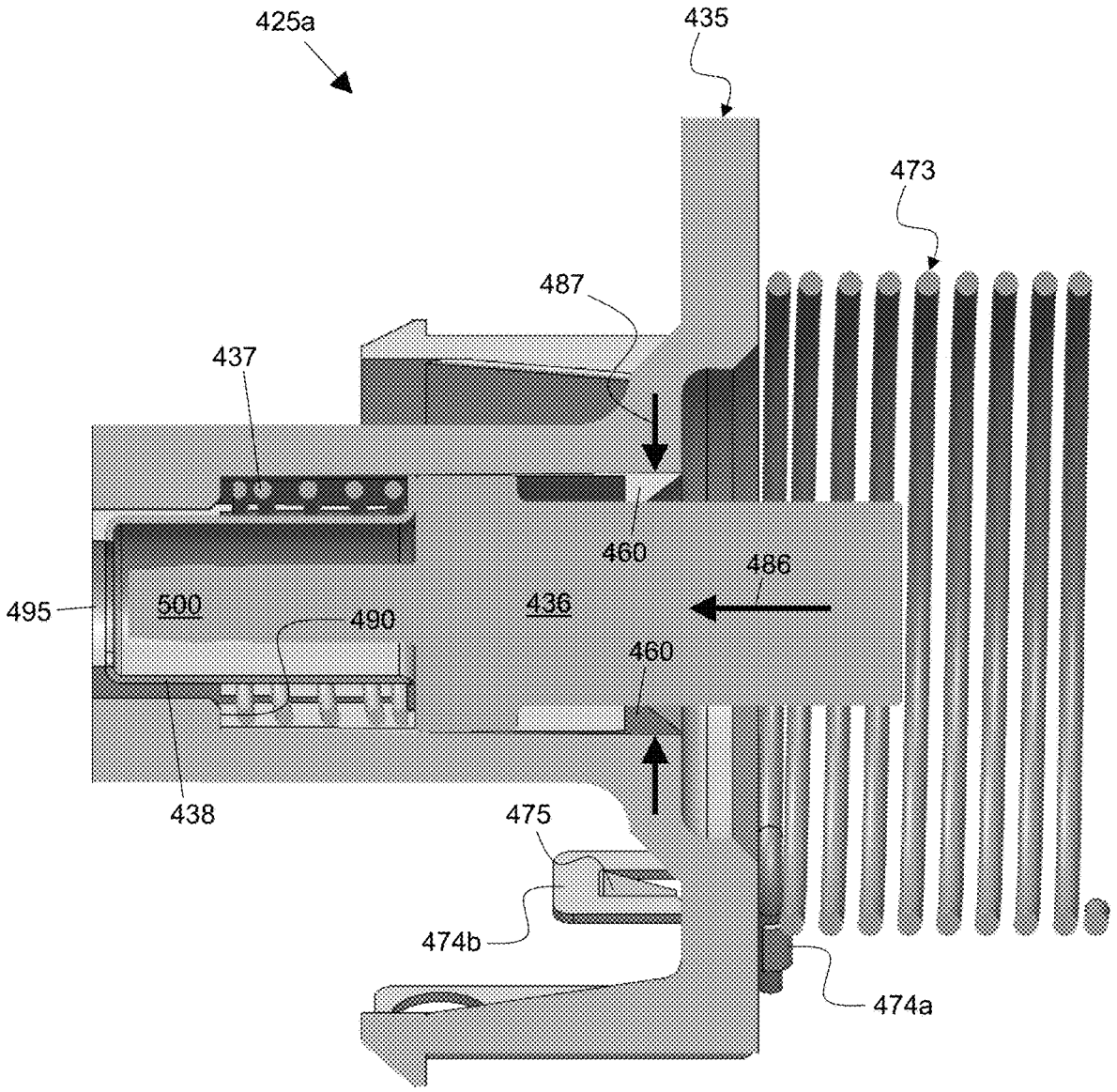
FIG. 22D is a cross-sectional view of the cap assembly of FIG. 22A taken along the line 22D-22D of FIG. 22B according to one or more embodiments of the present disclosure.
Figure 23A:
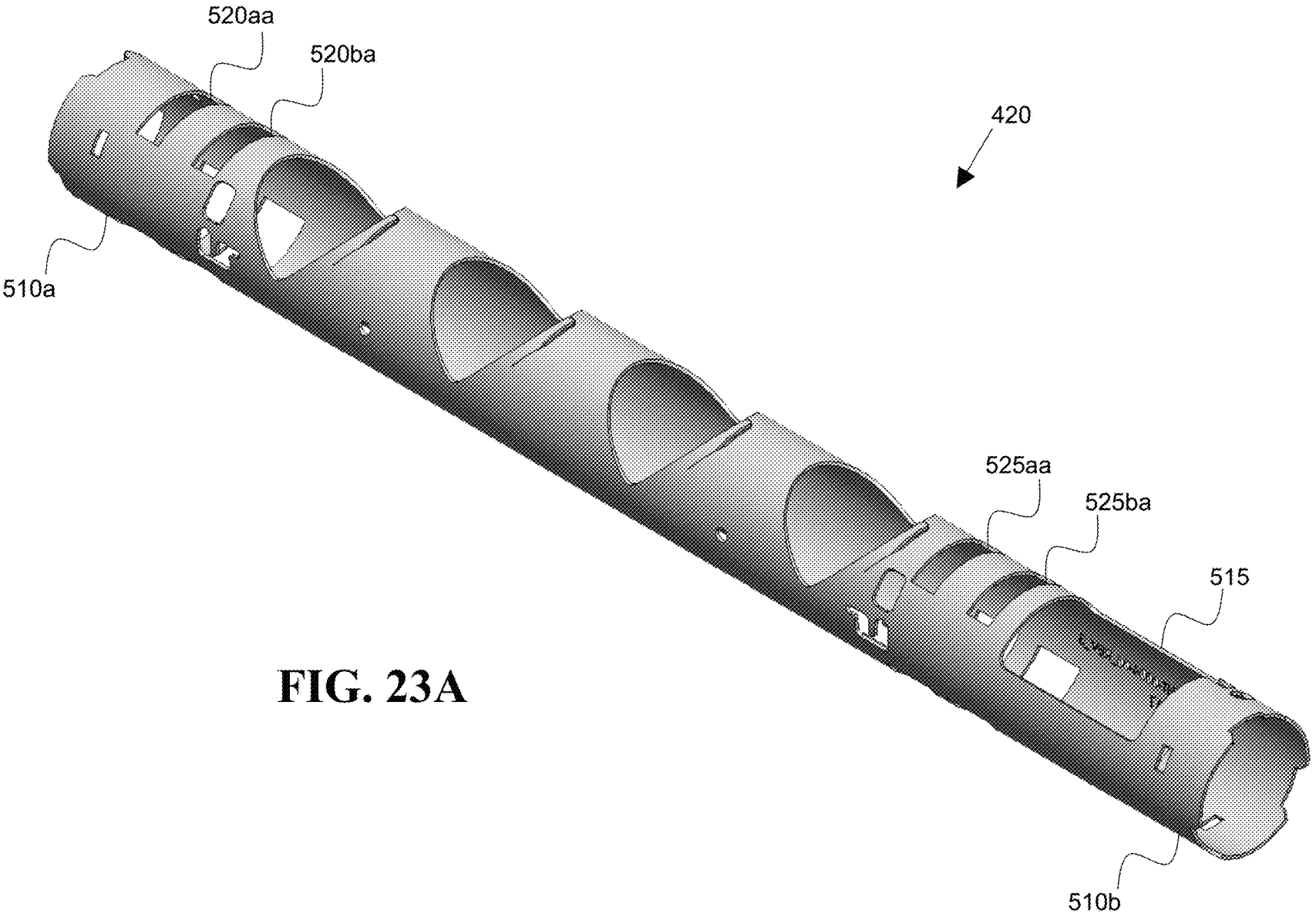
FIG. 23A is a perspective view of a charge tube of the self-orienting charge cartridge of FIG. 18 according to one or more embodiments of the present disclosure.
Figure 23B:
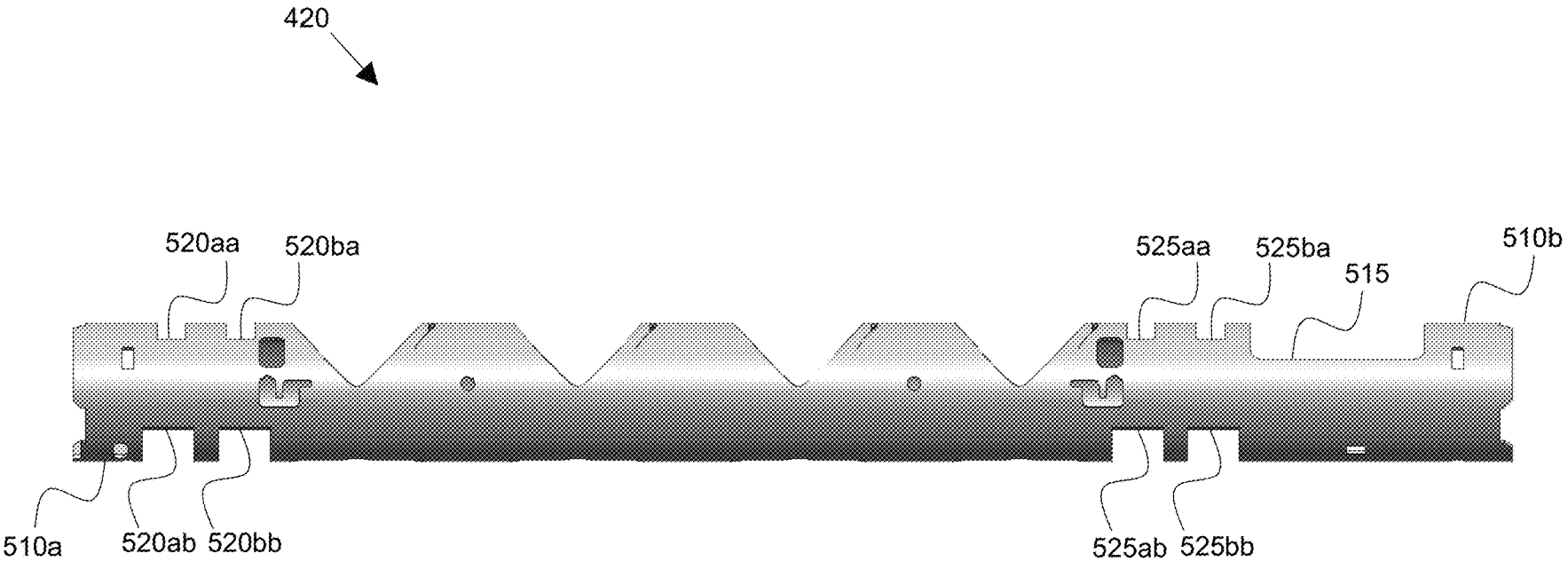
FIG. 23B is an elevational view of the charge tube of FIG. 23A according to one or more embodiments of the present disclosure.
Figure 23C:
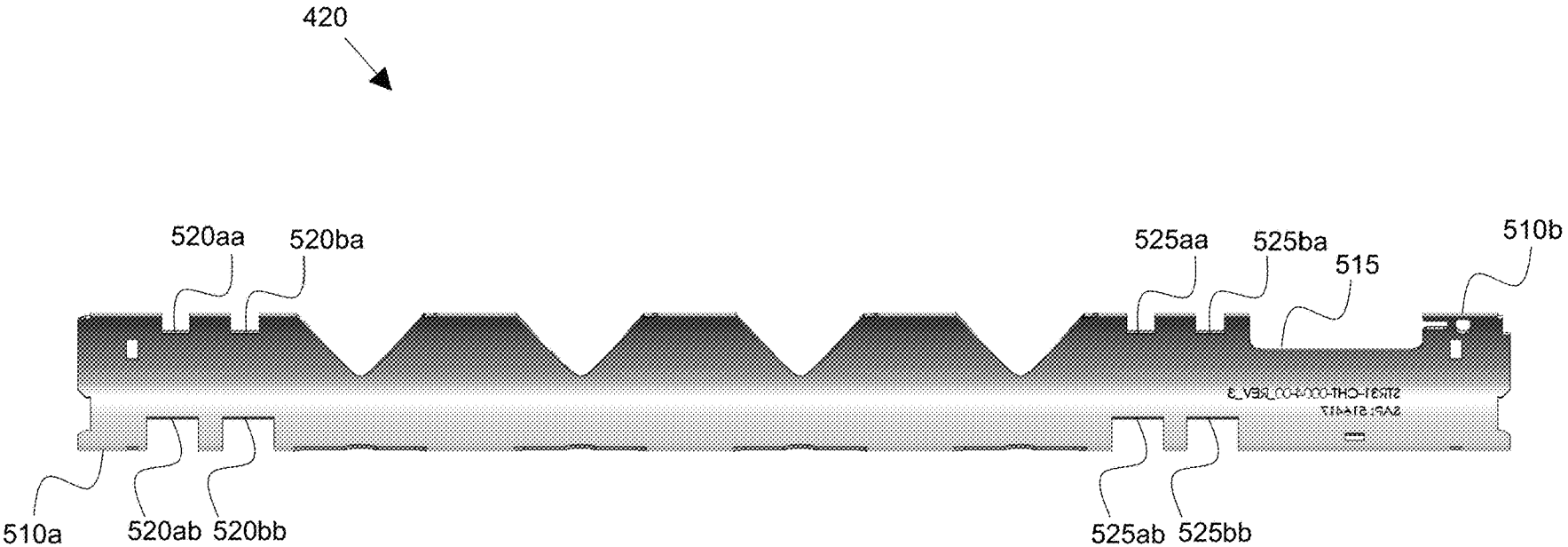
FIG. 23C is a cross-sectional view of the charge tube of FIG. 23B according to one or more embodiments of the present disclosure.
Figure 23D:
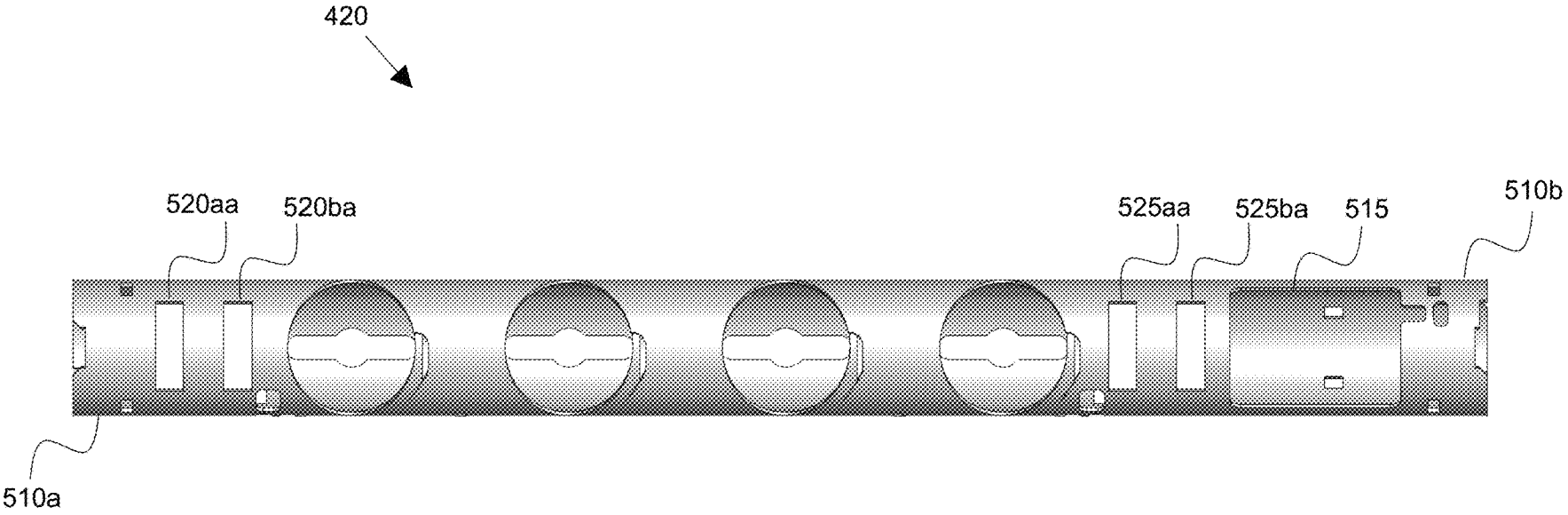
FIG. 23D is a top plan view of the charge tube of FIG. 23A according to one or more embodiments of the present disclosure.
Figure 23E:
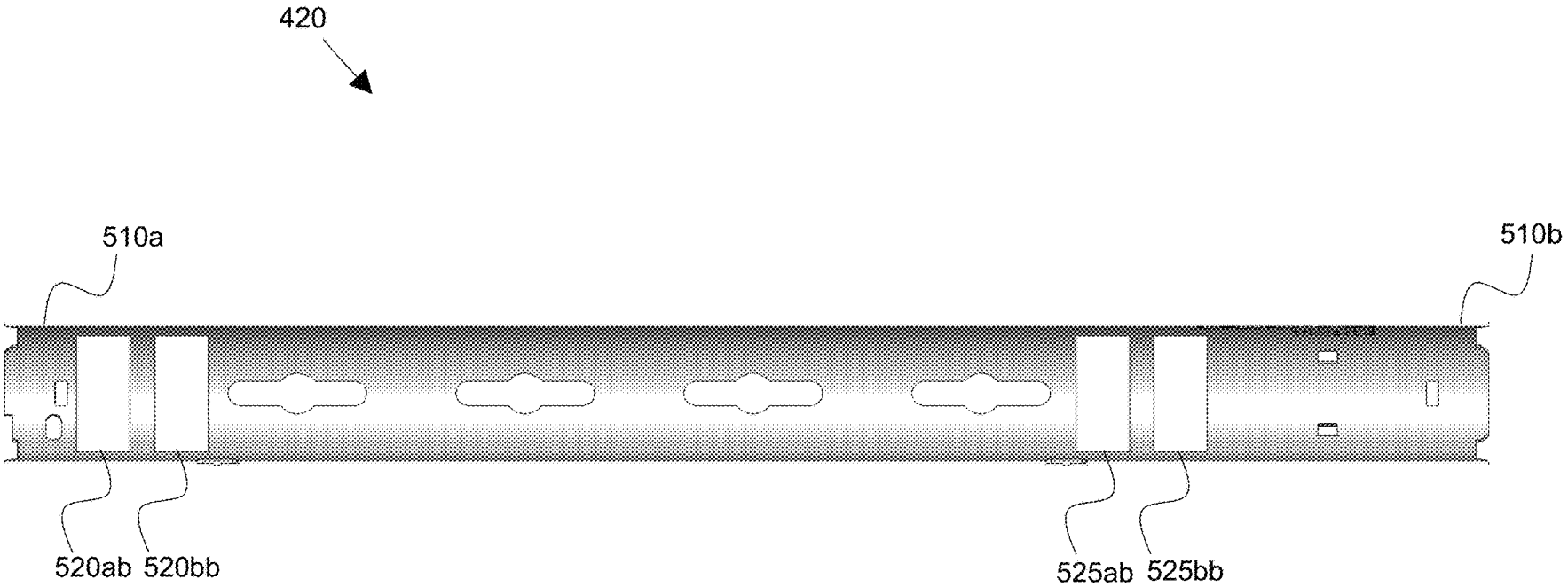
FIG. 23E is a cross-sectional view of the charge tube of FIG. 23D according to one or more embodiments of the present disclosure.

Referring to FIGS. 21A and 21B, in one or more embodiments, the ground conductor 440 includes a conductor clip 472 and a ground spring 473, which are together adapted to provide grounding electrical contact between the charge cartridge 405 and the conductor sub 415*a* when the charge cartridge 405 is assembled together with the carrier tube 410 and the conductor sub 415*a*. The conductor clip 472 of the ground conductor 440 is generally U- or J-shaped and includes a spring retainer 474*a*, a grounding tang 474*b*, and a grounding batten 474*c*. The grounding tang 474*b* is receivable into the grounding slot 471 of the end cap 435 and includes a latching feature 475 adapted to retain the grounding tang 474*b* within the grounding slot 471. The grounding batten 474*c* is receivable along the charge tube 420 and includes an opening 476 via which the conductor clip 472 is fastenable to the charge tube 420. The ground spring 473 is retained by the spring retainer 474*a*, and is adapted to contact the conductor sub 415*a* when the charge cartridge 405 is assembled together with the carrier tube 410 and the conductor sub 415*a*.

Referring to FIGS. 22A through 22D, in one or more embodiments, the conductor body 436, the biasing member 437, the connector retainer 438 (with the electrical connector (not shown)), and the ground conductor 440 are configured to be toollessly assembled with the end cap 435 (e.g., without fastener(s)). More particularly, the conductor body 436, the biasing member 437, and the connector retainer 438 are inserted axially into the conductor housing 450, as indicated by arrow 486, via the central aperture 465 of the end plate 441, causing the latching feature(s) 460 of the end cap 435 to latch onto the conductor body 436, as indicated by arrows 487, thereby trapping the conductor body 436 between the latching feature(s) 460 and an internal annular shoulder 490 of the end cap 435. The electrical connector (not shown) extends through the a central aperture 495 of the conductor housing 450, opposite the central aperture 465 of the end plate 441, fits over a reduced-diameter end portion 500 of the conductor body 436, and is adapted to electrically connect a wire from the detonator and/or the switch to the conductor body 436. In one or more embodiments, as in FIGS. 22A through 22D, the cap assembly 425*a* further includes the ground conductor 440 (e.g., toollessly coupled to the cap assembly 425*a*, and/or coupled to the cap assembly 425*a* without fastener(s)) adapted to provide grounding electrical contact between the charge cartridge 405 and the carrier tube 410 when the charge cartridge 405 is assembled together with the carrier tube 410 and the conductor sub 415*a*. In particular, the grounding tang 474*b* is received into the grounding slot 471 of the end cap 435, and is retained in the grounding slot 471 by the latching feature 475.

Referring to FIGS. 23A through 23E, in one or more embodiments, the charge tube 420 defines opposing end portions 510*a-b*. Although shown as a single integrally formed body, the charge tube 420 may instead be broken into two or more interconnected components. An access port or window 515 is formed radially through the charge tube 420 at or proximate the end portion 510*a* of the charge tube 420, which access port or window 515 permits access to an interior of the charge tube 420 at the end portion 510*b* of the charge tube 420, permitting insertion of a detonator on-site during assembly of the perforating gun 400 and immediately before the perforating gun 400 is deployed into a wellbore. Additionally, circumferentially-opposing slots 520*aa-ab* and 520*ba-bb* are formed radially through the charge tube 420 at or proximate the end portion 510*a* of the charge tube 420, via which slots 520*aa-ab* and 520*ba-bb* the retaining inserts 432*a-b* are insertable into the charge tube 420 (in the manner shown most clearly in FIG. 30B). Similarly, circumferentially-opposing slots 525*aa-ab* and 525*ba-bb* are formed radially through the charge tube 420 at or proximate the end portion 510*b* of the charge tube 420, via which slots 525*aa-ab* and 525*ba-bb* the retaining inserts 432*c-d* are insertable into the charge tube 420 (in a manner similar to that shown most clearly in FIG. 30B). When so inserted into the charge tube 420, the retaining inserts 432*a-d* are each spaced inwardly from the corresponding ends of the charge tube 420.

Figure 24A:
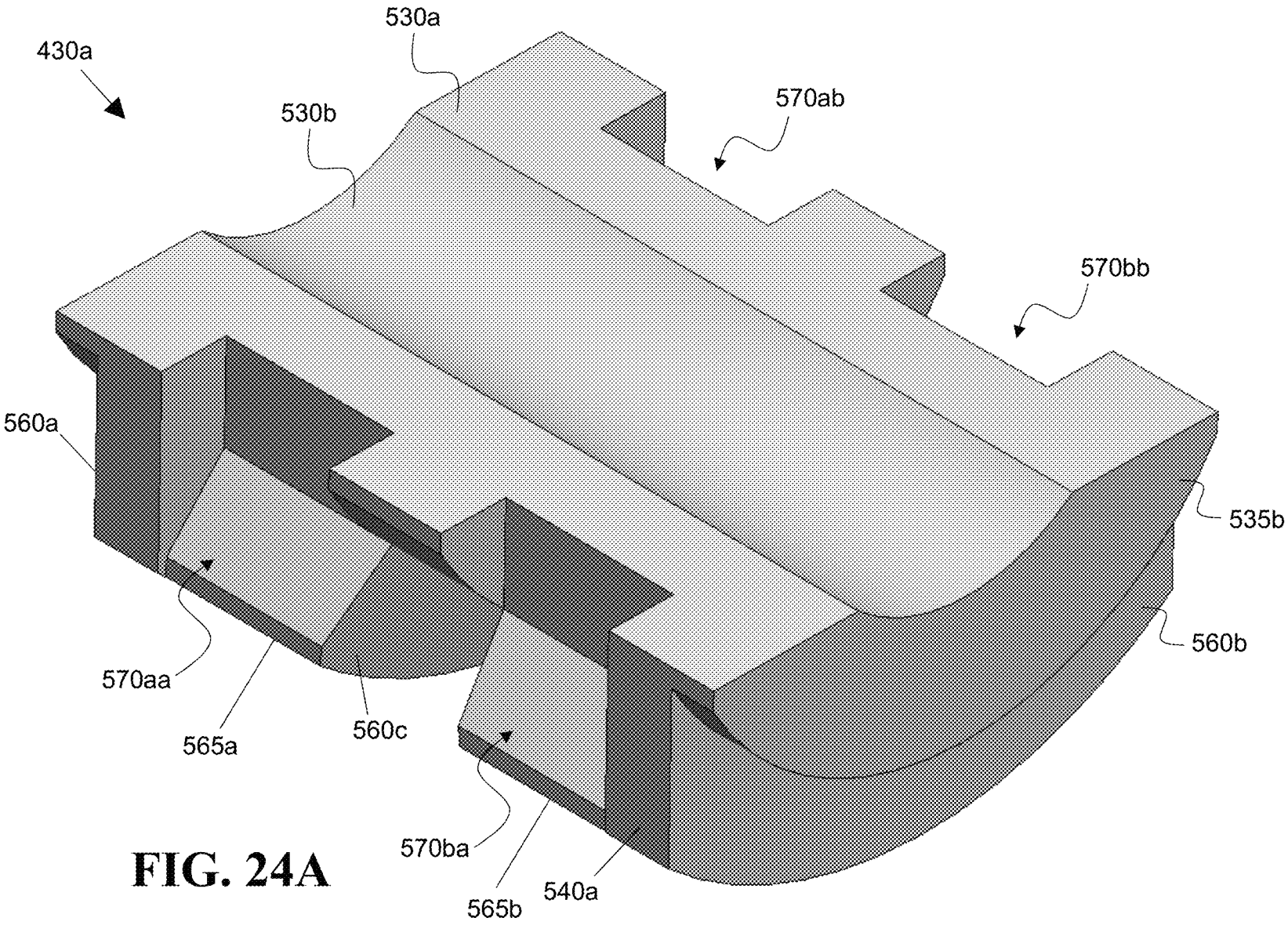
FIG. 24A is a perspective view of an orienting weight of the self-orienting charge cartridge of FIG. 18 according to one or more embodiments of the present disclosure.
Figure 24B:
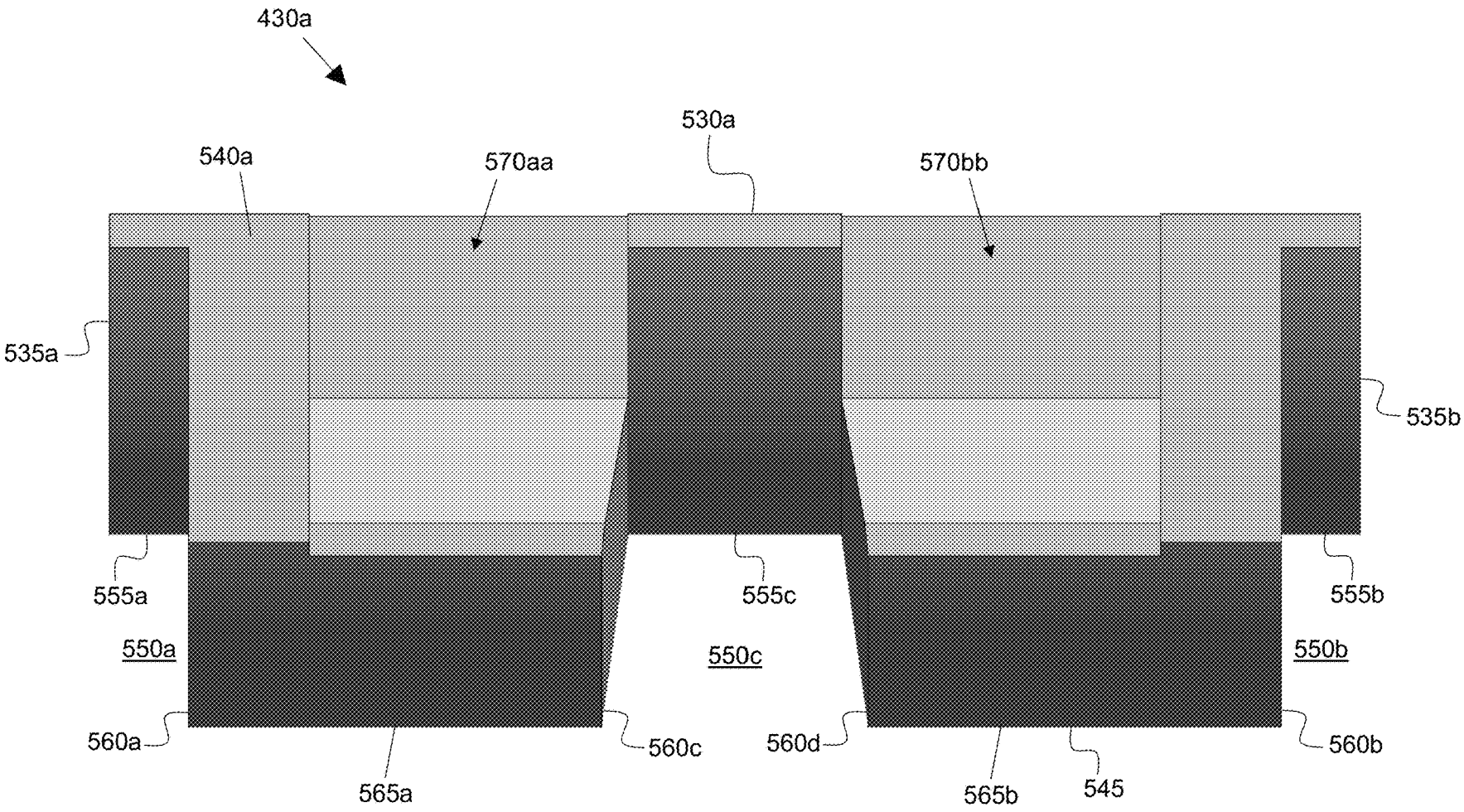
FIG. 24B is an elevational view of the orienting weight of FIG. 24A according to one or more embodiments of the present disclosure.
Figure 24C:
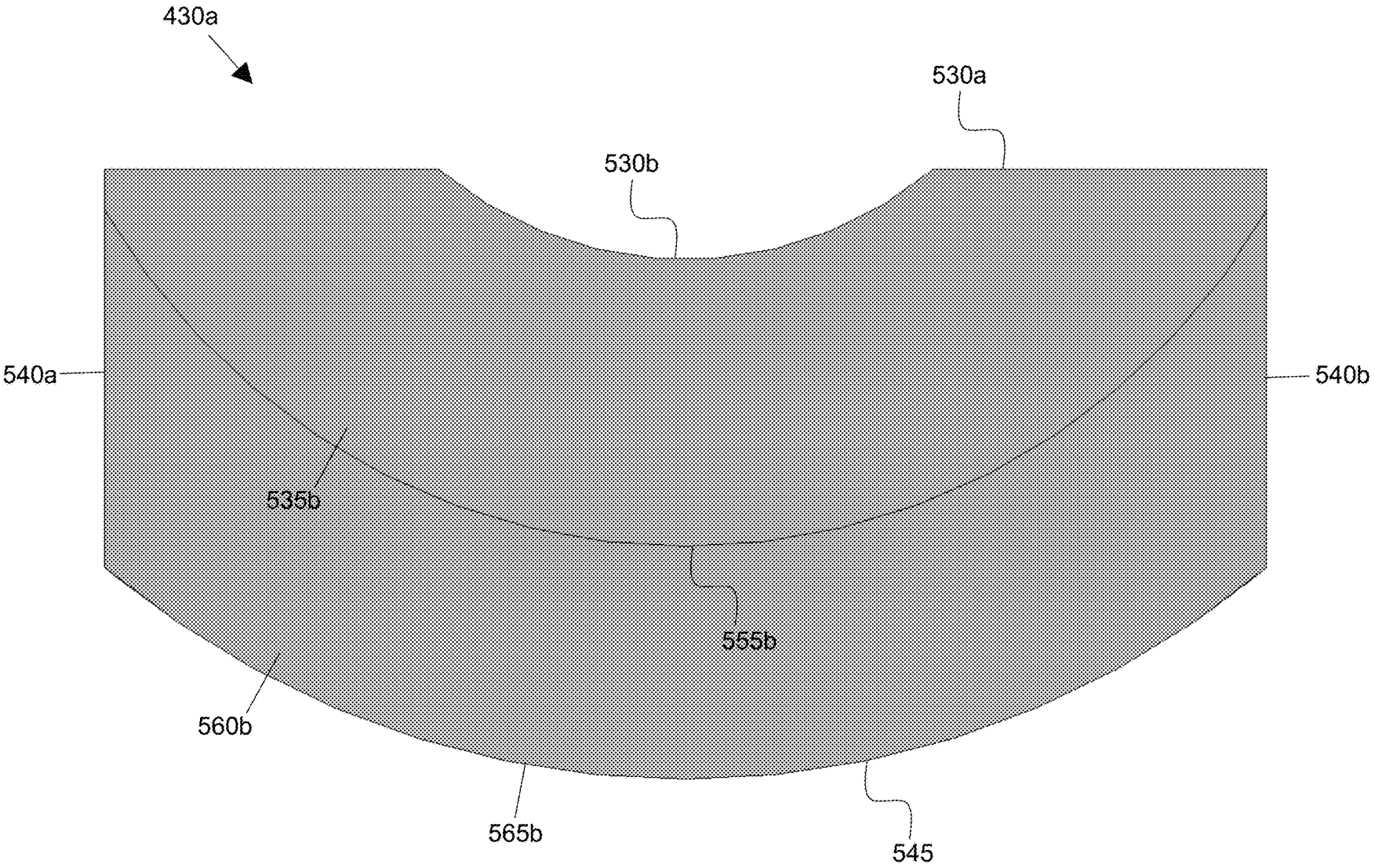
FIG. 24C is another elevation view of the orienting weight of FIG. 24A according to one or more embodiments of the present disclosure.

Referring to FIGS. 24A through 24C, in one or more embodiments, the orienting weight 430*a* includes inner surfaces 530*a-b*, opposing end surfaces 535*a-b*, opposing side surfaces 540*a-b*, and an outer surface 545. The inner surface 530*a* is planar. A recess is formed into the inner surface 530*a*, defining the inner surface 530*b* in the orienting weight 430*a*. The inner surface 530*b* is curved (e.g., semi-cylindrical), defining a first radius. The opposing end surfaces 535*a-b* are planar. The inner surfaces 530*a-b* extend from the end surface 535*a* to the end surface 535*b*. The end surfaces 535*a-b* are perpendicular to the inner surface 530*a*. The opposing side surfaces 540*a-b* are planar. The opposing side surfaces 540*a-b* extend between the end surfaces 535*a-b*. The opposing side surfaces 540*a-b* are perpendicular to the inner surface 530*a* and the opposing end surfaces 535*a-b*. The outer surface 545 is curved (e.g., semi-cylindrical), defining a second radius. The outer surface 545 is concentric to the inner surface 530*b*, so that the second radius of the outer surface 545 is greater than the first radius of the inner surface 530*b*.

A semi-annular outer recess 550*a* is formed into both the outer surface 545 and the end surface 535*a*, defining an outer surface 555*a* and an outer shoulder 560*a* in the orienting weight 430*a*. The outer surface 555*a* is curved (e.g., semi-cylindrical), defining a third radius. The outer shoulder 560*a* is offset from, and faces in the direction of, the end surface 535*a*. Likewise, a semi-annular outer recess 550*b* is formed into both the outer surface 545 and the end surface 535*b*, defining an outer surface 555*b* and an outer shoulder 560*b* in the orienting weight 430*a*. The outer surface 555*b* is curved (e.g., semi-cylindrical), defining the third radius. The outer shoulder 560*b* is offset from, and faces in the direction of, the end surface 535*b*. Finally, a semi-annular outer recess 550*c* is formed into the outer surface 545 between the semi-annular outer recesses 550*a-b*, defining an outer surface 555*c* and outer shoulders 560*c-d* in the orienting weight 430*a*. The outer surface 555*c* is curved (e.g., semi-cylindrical), defining the third radius. The outer shoulder 560*c* faces in the direction of the end surface 535*b*. The outer shoulder 560*d* faces in the direction of the end surface 535*a*. The outer surfaces 555*a-c* are concentric to the outer surface 545, so that the second radius of the outer surface 545 is greater than the third radius of the outer surfaces 555*a-c*.

Thus, the orienting weight 430*a* includes a semi-annular outer lobe 565*a* extending between the semi-annular outer recesses 550*a* and 550*c*. In particular, the semi-annular outer lobe 565*a* includes the outer shoulders 560*a* and 560*c*, a portion of the outer surface 545, and respective portions of the side surfaces 540*a* and 540*b*. Opposing side recesses 570*aa-ab* are formed through the respective side surface 540*a-b* and into the semi-annular outer lobe 565*a*. The opposing side recesses 570*aa-ab* are adapted to receive the retaining insert 432*a*, as will be described in further detail below. Likewise, the orienting weight 430*a* includes a semi-annular outer lobe 565*b* extending between the semi-annular outer recesses 550*b* and 550*c*. In particular, the semi-annular outer lobe 565*b* includes the outer shoulders 560*b* and 560*d*, another portion of the outer surface 545, and respective other portions of the side surfaces 540*a* and 540*b*. Opposing side recesses 570*ba-bb* are formed through the respective side surface 540*a-b* and into the semi-annular outer lobe 565*b*. The opposing side recesses 570*ba-bb* are adapted to receive the retaining insert 432*b*, as will be described in further detail below. The orienting weight 430*b* is substantially identical (or at least similar) to the orienting weight 430*a*, and therefore will not be described in further detail.

Figure 25:
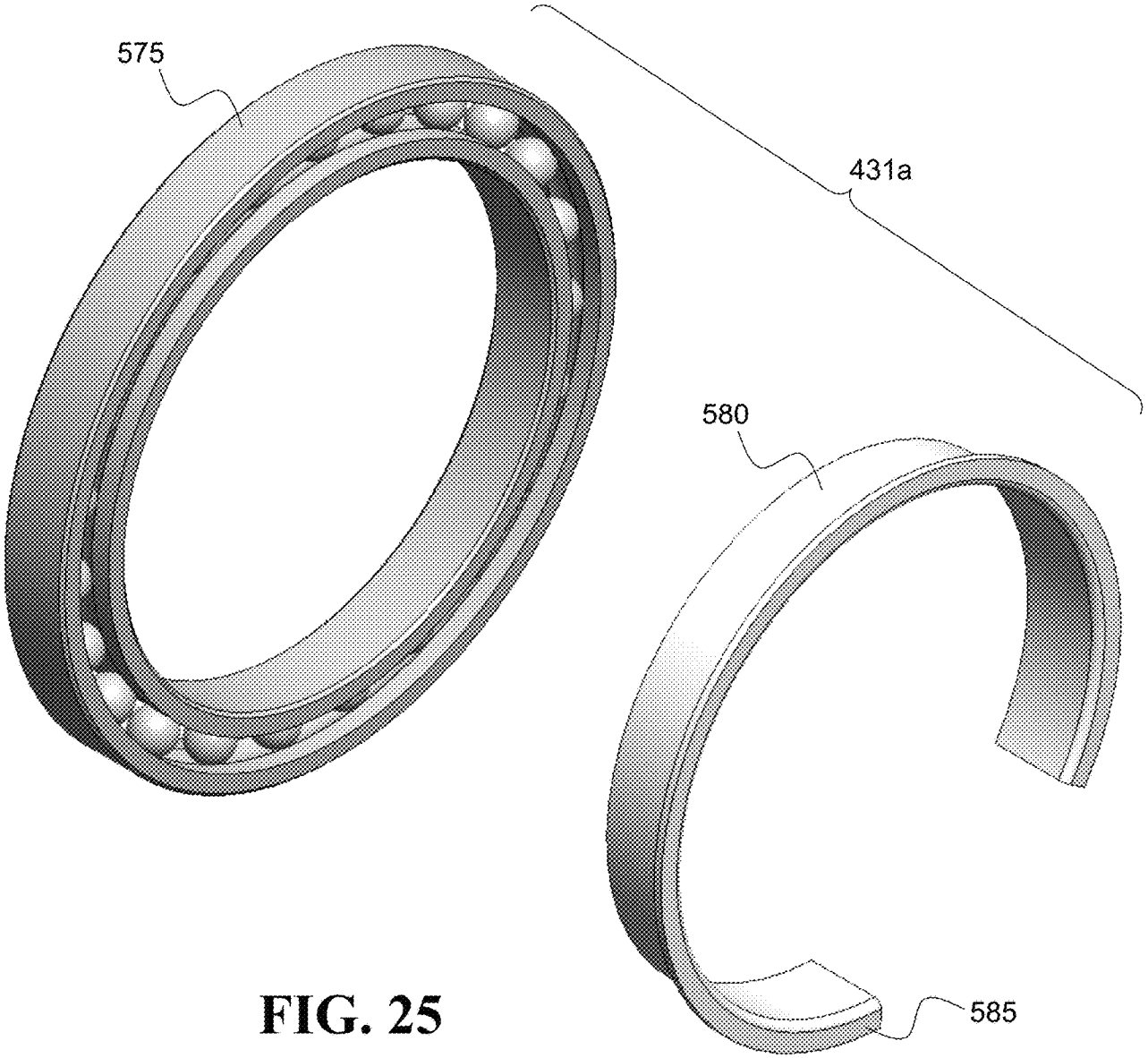
FIG. 25 is an exploded perspective view of a self-orienting bearing of the charge cartridge of FIG. 18 according to one or more embodiments of the present disclosure.

Referring to FIG. 25, in one or more embodiments, the self-orienting bearing 431*a* includes a bearing 575 and a bushing 580. In one or more embodiments, the bearing 575 is, includes, or is part of a roller bearing, a sleeve bearing, another type of bearing, the like, or any combination thereof. The bushing 580 is generally C-shaped, and includes a flange 585. In one or more embodiments, the orienting weight 430*a*, the retaining insert 432*a*, and the bushing 580 of the self-orienting bearing 431*a*, in combination, are referred to as a "bearing retention assembly" for retaining the bearing 575 of the self-orienting bearing 431*a* on the charge tube 420. The self-orienting bearing 431*b* is substantially identical (or at least similar) to the self-orienting bearing 431*a*, and therefore will not be described in further detail. In one or more embodiments, the orienting weight 430*b*, the retaining insert 432*b*, and the bushing 580 of the self-orienting bearing 431*b*, in combination, are referred to as a "bearing retention assembly" for retaining the bearing 575 of the self-orienting bearing 431*b* on the charge tube 420.

Figure 26A:
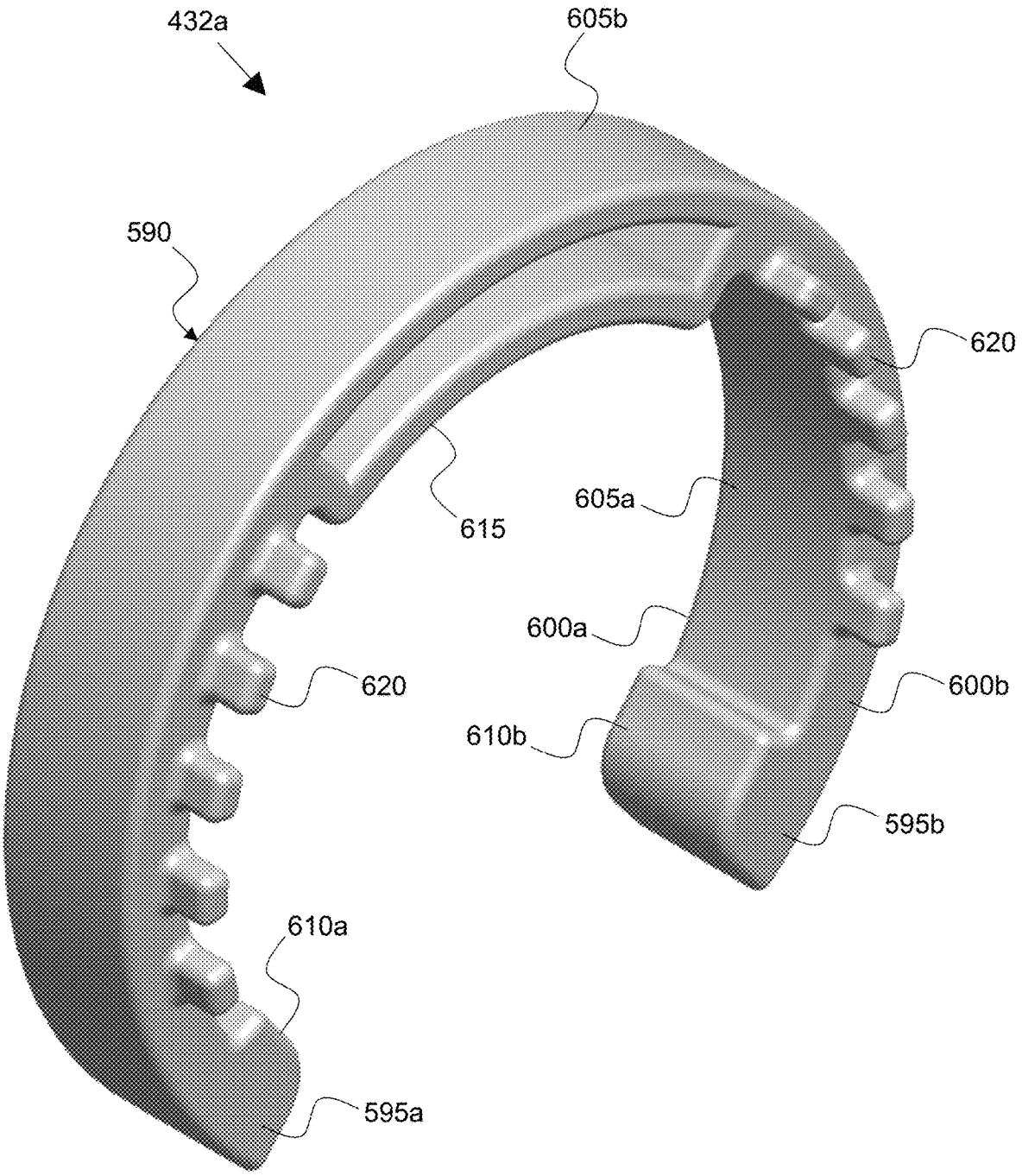
FIG. 26A is a perspective view of a retaining insert of the charge cartridge of FIG. 18 according to one or more embodiments of the present disclosure.
Figure 26B:
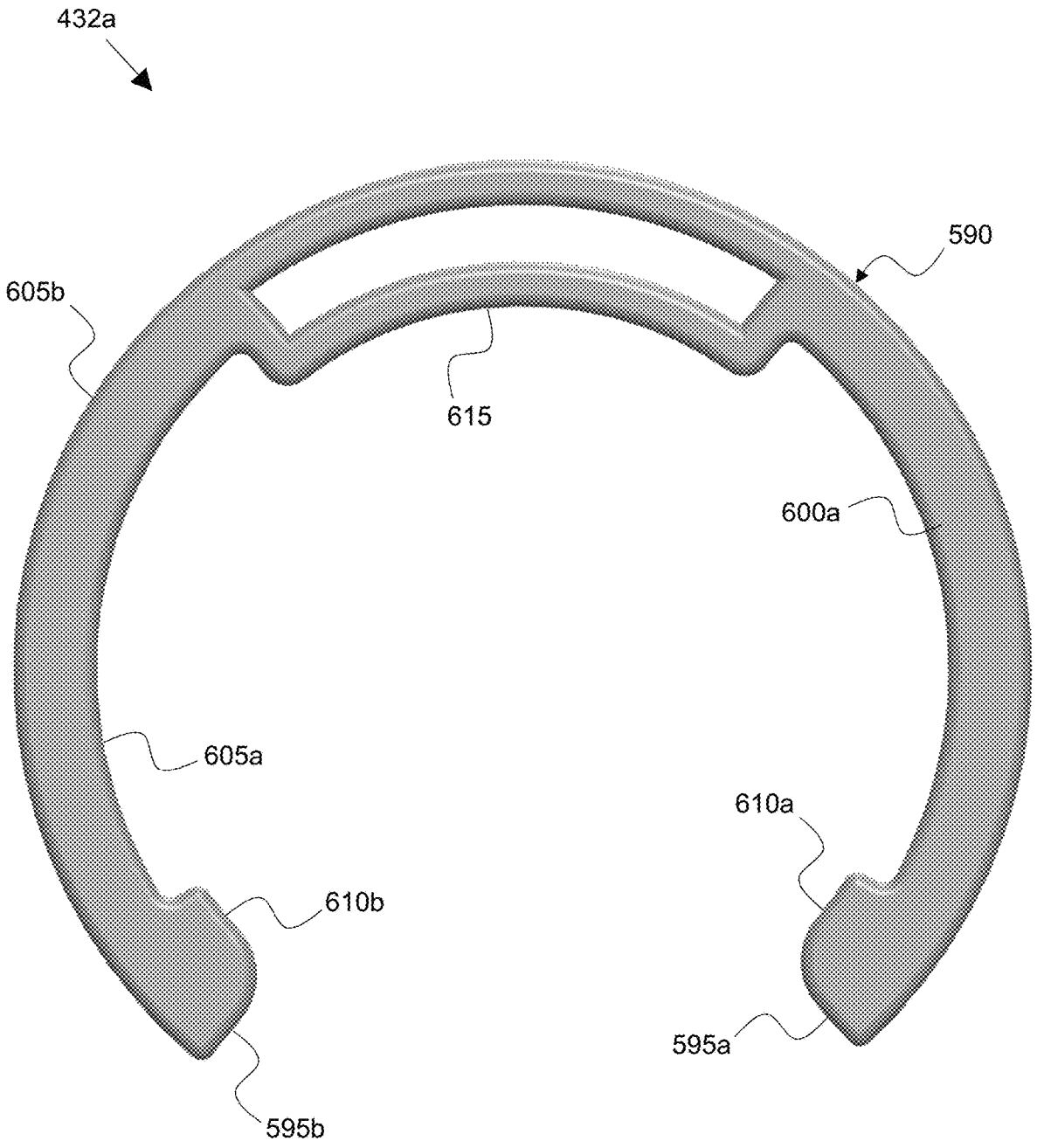
FIG. 26B is an elevational view of the orienting weight of FIG. 26A according to one or more embodiments of the present disclosure.
Figure 26C:
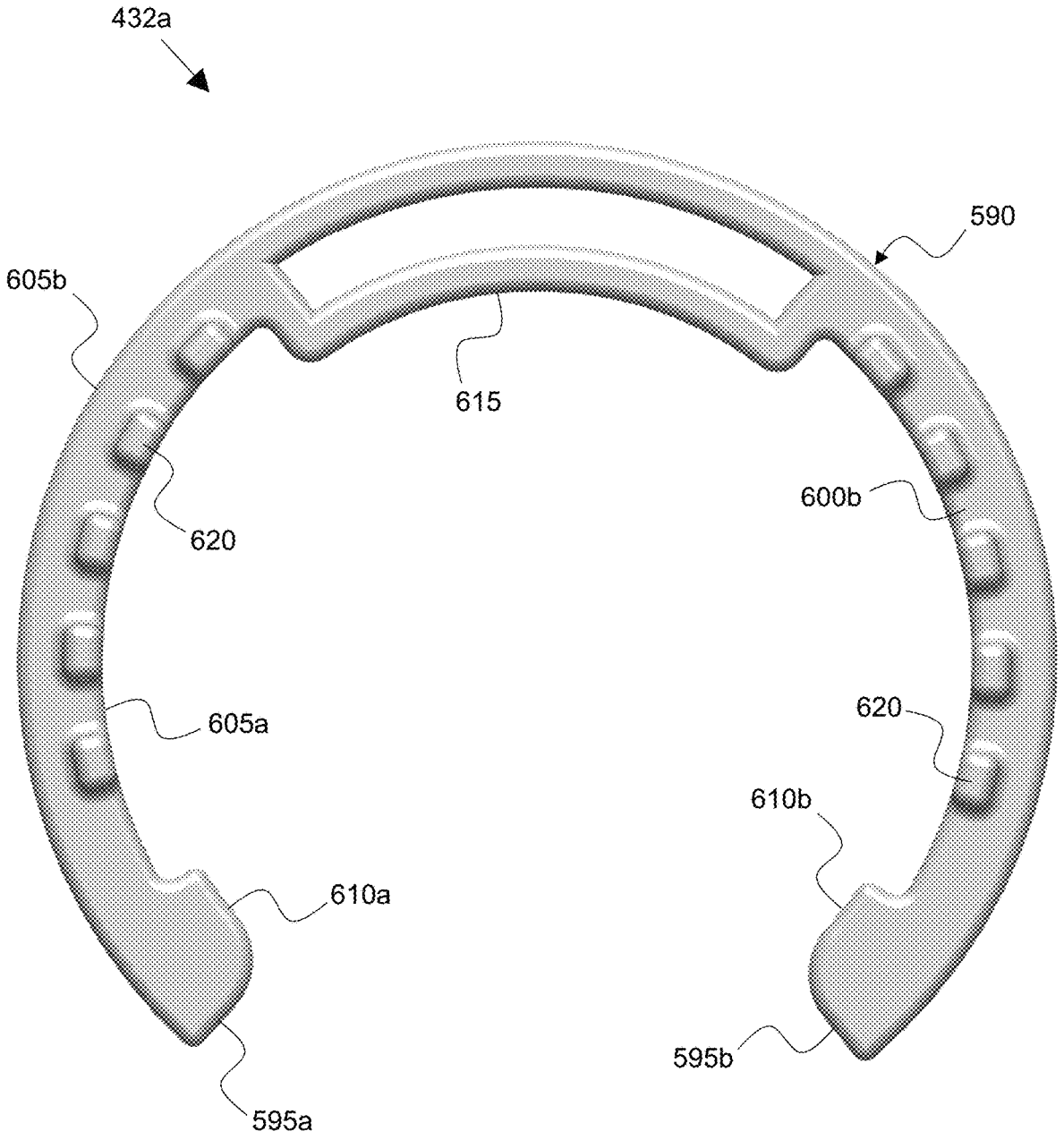
FIG. 26C is another elevational view of the orienting weight of FIG. 26A according to one or more embodiments of the present disclosure.

Referring to FIGS. 26A through 26C, the retaining insert 432*a* includes a retainer body 590 that is generally E-shaped, defining opposing end portions 595*a-b*, and including opposing side surfaces 600*a-b*, an inner surface 605*a*, and an outer surface 605*b*. The retaining insert 432*a* also includes opposing latching features 610*a-b* at the respective end portions 595*a-b* of the retainer body 590, and an alignment feature 615 extending inwardly from the inner surface 605*a* of the retainer body 590, between the opposing end portions 595*a-b*. The latching features 610*a-b* of the retaining insert 432*a* are adapted to be received through the slot 520*ab* of the charge tube 420 and into the respective opposing side recesses 570*aa-ab* of the orienting weight 430*a*, while, at the same time, the alignment feature 615 of the retaining insert 432*a* is received into the slot 520*aa* of the charge tube 420, as will be described in further detail below. In one or more embodiments, the retaining insert 432*a* includes a plurality of bearing alignment fingers 620 extending from the side surface 600*b* of the retainer body 590, and which, in combination with a corresponding plurality of bearing alignment fingers of the retaining insert 432*b*, are adapted to align the self-orienting bearing 431*a* on the charge tube 420. The retaining inserts 432*b-d* are substantially identical (or at least similar) to the retaining insert 432*a*, and therefore will not be described in further detail.

Figure 27:
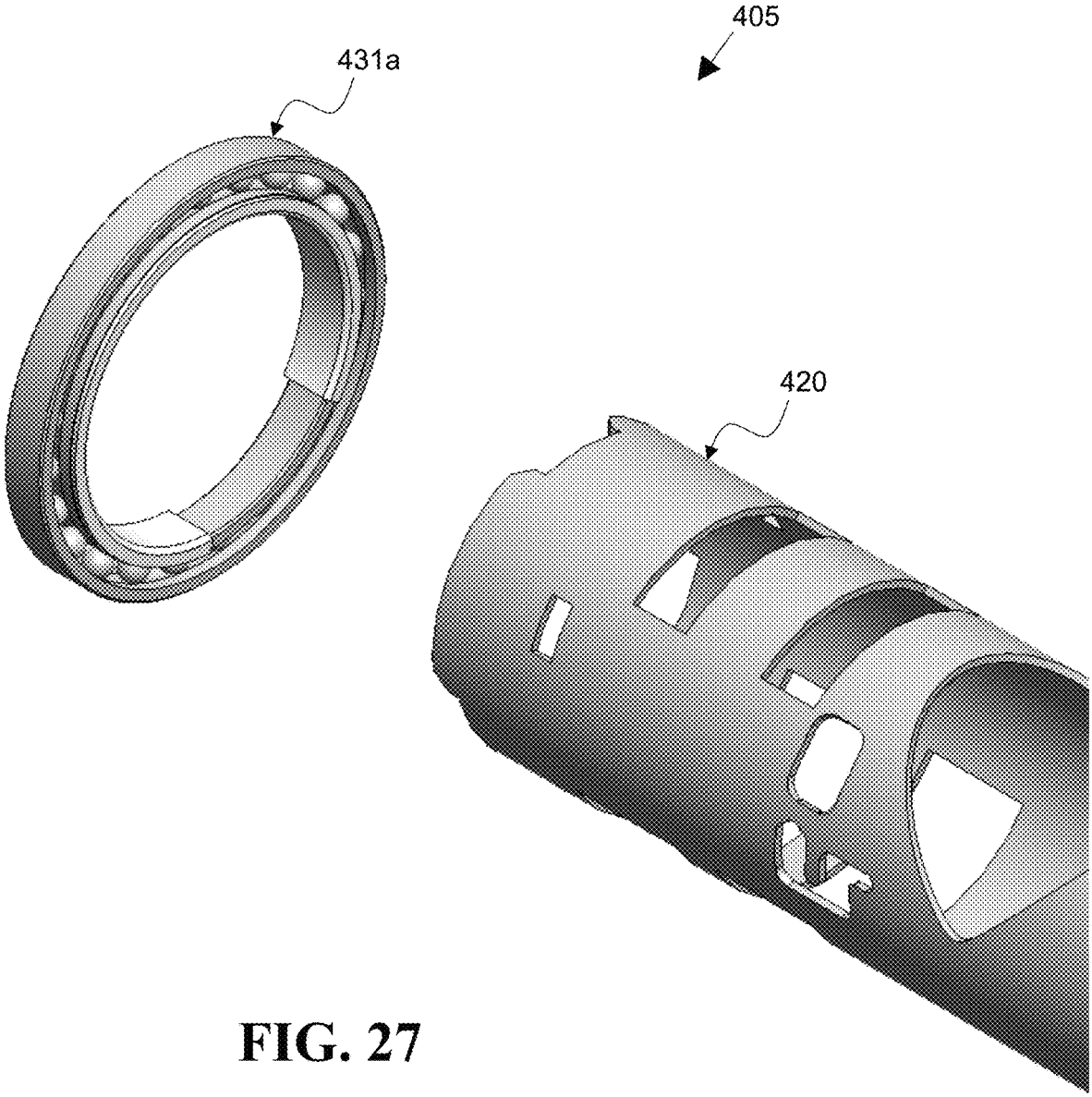
FIG. 27 is an exploded perspective view of the charge tube of FIGS. 23A through 23E and the self-orienting bearing of FIG. 25 according to one or more embodiments of the present disclosure.
Figure 28A:
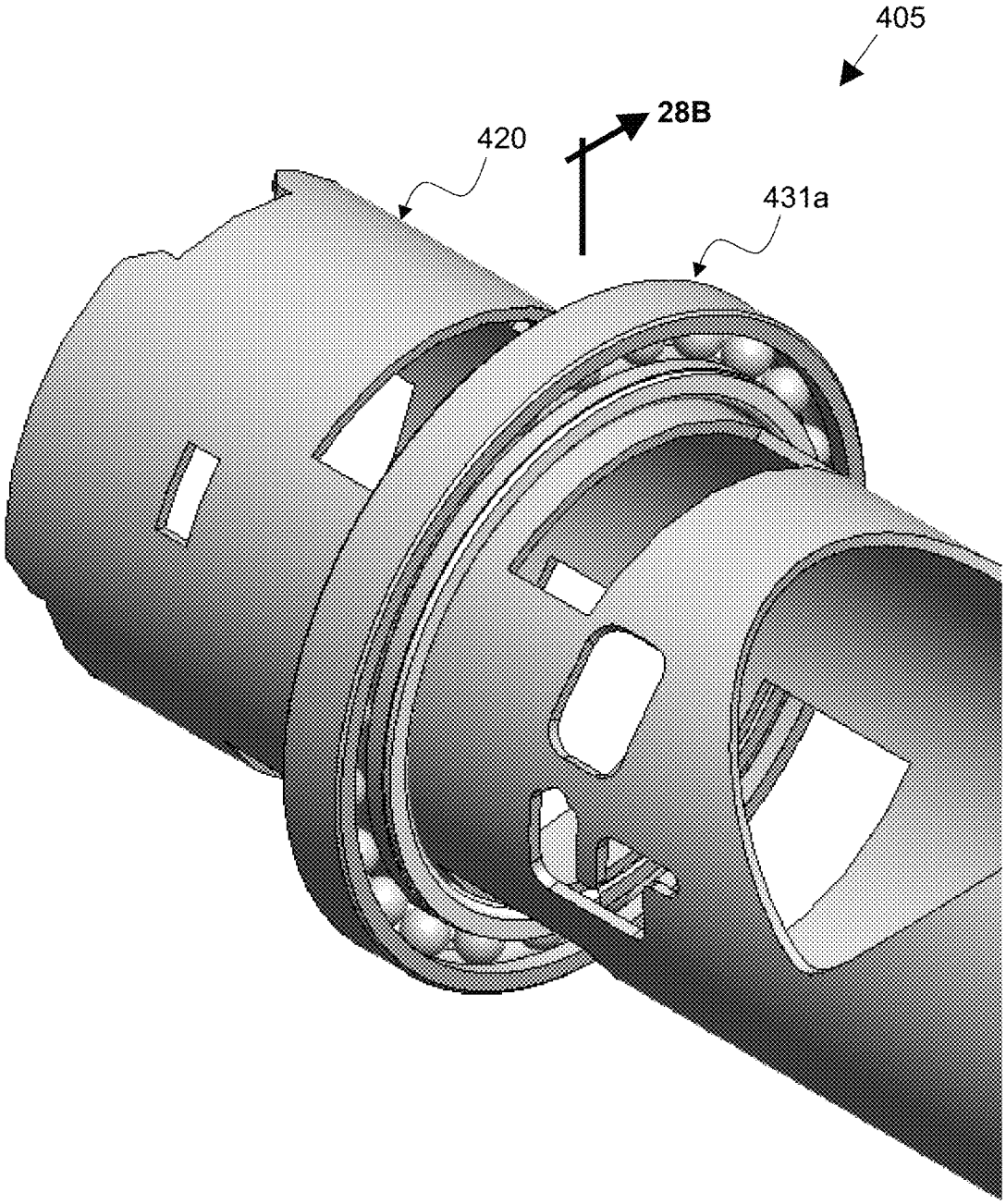
FIG. 28A is a perspective view of the charge tube and the self-orienting bearing of FIG. 27 in a first assembled state or configuration according to one or more embodiments of the present disclosure.
Figure 28B:
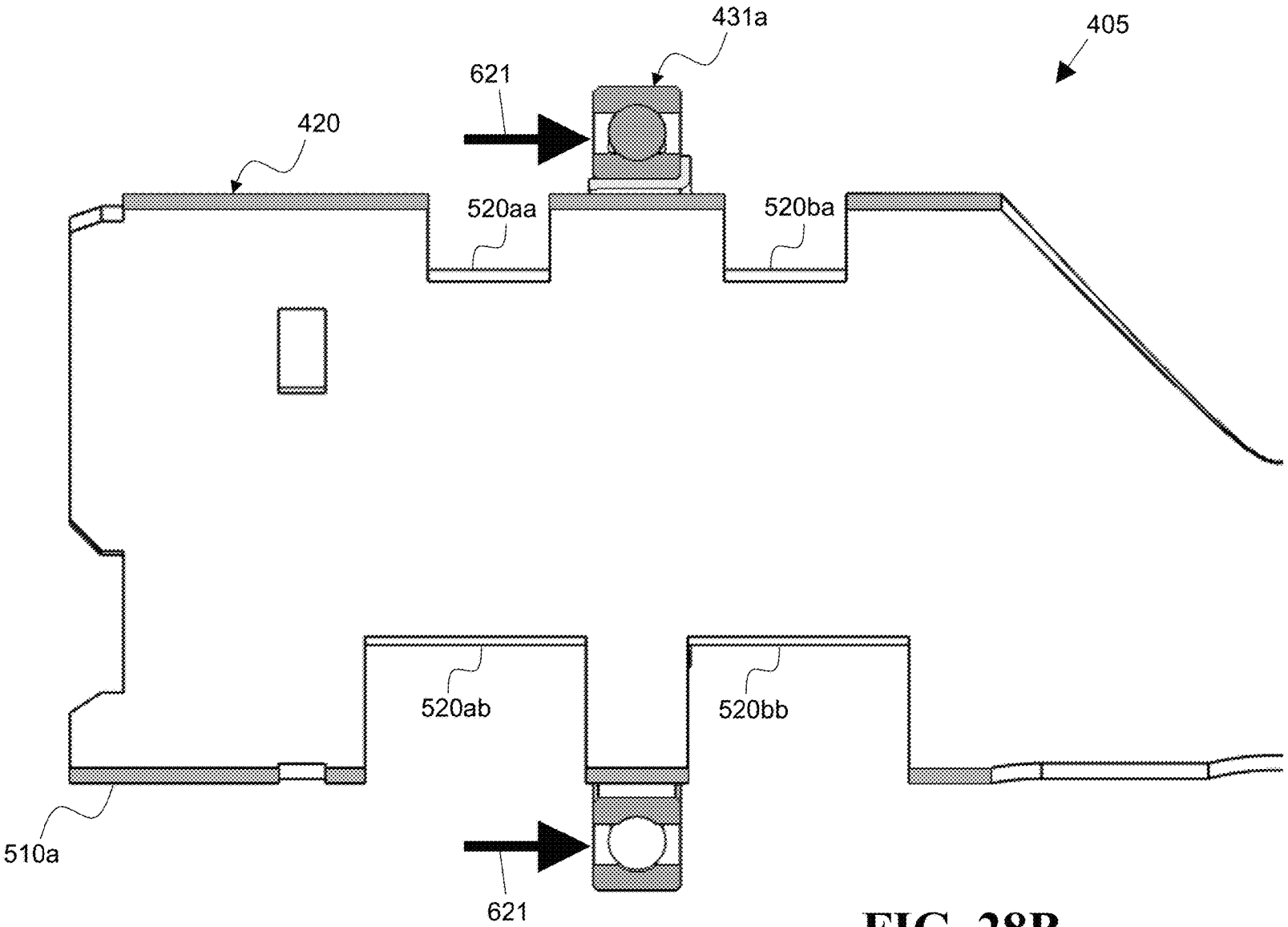
FIG. 28B is a cross-sectional view of the first assembled state or configuration taken along the line 28B-28B of FIG. 28A according to one or more embodiments of the present disclosure.
Figure 28C:
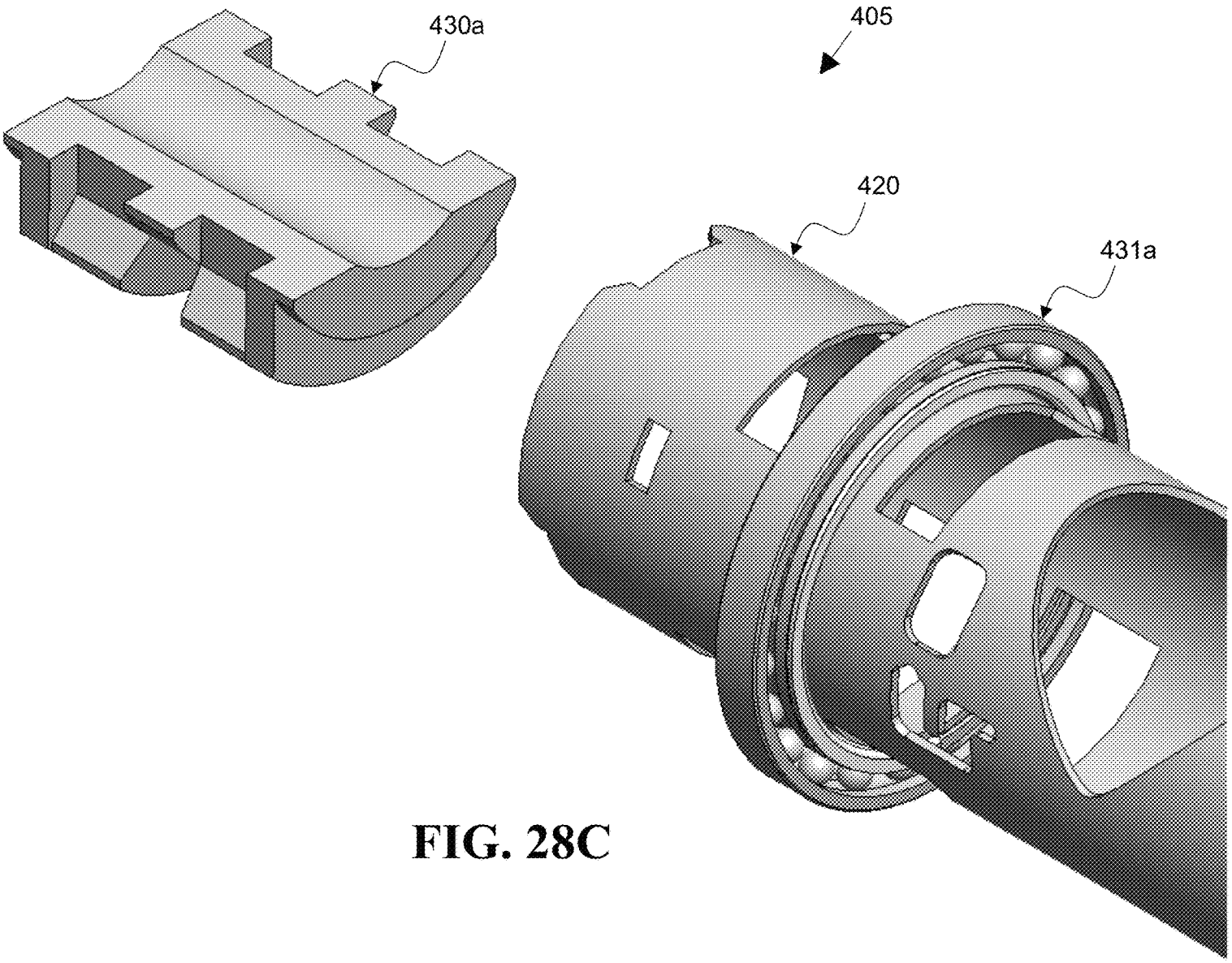
FIG. 28C is an exploded perspective view of the orienting weight of FIGS. 24A through 24C together with the charge tube and the self-orienting bearing in the first assembled state or configuration of FIG. 28A according to one or more embodiments of the present disclosure.

Referring to FIGS. 27 through 31B, various steps for assembling the charge cartridge 405 are illustrated in according to one or more embodiments of the present disclosure. Turning initially to FIG. 27, an exploded perspective view of the charge tube 420 and the self-orienting bearing 431*a* is illustrated according to one or more embodiments of the present disclosure. Turning next to FIGS. 28A through 28C, the charge tube 420 and the self-orienting bearing 431*a* are illustrated in a first assembled state or configuration according to one or more embodiments of the present disclosure. In particular, as shown in FIG. 28B, to place the charge tube 420 and the self-orienting bearing 431*a* in the first assembled state or configuration, the self-orienting bearing 431*a* is installed over the charge tube 420 at the end portion 510*a*, as indicated by arrows 621, so that: the self-orienting bearing 431*a* extends between the slots 520*aa* and 520*ba* of the charge tube 420; and the self-orienting bearing 431*a* extends between the slots 520*ab* and 520*bb* of the charge tube 420. FIG. 28C illustrates an exploded perspective view of the orienting weight 430*a* together with the charge tube 420 and the self-orienting bearing 431*a* (in the first assembled state or configuration) according to one or more embodiments of the present disclosure.

Figure 29A:
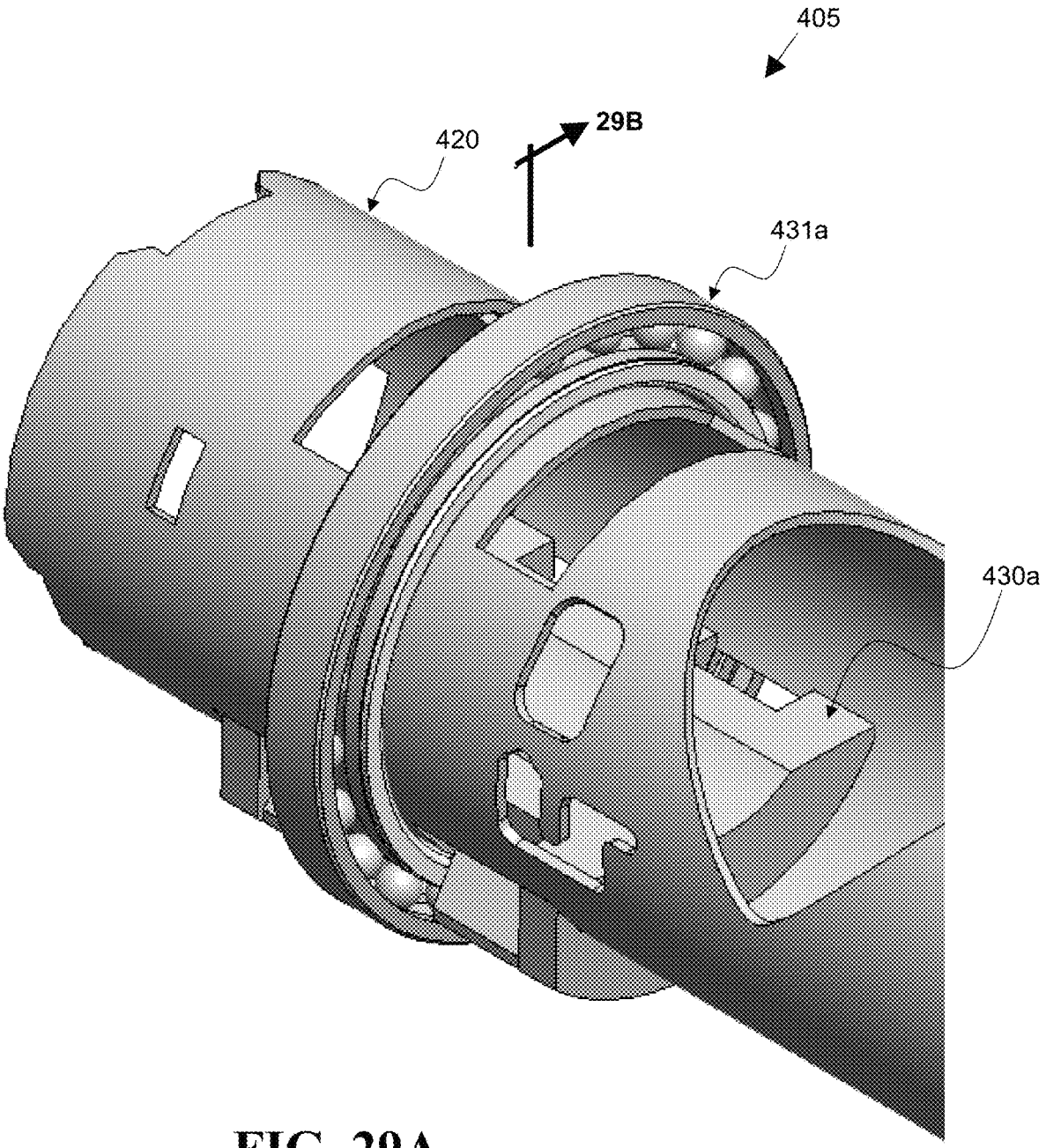
FIG. 29A is a perspective view of the orienting weight, the charge tube, and the self-orienting bearing of FIG. 28C in a second assembled state or configuration according to one or more embodiments of the present disclosure.
Figure 29B:
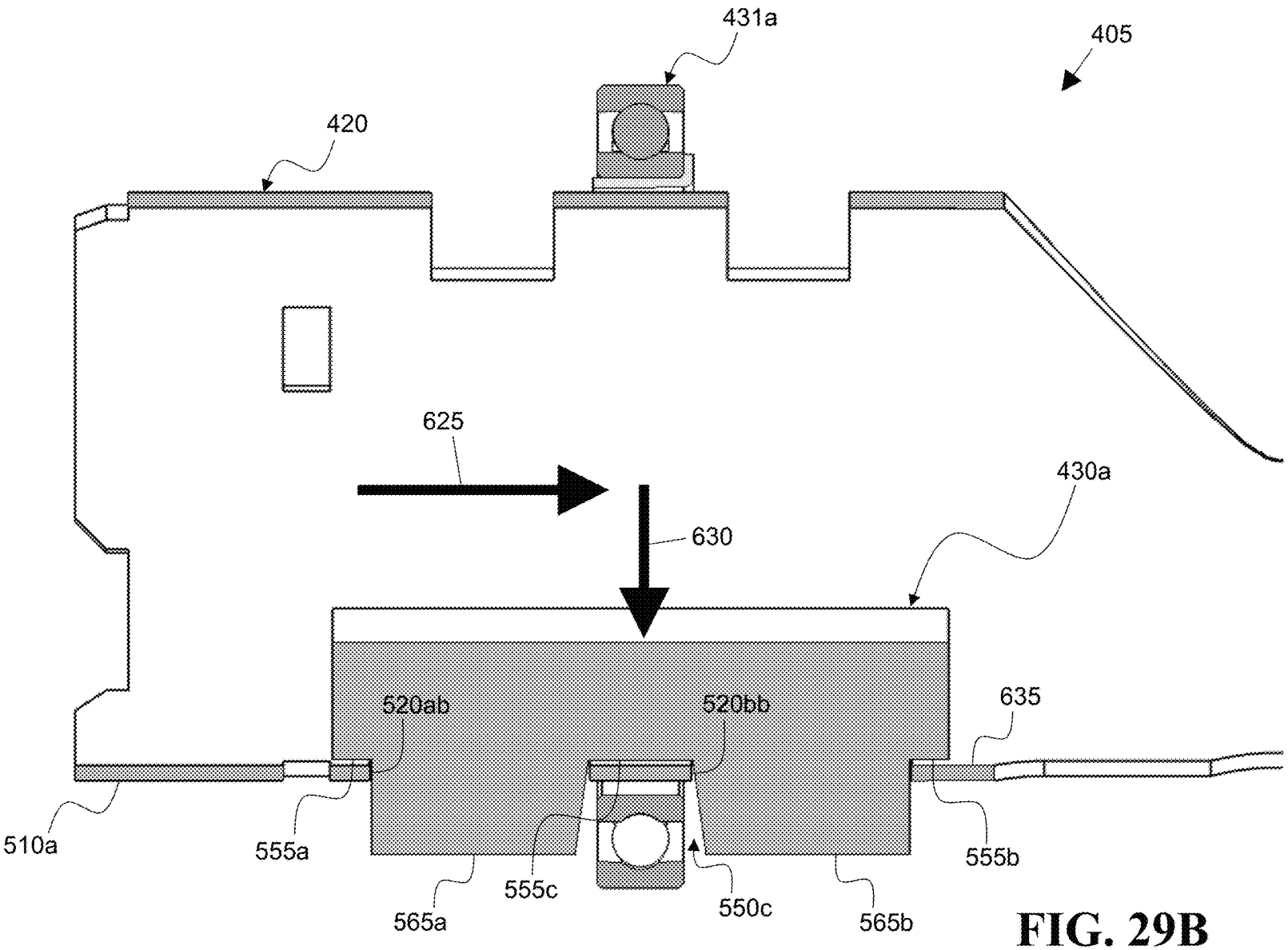
FIG. 29B is a cross-sectional view of the second assembled state or configuration taken along the line 29B-29B of FIG. 28A according to one or more embodiments of the present disclosure.
Figure 29C:
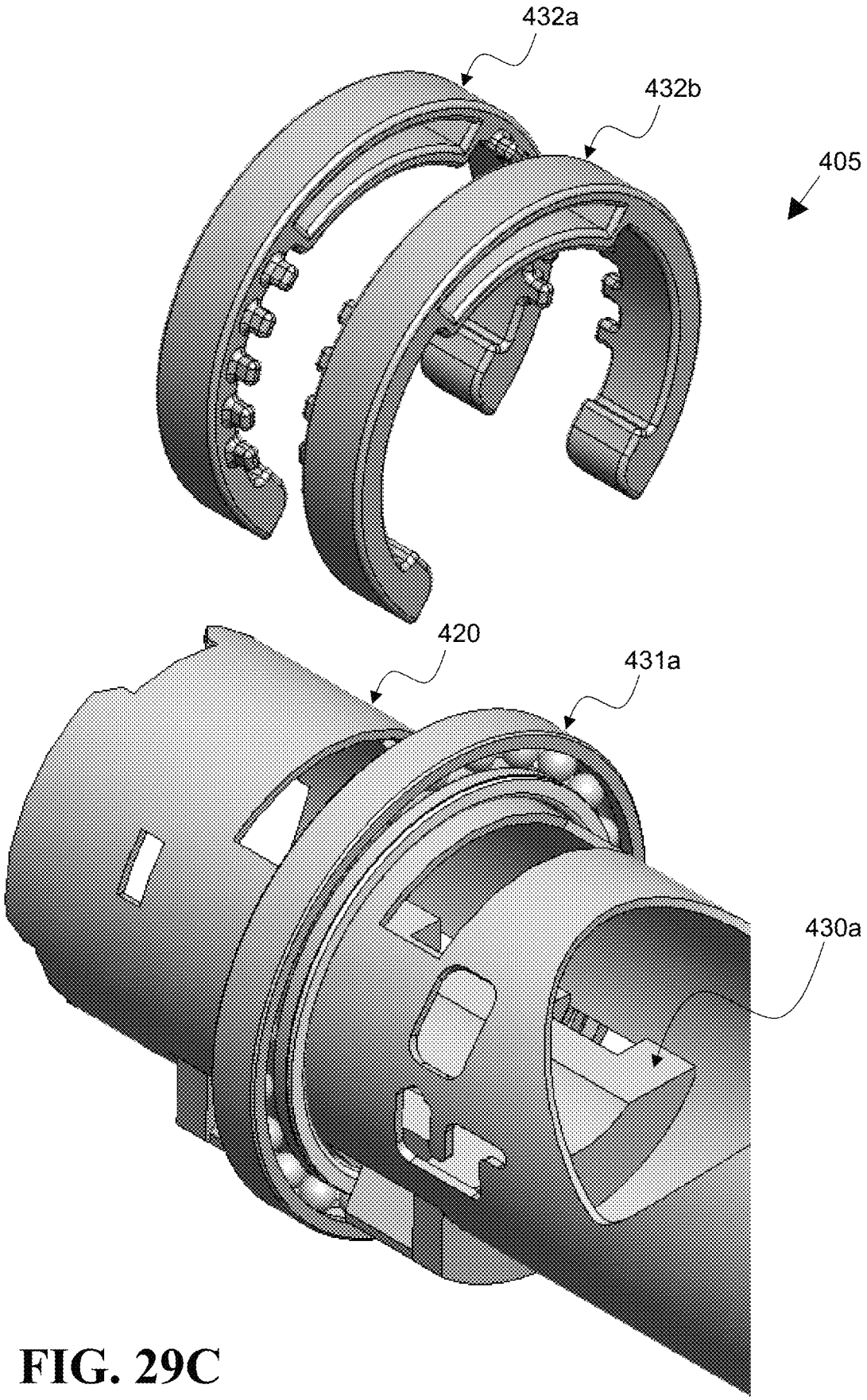
FIG. 29C is an exploded perspective view of the retaining insert of FIGS. 26A through 26C, and another substantially identical (or at least similar) retaining insert, together with the orienting weight, the charge tube, and the self-orienting bearing in the second assembled state or configuration of FIG. 29A according to one or more embodiments of the present disclosure.

Turning next to FIGS. 29A through 29C, the orienting weight 430*a*, the charge tube 420, and the self-orienting bearing 431*a* are illustrated in a second assembled state or configuration according to one or more embodiments of the present disclosure. In particular, as shown in FIG. 29B, to place the orienting weight 430*a*, the charge tube 420, and the self-orienting bearing 431*a* in the second assembled state or configuration, the orienting weight 430*a* is inserted into the charge tube 420 at the end portion 510*a*, as indicated by arrow 625, and dropped into the slots 520*ab* and 520*bb*, as indicated by arrow 630, so that: the semi-annular outer lobes 565*a-b* of the orienting weight 430*a* extend through the slots 520*ab* and 520*bb*, respectively, of the charge tube 420; the outer surfaces 555*a-c* of the orienting weight 430*a* are positioned along an interior surface 635 of the charge tube 420; and the self-orienting bearing 431*a* extends within the semi-annular outer recess 550*c* of the orienting weight 430*a*. FIG. 29C illustrates an exploded perspective view of the retaining inserts 432*a-b* together with the orienting weight 430*a*, the charge tube 420, and the self-orienting bearing 431*a* (in the second assembled state or configuration) according to one or more embodiments of the present disclosure.

Figure 30A:
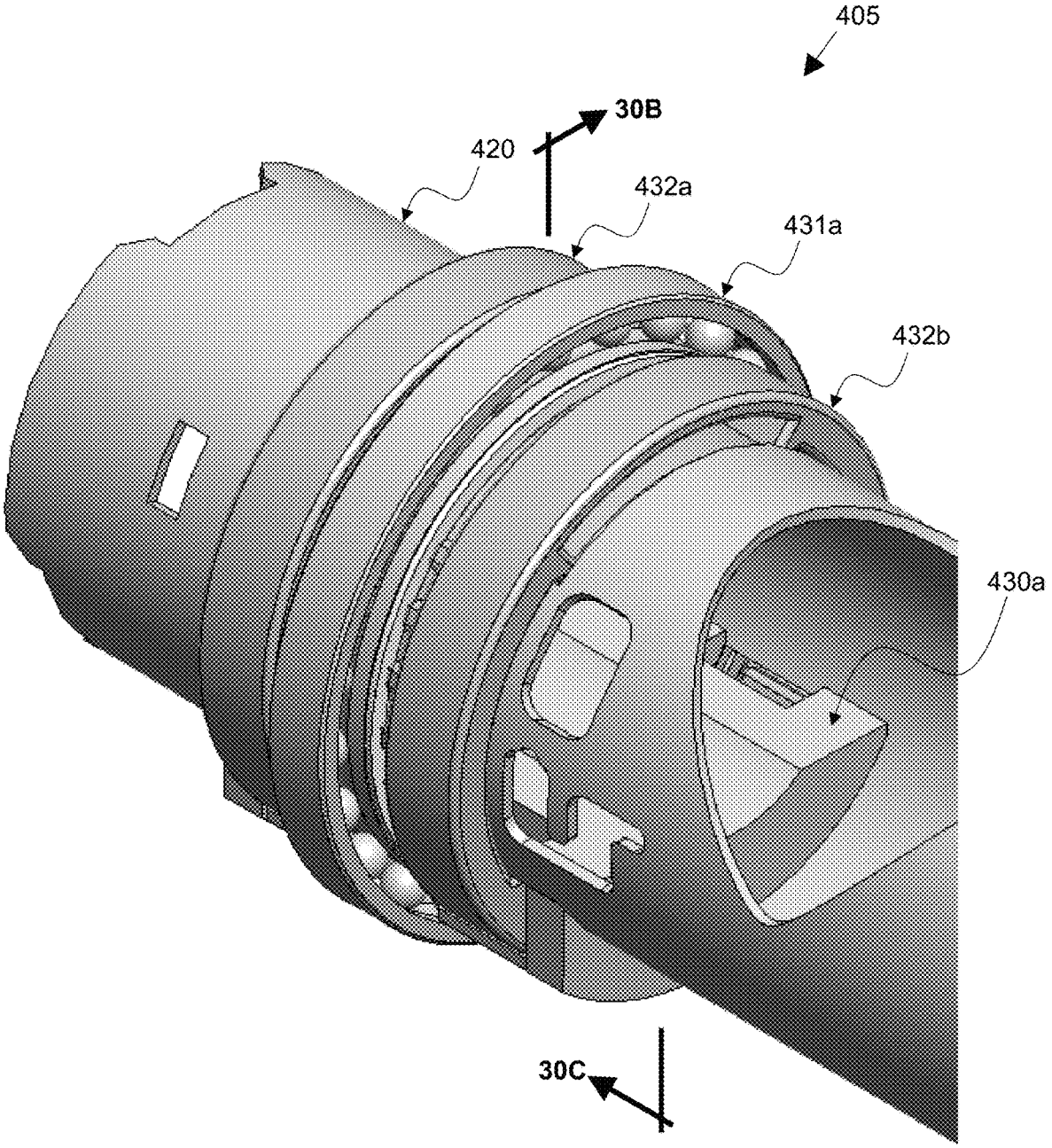
FIG. 30A is a perspective view of the retaining insert, the another substantially identical (or at least similar) retaining insert, the orienting weight, the charge tube, and the self-orienting bearing of FIG. 29C in a third assembled state or configuration according to one or more embodiments of the present disclosure.
Figure 30B:
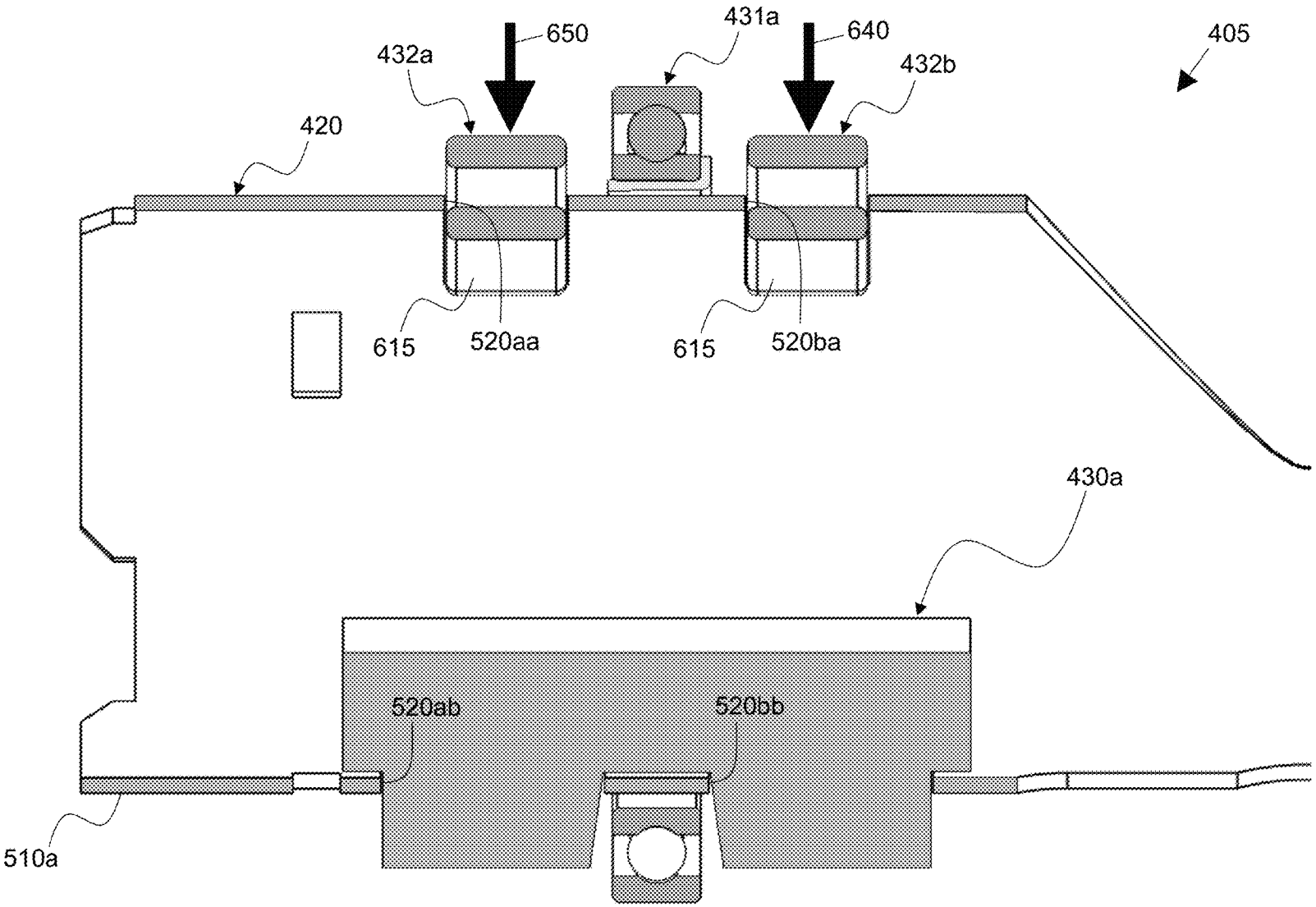
FIG. 30B is a cross-sectional view of the third assembled state or configuration taken along the line 30B-30B of FIG. 30A according to one or more embodiments of the present disclosure.
Figure 30C:
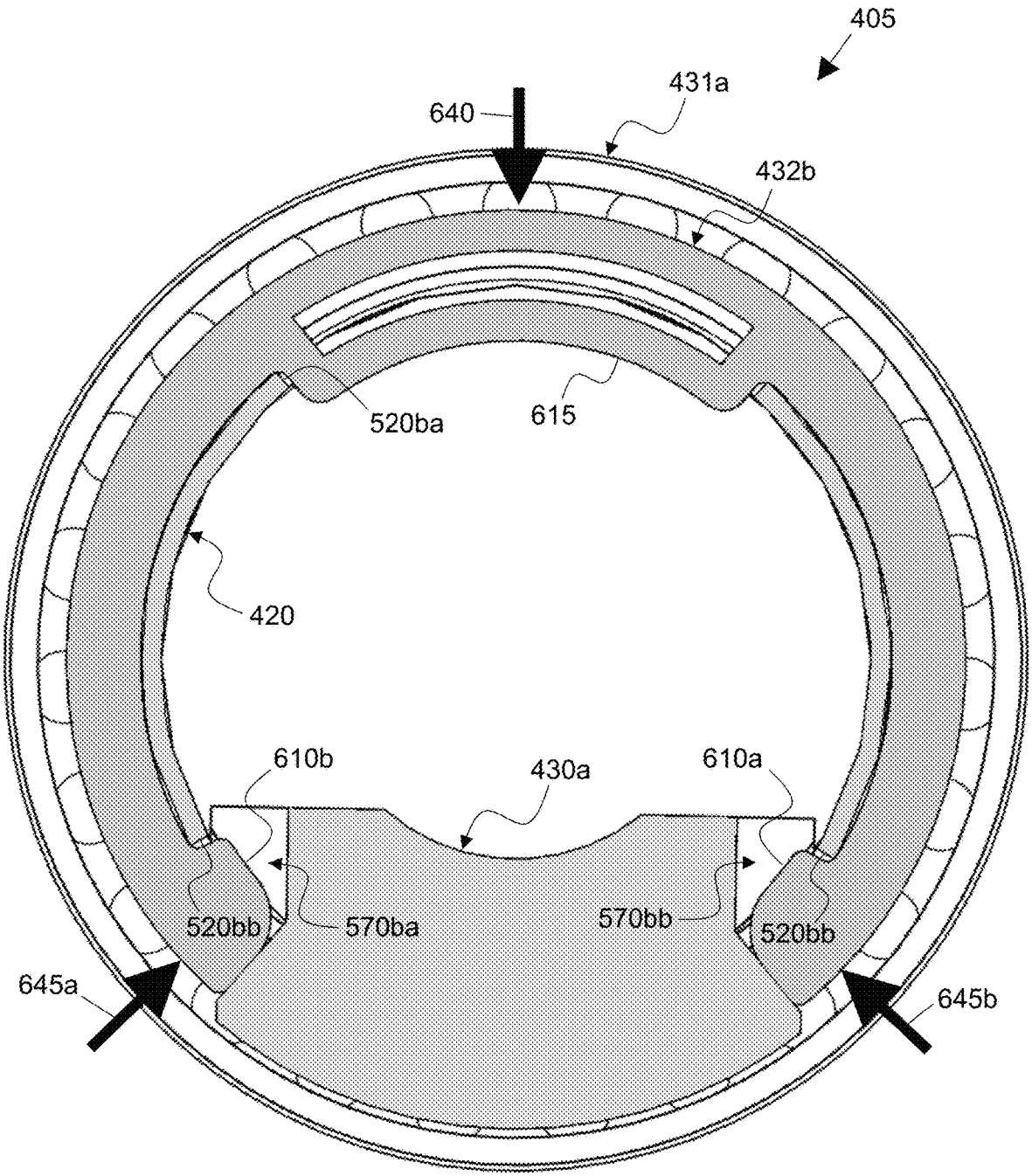
FIG. 30C is another cross-sectional view of the third assembled state or configuration taken along the line 30C-30C of FIG. 30A according to one or more embodiments of the present disclosure.
Figure 30D:
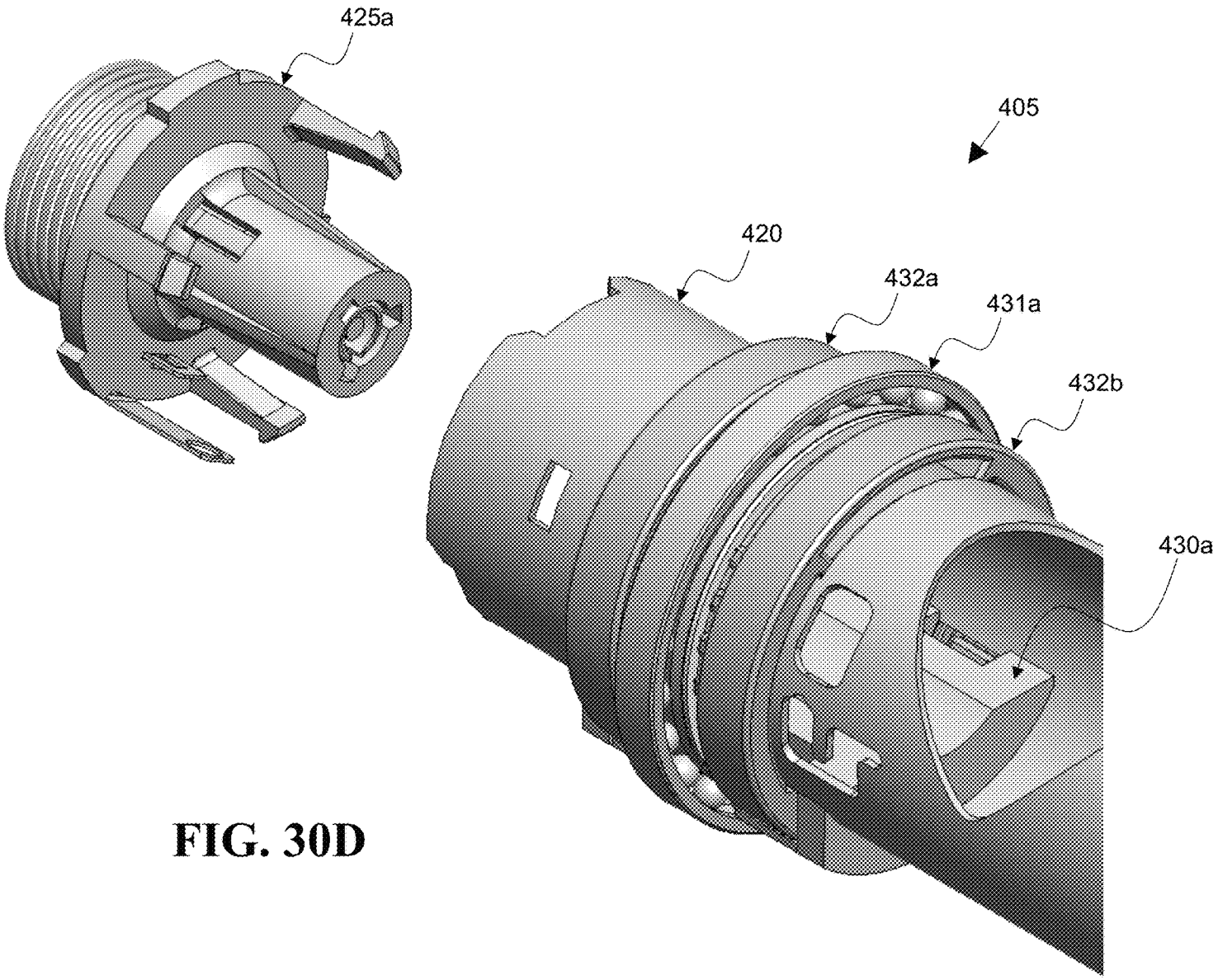
FIG. 30D is an exploded perspective view of the cap assembly of FIGS. 22A through 22D together with the retaining insert, the another substantially identical (or at least similar) retaining insert, the orienting weight, the charge tube, and the self-orienting bearing in the third assembled state or configuration of FIG. 30A according to one or more embodiments of the present disclosure.

Turning next to FIGS. 30A through 30D, the retaining inserts 432*a-b*, the orienting weight 430*a*, the charge tube 420, and the self-orienting bearing 431*a* are illustrated in a third assembled state or configuration according to one or more embodiments of the present disclosure. In particular, as shown in FIGS. 30B and 30C, to place the retaining inserts 432*a-b*, the orienting weight 430*a*, the charge tube 420, and the self-orienting bearing 431*a* in the third assembled state or configuration, the retaining insert 432*b* is inserted over the charge tube 420 at the end portion 510*a*, so that: the alignment feature 615 of the retaining insert 432*b* extends within the slot 520*ba* of the charge tube 420, as indicated by arrow 640 in FIGS. 30C and 30C; the latching feature 610*b* of the retaining insert 432*b* extends within both the slot 520*bb* of the charge tube 420 and the side recess 570*ba* of the orienting weight 430*a*, as indicated by arrow 645*a* in FIG. 30C; and the latching feature 610*a* of the retaining insert 432*b* extends within both the slot 520*bb* of the charge tube 420 and the side recess 570*bb* of the orienting weight 430*a*, as indicated by arrow 645*b* in FIG. 30C. Although not visible in FIG. 30C, the retaining insert 432*a* is inserted in a similar manner over the charge tube 420 at the end portion 510*a* so that: the alignment feature 615 of the retaining insert 432*a* extends within the slot 520*aa* of the charge tube 420, as indicated by arrow 650 in FIG. 30B; the latching feature 610*a* of the retaining insert 432*a* extends within both the slot 520*ab* of the charge tube 420 and the side recess 570*aa* of the orienting weight 430*a*; and the latching feature 610*b* of the retaining insert 432*a* extends within both the slot 520*ab* of the charge tube 420 and the side recess 570*ab* of the orienting weight 430*a*. FIG. 30D illustrates an exploded perspective view of the cap assembly 425*a* together with the retaining inserts 432*a-b*, the orienting weight 430*a*, the charge tube 420, and the self-orienting bearing 431*a* (in the third assembled state or configuration) according to one or more embodiments of the present disclosure.

Figure 31A:
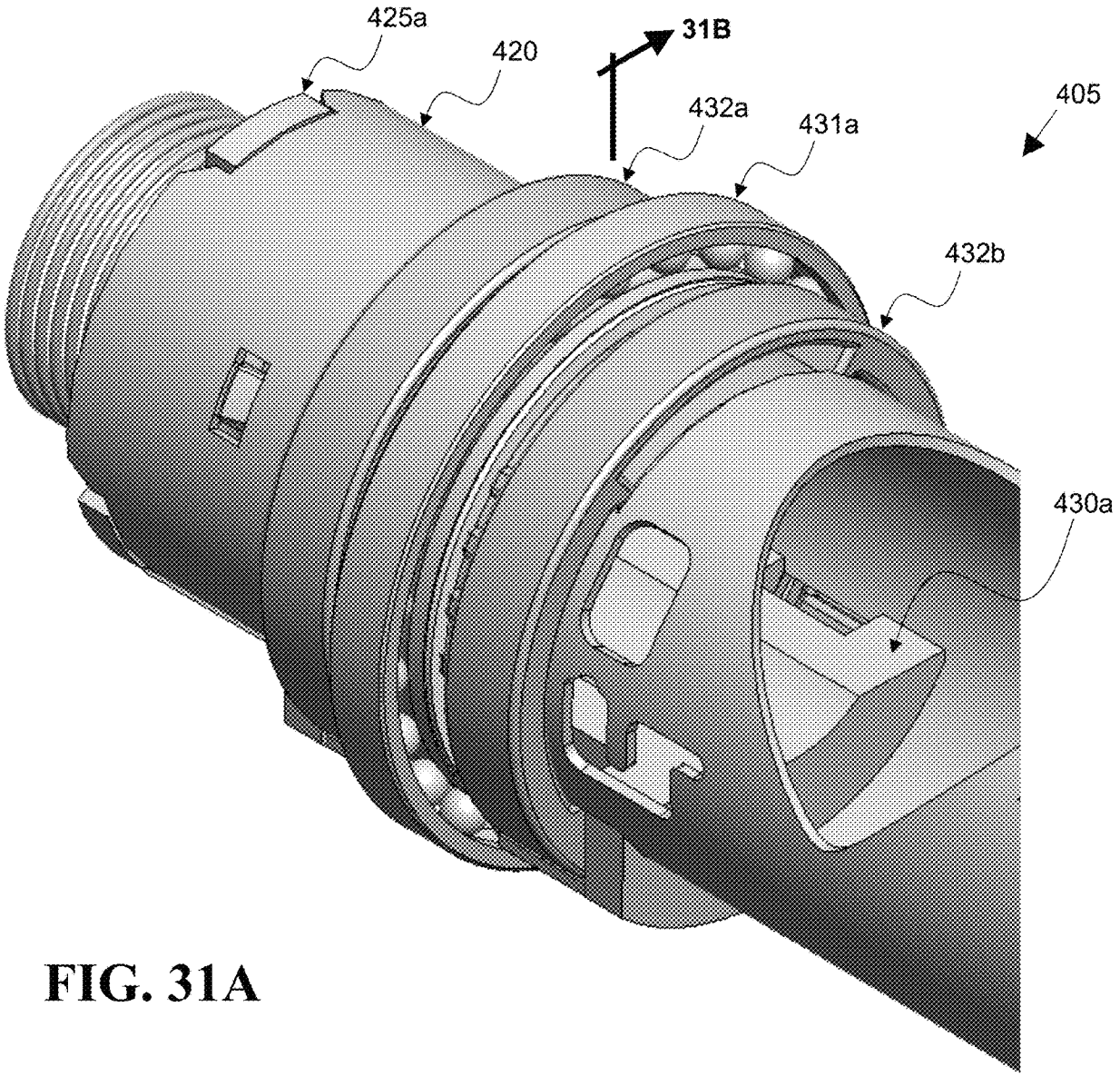
FIG. 31A is a perspective view of the cap assembly, the retaining insert, the another substantially identical (or at least similar) retaining insert, the orienting weight, the charge tube, and the self-orienting bearing of FIG. 30D in a fourth assembled state or configuration according to one or more embodiments of the present disclosure.
Figure 31B:
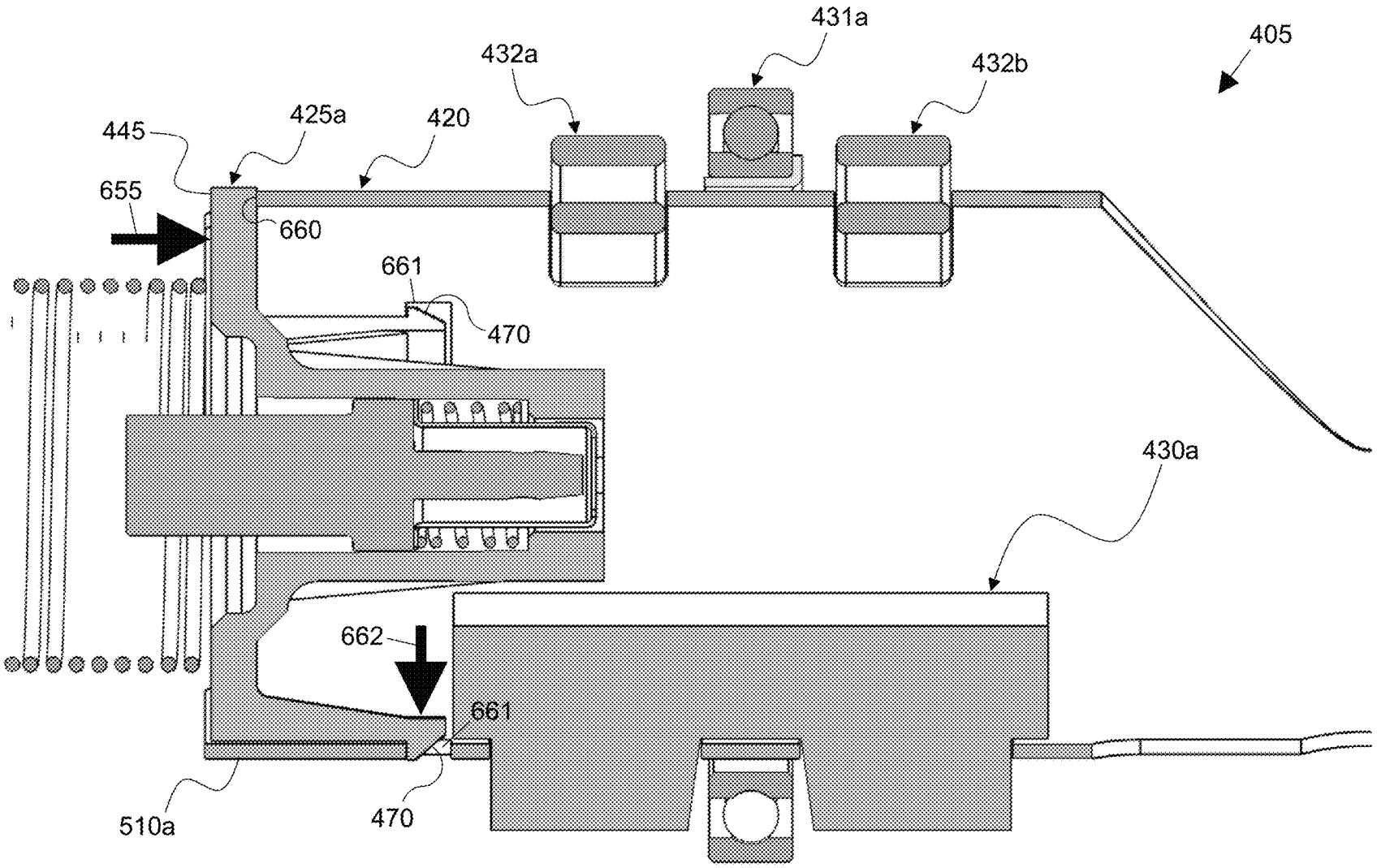
FIG. 31B is a cross-sectional view of the fourth assembled state or configuration taken along the line 31B-31B of FIG. 31A according to one or more embodiments of the present disclosure.

Turning next to FIGS. 31A and 31B, the cap assembly 425*a*, the retaining inserts 432*a-b*, the orienting weight 430*a*, the charge tube 420, and the self-orienting bearing 431*a* are illustrated in a fourth assembled state or configuration according to one or more embodiments of the present disclosure. In particular, as shown in FIG. 31B, to place the cap assembly 425*a*, the retaining inserts 432*a-b*, the orienting weight 430*a*, the charge tube 420, and the self-orienting bearing 431*a* in the fourth assembled state or configuration, the cap assembly 425*a* is assembled into the end portion 510*a* of the charge tube 420. More particularly, the cap assembly 425*a* is inserted axially into the end portion 510*a* of the charge tube 420, as indicated by arrow 655, causing: the one or more tabs 445 to be received within corresponding axial recesses 660 formed into the charge tube 420 at the end portion 510*a*; and the latching feature(s) 470 of the end cap 435 to latch onto the charge tube 420 at corresponding slots 661 formed through the charge tube 420, as indicated by arrow 662.

Figure 32:
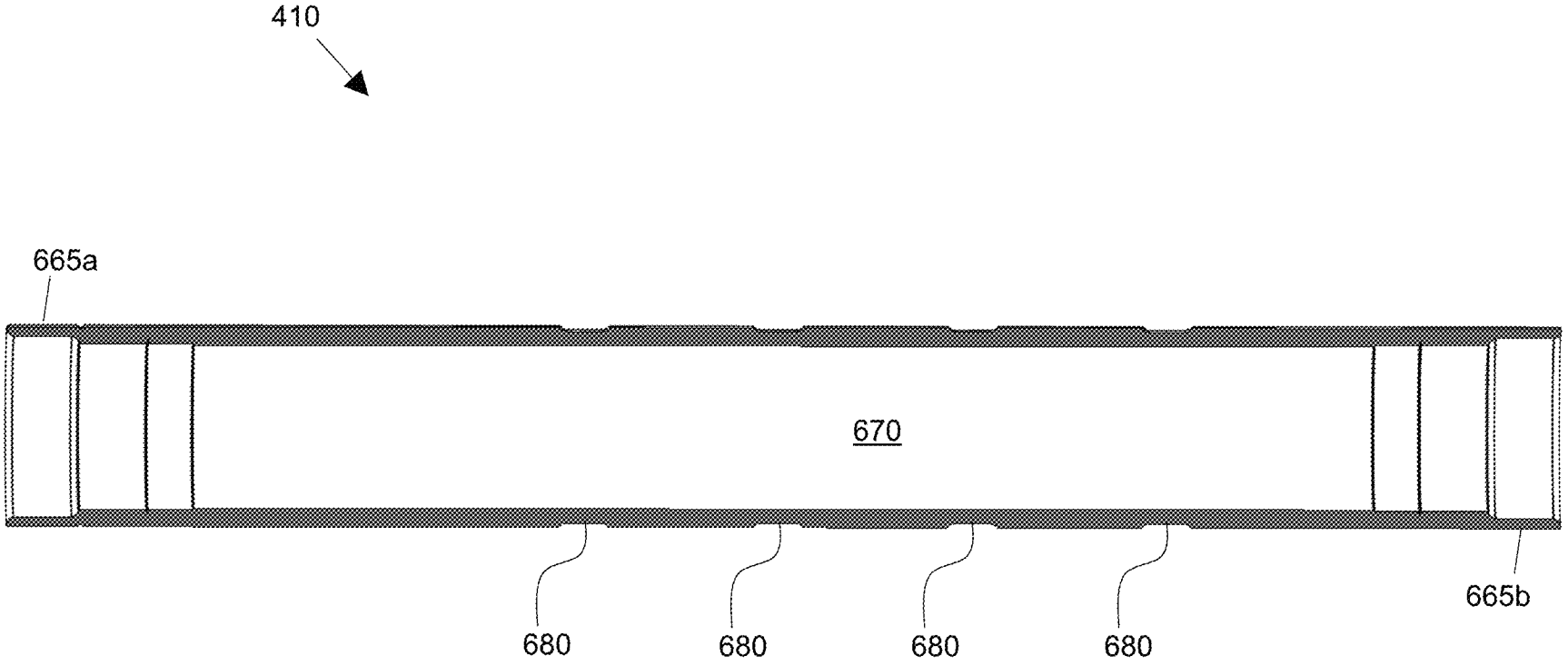
FIG. 32 is a cross-sectional view of a carrier tube of the perforating gun of FIG. 17 according to one or more embodiments of the present disclosure.

Referring to FIG. 32, in one or more embodiments, the carrier tube 410 defines opposing end portions 665*a-b* and a central passageway 670 extending axially therethrough. Although shown as a single integrally formed body, the carrier tube 410 may instead be broken into two or more interconnected components. A plurality of banded scallops 680 are formed externally into, and circumferentially around, the carrier tube 410. The plurality of banded scallops 680 eliminate the need to rotationally align the perforating charges (each of which is rotationally aligned in a substantially straight line (i.e., a non-phased relationship) with adjacent one(s) of the perforating charges) with respective ones of the plurality of banded scallops 680 formed externally into the carrier tube 410, as will be described in further detail below.

Figure 33:
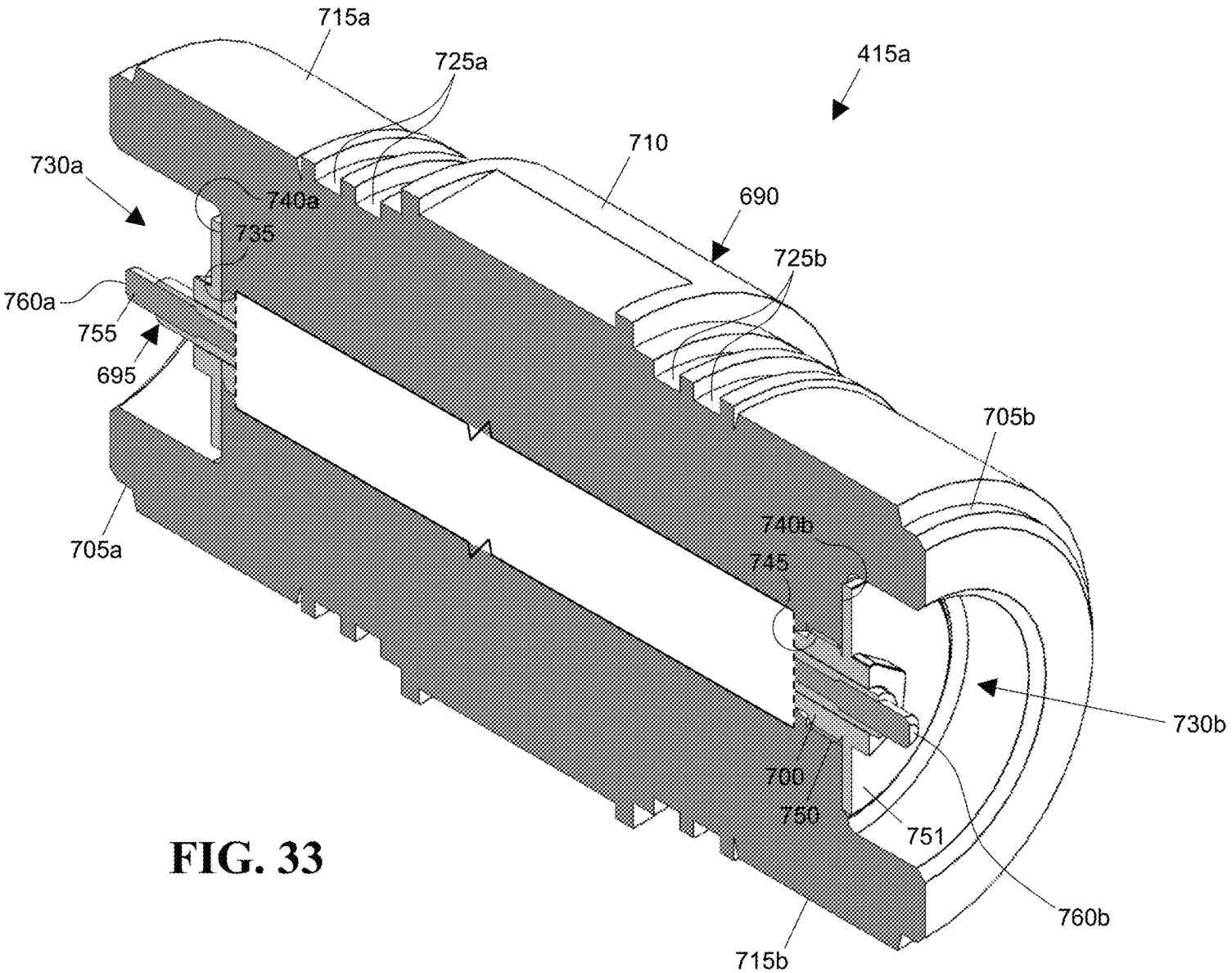
FIG. 33 is a perspective cross-sectional view of a conductor sub of the perforating gun of FIG. 17 according to one or more embodiments of the present disclosure.

Referring to FIG. 33, in one or more embodiments, the conductor sub 415*a* includes a sub body 690, a conductor assembly 695 (or "feedthrough"), and a retainer 700. The sub body 690 defines opposing end portions 705*a-b*. The sub body 690 includes an enlarged-diameter portion 710 located between the end portions 705*a-b* of the sub body 690. An external threaded connection 715*a* is formed in the sub body 690 proximate the end portion 705*a* of the sub body 690. One or more seals are adapted to extend within one or more external annular grooves 725*a* formed into the sub body 690 between the enlarged-diameter portion 710 and the external threaded connection 715*a*. Similarly, an external threaded connection 715*b* is formed in the sub body 690 proximate the end portion 705*b* of the sub body 690. One or more seals are adapted to extend within one or more external annular grooves 725*b* formed into the sub body 690 between the enlarged-diameter portion 710 and the external threaded connection 715*b*.

Opposing axial recesses 730*a-b* are formed into the sub body 690 at the end portions 705*a-b*, respectively, of the sub body 690. An internal bore 735 is formed through the sub body 690 between the axial recesses 730*a-b*. The axial recesses 730*a-b* are substantially larger in diameter than the internal bore 735; as a result, an internal face 740*a* is formed in the sub body 690 where the internal bore 735 intersects the axial recess 730*a*, and an internal face 740*b* is formed in the sub body 690 where the internal bore 735 intersects the axial recess 730*b*. An internal threaded connection 745 is formed in the sub body 690 at the internal bore 735, proximate the axial recess 730*a*. The retainer 700 includes an external threaded connection 750 threadably engaged with the internal threaded connection 745 of the sub body 690 to retain the conductor assembly 695 within the sub body 690. The conductor assembly 695 includes a conductor body 755 defining opposing end portions 760*a-b* that extend within the axial recesses 730*a-b* when the retainer 700 retains the conductor assembly 695 within the sub body 690. A grounding flange 751 extends from the retainer 700 and covers the internal face 740*b* of the sub body 690. In one or more embodiments, the grounding flange 751 is integrally formed with the retainer 700. Alternatively, in one or more embodiments, the grounding flange 751 may be separately formed from the retainer 700.

Figure 34A:
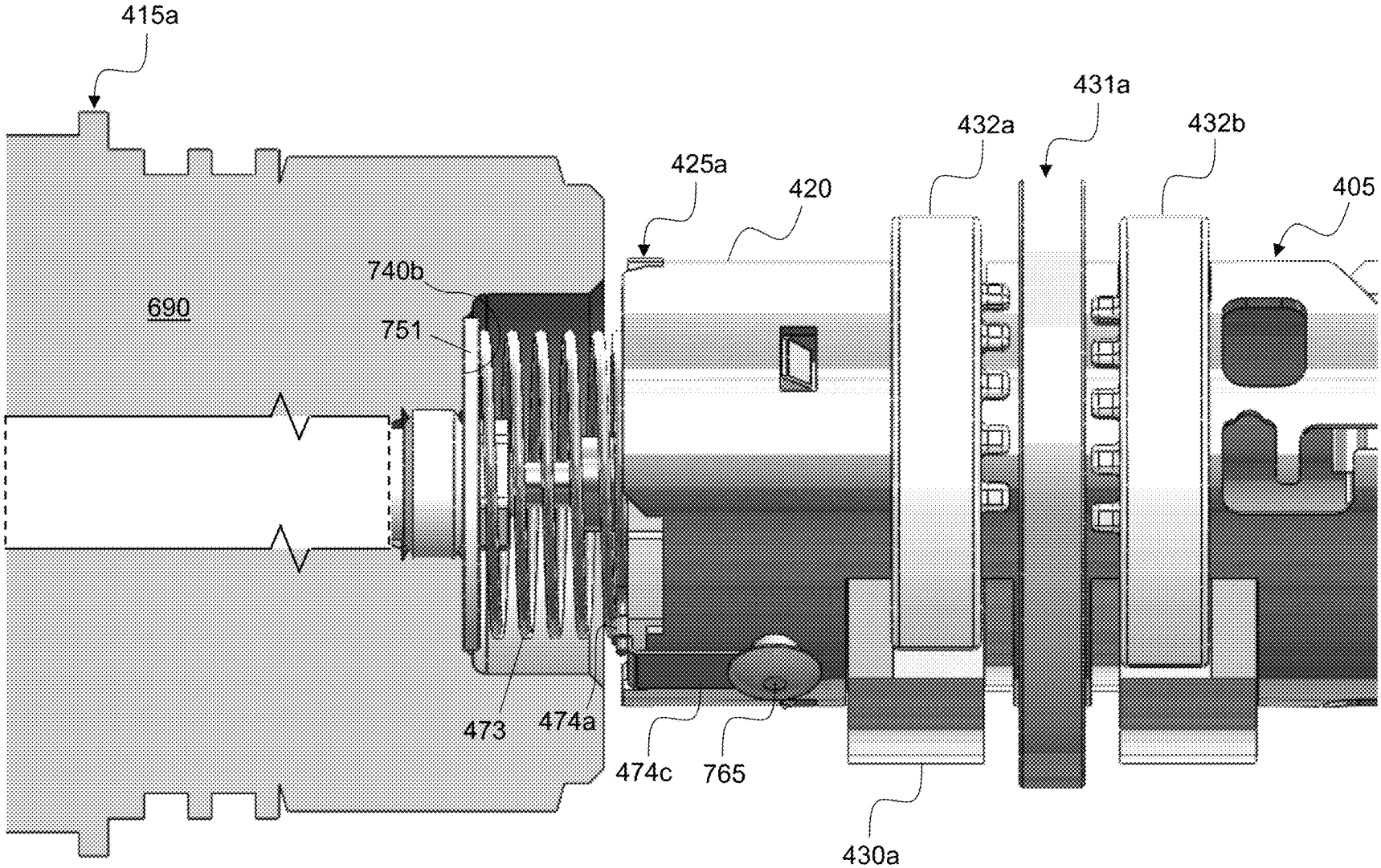
FIG. 34A is a cross-sectional view of a portion of the perforating gun of FIG. 17 according to one or more embodiments of the present disclosure.
Figure 34B:
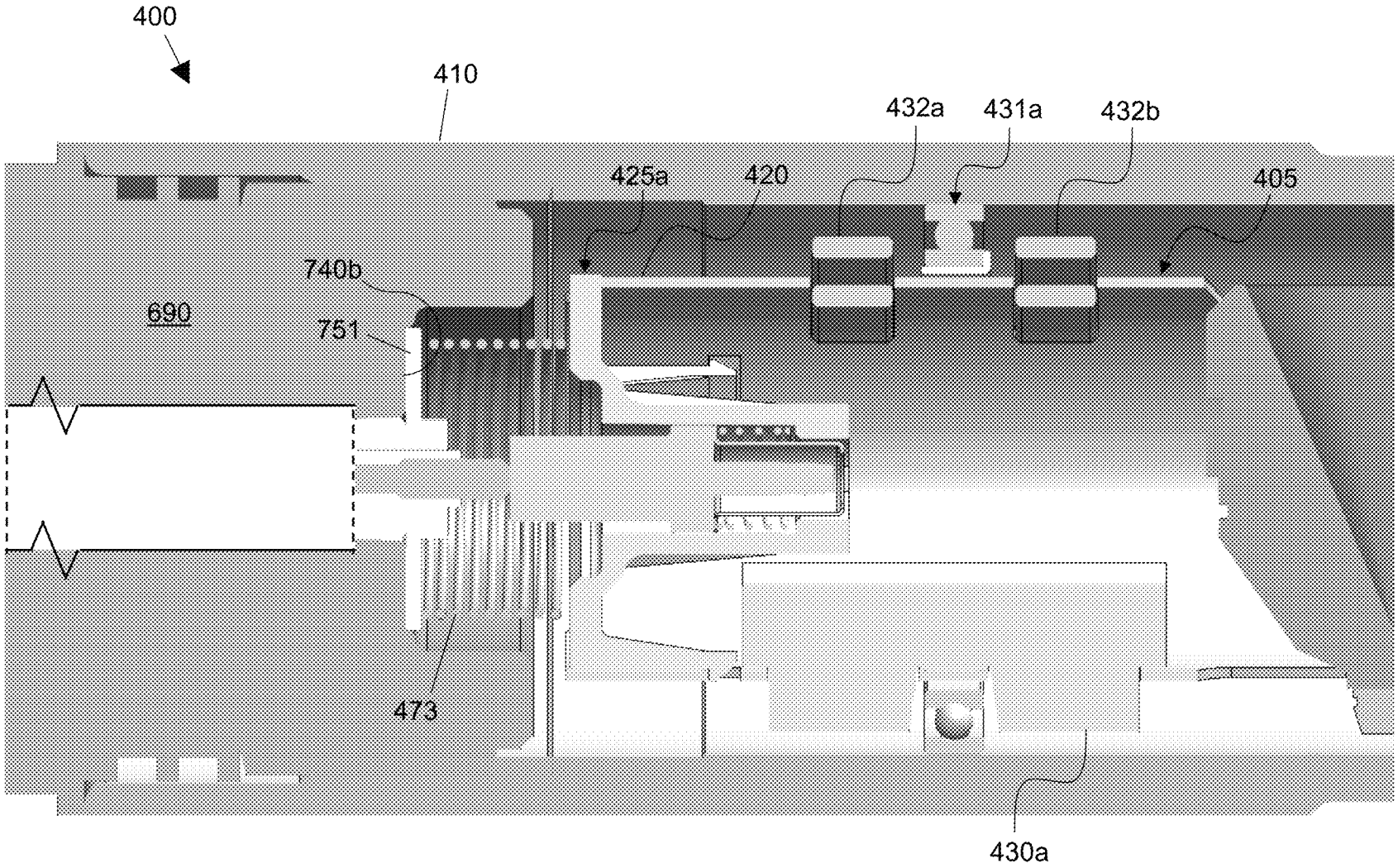
FIG. 34B is another cross-sectional view of the portion of the perforating gun of FIG. 34A according to one or more embodiments of the present disclosure.

Referring to FIGS. 34A and 34B, in one or more embodiments, when the charge cartridge 405 including the cap assembly 425*a* is assembled together with the carrier tube 410 (not visible in FIG. 34A) and the conductor sub 415*a*, the ground spring 473, which is retained by the spring retainer 474*a* of the conductor clip 472 (shown in FIGS. 21A and 21B), contacts the grounding flange 751 covering the internal face 740*b* of the sub body 690 of the conductor sub 415*a*, thereby electrically grounding, the charge cartridge 405 to the conductor sub 415*a* (via the grounding flange 751). Moreover, the grounding batten 474*c* is fastened to the charge tube 420 using a rivet 765 so that the electrical ground is transferred to the charge tube 420. As a result, when the charge cartridge 405 is assembled together with the carrier tube 410 and the conductor sub 415*a*, the ground conductor 440, including the conductor clip 472 and the ground spring 473, provides grounding electrical contact between the charge tube 420 and the conductor sub 415*a*. The self-orienting bearing 431*a* supports the charge tube 420 against the carrier tube 410, enabling rotation of the charge cartridge 405 with respect to the carrier tube 410 and the conductor sub 415*a*. The retaining inserts 432*a-b* hold the orienting weight 430*a* in place and keep the self-orienting bearing 431*a* centralized on the charge tube 420. When the perforating gun 400 extends horizontally, gravity acts on the orienting weights 430*a-b*, rotating the self-orienting charge cartridge 405 via the self-orienting bearings 431*a-b* so the perforating charges are aimed in a desired direction.

One or more embodiments of the present application are provided in whole or in part as described in Appendix A of the '404 Application, which forms part of the present application. It is understood that one or more of the embodiments described above and shown FIGS. 1 through 34B may be combined in whole or in part with one or more of the embodiments described and illustrated in Appendix A of the '404 Application, and/or one or more other embodiments described above and shown in FIGS. 1 through 34B.

One or more embodiments of the present application are provided in whole or in part as described in Appendix B of the '404 Application, which forms part of the present application. It is further understood that one or more of the embodiments described above and shown FIGS. 1 through 34B may be combined in whole or in part with one or more of the embodiments described and illustrated in Appendix B of the '404 Application, and/or one or more other embodiments described above and shown in FIGS. 1 through 34B.

In several embodiments, one or more of the embodiments described and illustrated in Appendices A-B of the '404 Application are combined in whole or in part with one or more of the embodiments described above and shown in FIGS. 1 through 34B and/or one or more of the other embodiments described and illustrated in Appendices A-B of the '404 Application.

The present disclosure introduces a perforating gun. The perforating gun generally includes: a carrier tube; a self-orienting charge cartridge extending within the carrier tube, the self-orienting charge cartridge defining opposing first and second end portions and including: a first cap assembly at the first end portion; a perforating charge; a bearing; and a ground conductor including a ground spring; and a conductor sub coupled to the carrier tube; wherein the self-orienting charge cartridge is configured so that: the perforating charge is initiable via both the conductor sub and the first cap assembly; the bearing rotationally supports the perforating charge within the carrier tube; and the ground spring provides grounding electrical contact with the conductor sub in order to ground the self-orienting charge cartridge directly to the conductor sub. In one or more embodiments, the self-orienting charge cartridge is configured so that the bearing rotationally supporting the perforating charge is positioned against the carrier tube. In one or more embodiments, the self-orienting charge cartridge is configured so that the bearing rotationally supporting the perforating charge in the carrier tube is positioned between the first cap assembly and the second end portion. In one or more embodiments, the self-orienting charge cartridge further includes a second cap assembly at the second end portion; and the self-orienting charge cartridge is configured so that the bearing rotationally supporting the perforating charge in the carrier tube is positioned between the first cap assembly and the second cap assembly. In one or more embodiments, the self-orienting charge cartridge further comprises an orienting weight; and the self-orienting charge cartridge is configured so that: axial movement of the bearing is restricted by the orienting weight; and the orienting weight is adapted to be acted upon by gravity, thereby rotating the self-orienting charge cartridge via the bearing in order to aim the perforating charge in a desired direction. In one or more embodiments, the self-orienting charge cartridge further comprises a retaining insert; and the self-orienting charge cartridge is configured so that: the retaining insert retains the orienting weight; and axial movement of the bearing is restricted by the retaining insert. In one or more embodiments, the self-orienting charge cartridge further includes a charge tube; and the first cap assembly is coupled to the charge tube. In one or more embodiments, the self-orienting charge cartridge is configured so that the bearing rotationally supports, via the charge tube, the perforating charge within the carrier tube at the position between the first cap assembly and the second end portion. In one or more embodiments, the self-orienting charge cartridge is configured so that the bearing rotationally supporting the perforating charge in the carrier tube extends entirely outside the conductor sub.

The present disclosure also introduces a self-orienting charge cartridge for a perforating gun. The self-orienting charge cartridge generally defines opposing first and second end portions and includes: a first cap assembly at the first end portion; a perforating charge; a bearing; and a ground conductor including a ground spring; wherein the self-orienting charge cartridge is adapted to extend within a carrier tube of the perforating gun and is configured so that, when a conductor sub of the perforating gun is coupled to the carrier tube and the self-orienting charge cartridge extends therewithin: the perforating charge is initiable via both the conductor sub and the first cap assembly; the bearing rotationally supports the perforating charge within the carrier tube; and the ground spring provides grounding electrical contact with the conductor sub in order to ground the self-orienting charge cartridge directly to the conductor sub. In one or more embodiments, the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge is positioned against the carrier tube. In one or more embodiments, the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge in the carrier tube is positioned between the first cap assembly and the second end portion. In one or more embodiments, the self-orienting charge cartridge further includes a second cap assembly at the second end portion; wherein the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supports the perforating charge in the carrier tube at a position between the first cap assembly and the second cap assembly. In one or more embodiments, the self-orienting charge cartridge further comprises an orienting weight; wherein the self-orienting charge cartridge is adapted to extend within the carrier tube of the perforating gun and is configured so that, when the conductor sub of the perforating gun is coupled to the carrier tube and the self-orienting charge cartridge extends therewithin: axial movement of the bearing is restricted by the orienting weight; and the orienting weight is adapted to be acted upon by gravity, thereby rotating the self-orienting charge cartridge via the bearing in order to aim the perforating charge in a desired direction. In one or more embodiments, the self-orienting charge cartridge further comprises a retaining insert; wherein the self-orienting charge cartridge is adapted to extend within the carrier tube of the perforating gun and is configured so that, when the conductor sub of the perforating gun is coupled to the carrier tube and the self-orienting charge cartridge extends therewithin: the retaining insert retains the orienting weight; and axial movement of the bearing is restricted by the retaining insert. In one or more embodiments, the self-orienting charge cartridge further includes a charge tube; wherein the first cap assembly is coupled to the charge tube. In one or more embodiments, the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supports, via the charge tube, the perforating charge within the carrier tube at the position between the first cap assembly and the second end portion. In one or more embodiments, the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge in the carrier tube extends entirely outside the conductor sub.

The present disclosure also introduces another perforating gun. The another perforating gun generally includes: a carrier tube; a self-orienting charge cartridge extending within the carrier tube, the self-orienting charge cartridge including: a perforating charge; a bearing; and a ground conductor; and a conductor sub coupled to the carrier tube; wherein the self-orienting charge cartridge is configured so that: the perforating charge is initiable via the conductor sub; the bearing rotationally supports the perforating charge within the carrier tube; and the ground conductor provides grounding electrical contact with the conductor sub in order to ground the self-orienting charge cartridge directly to the conductor sub. In one or more embodiments, the ground conductor includes a ground spring; and the self-orienting charge cartridge is configured so that the ground spring provides the grounding electrical contact with the conductor sub in order to ground the self-orienting charge cartridge directly to the conductor sub. In one or more embodiments, the self-orienting charge cartridge is configured so that the bearing rotationally supporting the perforating charge is positioned against the carrier tube. In one or more embodiments, the self-orienting charge cartridge defines opposing first and second end portions and further includes a first cap assembly at the first end portion; wherein the perforating charge is initiable via both the conductor sub and the first cap assembly; and wherein the self-orienting charge cartridge is configured so that the bearing rotationally supporting the perforating charge in the carrier tube is positioned between the first cap assembly and the second end portion. In one or more embodiments, the self-orienting charge cartridge further includes a second cap assembly at the second end portion; and the self-orienting charge cartridge is configured so that the position at which the bearing rotationally supporting the perforating charge in the carrier tube is positioned between the first cap assembly and the second cap assembly. In one or more embodiments, the self-orienting charge cartridge further comprises an orienting weight; and the self-orienting charge cartridge is configured so that: axial movement of the bearing is restricted by the orienting weight; and the orienting weight is adapted to be acted upon by gravity, thereby rotating the self-orienting charge cartridge via the bearing in order to aim the perforating charge in a desired direction. In one or more embodiments, the self-orienting charge cartridge further comprises a retaining insert; and the self-orienting charge cartridge is configured so that: the retaining insert retains the orienting weight; and axial movement of the bearing is restricted by the retaining insert. In one or more embodiments, the self-orienting charge cartridge further includes a charge tube; and the first cap assembly is coupled to the charge tube. In one or more embodiments, the self-orienting charge cartridge is configured so that the bearing rotationally supports, via the charge tube, the perforating charge within the carrier tube at the position between the first cap assembly and the second end portion. In one or more embodiments, the self-orienting charge cartridge is configured so that the bearing rotationally supporting the perforating charge in the carrier tube extends entirely outside the conductor sub.

The present disclosure also introduces another self-orienting charge cartridge for a perforating gun. The self-orienting charge cartridge generally includes: a perforating charge; a bearing; and a ground conductor; wherein the self-orienting charge cartridge is adapted to extend within a carrier tube of the perforating gun and is configured so that, when a conductor sub of the perforating gun is coupled to the carrier tube and the self-orienting charge cartridge extends therewithin: the perforating charge is initiable via the conductor sub; the bearing rotationally supports the perforating charge within the carrier tube; and the ground conductor provides grounding electrical contact with the conductor sub in order to ground the self-orienting charge cartridge directly to the conductor sub. In one or more embodiments, the ground conductor includes a ground spring; and the self-orienting charge cartridge is adapted to extend within the carrier tube of the perforating gun and is configured so that, when the conductor sub of the perforating gun is coupled to the carrier tube and the self-orienting charge cartridge extends therewithin, the ground spring provides the grounding electrical contact with the conductor sub in order to ground the self-orienting charge cartridge directly to the conductor sub. In one or more embodiments, the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge is positioned against the carrier tube. In one or more embodiments, the self-orienting charge cartridge defines opposing first and second end portions and further includes a first cap assembly at the first end portion; and the self-orienting charge cartridge is adapted to extend within the carrier tube of the perforating gun and is configured so that, when the conductor sub of the perforating gun is coupled to the carrier tube and the self-orienting charge cartridge extends therewithin: the perforating charge is initiable via both the conductor sub and the first cap assembly; and the bearing rotationally supporting the perforating charge in the carrier tube is positioned between the first cap assembly and the second end portion. In one or more embodiments, the self-orienting charge cartridge of further includes a second cap assembly at the second end portion; wherein the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge in the carrier tube is positioned between the first cap assembly and the second cap assembly. In one or more embodiments, the self-orienting charge cartridge further comprises an orienting weight; wherein the self-orienting charge cartridge is adapted to extend within the carrier tube of the perforating gun and is configured so that, when the conductor sub of the perforating gun is coupled to the carrier tube and the self-orienting charge cartridge extends therewithin: axial movement of the bearing is restricted by the orienting weight; and the orienting weight is adapted to be acted upon by gravity, thereby rotating the self-orienting charge cartridge via the bearing in order to aim the perforating charge in a desired direction. In one or more embodiments, the self-orienting charge cartridge further comprises a retaining insert; wherein the self-orienting charge cartridge is adapted to extend within the carrier tube of the perforating gun and is configured so that, when the conductor sub of the perforating gun is coupled to the carrier tube and the self-orienting charge cartridge extends therewithin: the retaining insert retains the orienting weight; and axial movement of the bearing is restricted by the retaining insert. In one or more embodiments, the self-orienting charge cartridge of claim 26, further includes a charge tube; wherein the first cap assembly is coupled to the charge tube. In one or more embodiments, the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supports, via the charge tube, the perforating charge within the carrier tube at the position between the first cap assembly and the second end portion. In one or more embodiments, the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge in the carrier tube extends entirely outside the conductor sub.

It is further understood that variations may be made in the foregoing without departing from the scope of the disclosure.

In several embodiments, the elements and teachings of the various illustrative embodiments may be combined in whole or in part in some or all of the illustrative embodiments. In addition, one or more of the elements and teachings of the various illustrative embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, or one or more of the procedures may also be performed in different orders, simultaneously or sequentially. In several embodiments, the steps, processes or procedures may be merged into one or more steps, processes or procedures. In several embodiments, one or more of the operational steps in each embodiment may be omitted. Moreover, in some instances, some features of the present disclosure may be employed without a corresponding use of the other features. Moreover, one or more of the embodiments disclosed above, in the Appendices A-B of the '404 Application, and in the '188, '320, and '900 Applications, or variations thereof, may be combined in whole or in part with any one or more of the other embodiments described above, in the Appendices A-B of the '404 Application, and in the '188, '320, and '900 Applications, or variations thereof.

Although several embodiments have been disclosed in detail above, in the Appendices A-B of the '404 Application, and in the '188, '320, and '900 Applications, the embodiments disclosed are exemplary only and are not limiting, and those skilled in the art will readily appreciate that many other modifications, changes, and substitutions are possible in the embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A perforating gun, comprising:

a carrier tube;

a self-orienting charge cartridge extending within the carrier tube, the self-orienting charge cartridge defining opposing first and second end portions and comprising:

a first cap assembly at the first end portion;

a perforating charge;

a bearing; and a ground conductor comprising a ground spring;

and a conductor sub coupled to the carrier tube;

wherein the self-orienting charge cartridge is configured so that:

the perforating charge is initiable via both the conductor sub and the first cap assembly;

the bearing rotationally supports the perforating charge within the carrier tube; and the ground spring provides grounding electrical contact with the conductor sub in order to ground the self-orienting charge cartridge directly to the conductor sub.

2. The perforating gun of claim 1, wherein the self-orienting charge cartridge is configured so that the bearing rotationally supporting the perforating charge is positioned against the carrier tube.

3. The perforating gun of claim 1, wherein the self-orienting charge cartridge is configured so that the bearing rotationally supporting the perforating charge in the carrier tube is positioned between the first cap assembly and the second end portion.

4. The perforating gun of claim 3, wherein the self-orienting charge cartridge further comprises a charge tube;

wherein the first cap assembly is coupled to the charge tube; and wherein the self-orienting charge cartridge is configured so that the bearing rotationally supports, via the charge tube, the perforating charge within the carrier tube at the position between the first cap assembly and the second end portion.

5. The perforating gun of claim 3, wherein the self-orienting charge cartridge is configured so that the bearing rotationally supporting the perforating charge in the carrier tube extends entirely outside the conductor sub.

6. The perforating gun of claim 1, wherein the self-orienting charge cartridge further comprises an orienting weight; and wherein the self-orienting charge cartridge is configured so that:

axial movement of the bearing is restricted by the orienting weight; and the orienting weight is adapted to be acted upon by gravity, thereby rotating the self-orienting charge cartridge via the bearing in order to aim the perforating charge in a desired direction.

7. The perforating gun of claim 6, wherein the self-orienting charge cartridge further comprises a retaining insert; and wherein the self-orienting charge cartridge is configured so that:

the retaining insert retains the orienting weight; and axial movement of the bearing is restricted by the retaining insert.

8. The perforating gun of claim 1, wherein the self-orienting charge cartridge is further configured so that, when the bearing rotationally supports the charge cartridge within the carrier tube, the bearing is spaced apart from, so as not to be in contact with, the ground conductor.

9. A self-orienting charge cartridge for a perforating gun, the self-orienting charge cartridge defining opposing first and second end portions and comprising:

a first cap assembly at the first end portion;

a perforating charge;

a bearing; and a ground conductor comprising a ground spring;

wherein the self-orienting charge cartridge is adapted to extend within a carrier tube of the perforating gun and is configured so that, when a conductor sub of the perforating gun is coupled to the carrier tube and the self-orienting charge cartridge extends therewithin:

the perforating charge is initiable via both the conductor sub and the first cap assembly;

the bearing rotationally supports the perforating charge within the carrier tube; and the ground spring provides grounding electrical contact with the conductor sub in order to ground the self-orienting charge cartridge directly to the conductor sub.

10. The self-orienting charge cartridge of claim 9, wherein the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge is positioned against the carrier tube.

11. The self-orienting charge cartridge of claim 9, wherein the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge in the carrier tube is positioned between the first cap assembly and the second end portion.

12. The self-orienting charge cartridge of claim 11, further comprising:

a charge tube;

wherein the first cap assembly is coupled to the charge tube; and wherein the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supports, via the charge tube, the perforating charge within the carrier tube at the position between the first cap assembly and the second end portion.

13. The self-orienting charge cartridge of claim 11, wherein the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge in the carrier tube extends entirely outside the conductor sub.

14. The self-orienting charge cartridge of claim 9, further comprising:

an orienting weight;

wherein the self-orienting charge cartridge is adapted to extend within the carrier tube of the perforating gun and is configured so that, when the conductor sub of the perforating gun is coupled to the carrier tube and the self-orienting charge cartridge extends therewithin:

axial movement of the bearing is restricted by the orienting weight; and the orienting weight is adapted to be acted upon by gravity, thereby rotating the self-orienting charge cartridge via the bearing in order to aim the perforating charge in a desired direction.

15. The self-orienting charge cartridge of claim 14, further comprising:

a retaining insert;

wherein the self-orienting charge cartridge is adapted to extend within the carrier tube of the perforating gun and is configured so that, when the conductor sub of the perforating gun is coupled to the carrier tube and the self-orienting charge cartridge extends therewithin:

the retaining insert retains the orienting weight; and axial movement of the bearing is restricted by the retaining insert.

16. The self-orienting charge cartridge of claim 9, wherein the self-orienting charge cartridge is further configured so that, when the bearing rotationally supports the charge cartridge within the carrier tube, the bearing is spaced apart from, so as not to be in contact with, the ground conductor.

17. A perforating gun, comprising:

a carrier tube;

a self-orienting charge cartridge extending within the carrier tube, the self-orienting charge cartridge comprising:

a perforating charge;

a bearing; and a ground conductor;

and a conductor sub coupled to the carrier tube;

wherein the self-orienting charge cartridge is configured so that:

the perforating charge is initiable via the conductor sub;

the bearing is spaced apart from, so as not to be in contact with, the ground conductor, and rotationally supports the perforating charge within the carrier tube; and the ground conductor provides grounding electrical contact with the conductor sub in order to ground the self-orienting charge cartridge directly to the conductor sub.

18. The perforating gun of claim 17, wherein the ground conductor comprises a ground spring; and wherein the self-orienting charge cartridge is configured so that the ground spring provides the grounding electrical contact with the conductor sub in order to ground the self-orienting charge cartridge directly to the conductor sub.

19. The perforating gun of claim 17, wherein the self-orienting charge cartridge further comprises an orienting weight; and wherein the self-orienting charge cartridge is configured so that:

axial movement of the bearing is restricted by the orienting weight; and the orienting weight is adapted to be acted upon by gravity, thereby rotating the self-orienting charge cartridge via the bearing in order to aim the perforating charge in a desired direction.

20. The perforating gun of claim 19, wherein the self-orienting charge cartridge further comprises a retaining insert; and wherein the self-orienting charge cartridge is configured so that:

the retaining insert retains the orienting weight; and axial movement of the bearing is restricted by the retaining insert.

21. A perforating gun, comprising:

a carrier tube;

a self-orienting charge cartridge extending within the carrier tube, the self-orienting charge cartridge comprising:

a perforating charge;

a bearing; and a ground conductor:

and a conductor sub coupled to the carrier tube;

wherein the self-orienting charge cartridge is configured so that:

the perforating charge is initiable via the conductor sub;

the bearing rotationally supports the perforating charge within the carrier tube; and the ground conductor provides grounding electrical contact with the conductor sub in order to ground the self-orienting charge cartridge directly to the conductor sub;

and wherein the self-orienting charge cartridge is configured so that the bearing rotationally supporting the perforating charge is positioned against the carrier tube.

22. A perforating gun, comprising:

a carrier tube;

a self-orienting charge cartridge extending within the carrier tube, the self-orienting charge cartridge comprising:

a perforating charge;

a bearing; and a ground conductor:

and a conductor sub coupled to the carrier tube;

wherein the self-orienting charge cartridge is configured so that:

the perforating charge is initiable via the conductor sub;

the bearing rotationally supports the perforating charge within the carrier tube; and the ground conductor provides grounding electrical contact with the conductor sub in order to ground the self-orienting charge cartridge directly to the conductor sub;

wherein the self-orienting charge cartridge defines opposing first and second end portions and further comprises a first cap assembly at the first end portion;

wherein the perforating charge is initiable via both the conductor sub and the first cap assembly; and wherein the self-orienting charge cartridge is configured so that the bearing rotationally supporting the perforating charge in the carrier tube is positioned between the first cap assembly and the second end portion.

23. The perforating gun of claim 22, wherein the self-orienting charge cartridge further comprises a charge tube; and wherein the first cap assembly is coupled to the charge tube; and wherein the self-orienting charge cartridge is configured so that the bearing rotationally supports, via the charge tube, the perforating charge within the carrier tube at the position between the first cap assembly and the second end portion.

24. The perforating gun of claim 22, wherein the self-orienting charge cartridge is configured so that the bearing rotationally supporting the perforating charge in the carrier tube extends entirely outside the conductor sub.

25. A self-orienting charge cartridge for a perforating gun, the self-orienting charge cartridge comprising:

a perforating charge;

a bearing; and a ground conductor;

wherein the self-orienting charge cartridge is adapted to extend within a carrier tube of the perforating gun and is configured so that, when a conductor sub of the perforating gun is coupled to the carrier tube and the self-orienting charge cartridge extends therewithin:

the perforating charge is initiable via the conductor sub;

the bearing is spaced apart from, so as not to be in contact with, the ground conductor, and rotationally supports the perforating charge within the carrier tube; and the ground conductor provides grounding electrical contact with the conductor sub in order to ground the self-orienting charge cartridge directly to the conductor sub.

26. The self-orienting charge cartridge of claim 25, wherein the ground conductor comprises a ground spring; and wherein the self-orienting charge cartridge is adapted to extend within the carrier tube of the perforating gun and is configured so that, when the conductor sub of the perforating gun is coupled to the carrier tube and the self-orienting charge cartridge extends therewithin, the ground spring provides the grounding electrical contact with the conductor sub in order to ground the self-orienting charge cartridge directly to the conductor sub.

27. The self-orienting charge cartridge of claim 25, further comprising:

an orienting weight;

wherein the self-orienting charge cartridge is adapted to extend within the carrier tube of the perforating gun and is configured so that, when the conductor sub of the perforating gun is coupled to the carrier tube and the self-orienting charge cartridge extends therewithin:

axial movement of the bearing is restricted by the orienting weight; and the orienting weight is adapted to be acted upon by gravity, thereby rotating the self-orienting charge cartridge via the bearing in order to aim the perforating charge in a desired direction.

28. The self-orienting charge cartridge of claim 27, further comprising:

a retaining insert;

wherein the self-orienting charge cartridge is adapted to extend within the carrier tube of the perforating gun and is configured so that, when the conductor sub of the perforating gun is coupled to the carrier tube and the self-orienting charge cartridge extends therewithin:

the retaining insert retains the orienting weight; and axial movement of the bearing is restricted by the retaining insert.

29. A self-orienting charge cartridge for a perforating gun, the self-orienting charge cartridge comprising:

a perforating charge;

a bearing; and a ground conductor;

wherein the self-orienting charge cartridge is adapted to extend within a carrier tube of the perforating gun and is configured so that, when a conductor sub of the perforating gun is coupled to the carrier tube and the self-orienting charge cartridge extends therewithin:

the perforating charge is initiable via the conductor sub;

the bearing rotationally supports the perforating charge within the carrier tube; and the ground conductor provides grounding electrical contact with the conductor sub in order to ground the self-orienting charge cartridge directly to the conductor sub;

and wherein the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge is positioned against the carrier tube.

30. A self-orienting charge cartridge for a perforating gun, the self-orienting charge cartridge comprising:

a perforating charge;

a bearing; and a ground conductor;

wherein the self-orienting charge cartridge is adapted to extend within a carrier tube of the perforating gun and is configured so that, when a conductor sub of the perforating gun is coupled to the carrier tube and the self-orienting charge cartridge extends therewithin:

the perforating charge is initiable via the conductor sub;

the bearing rotationally supports the perforating charge within the carrier tube; and the ground conductor provides grounding electrical contact with the conductor sub in order to ground the self-orienting charge cartridge directly to the conductor sub;

wherein the self-orienting charge cartridge defines opposing first and second end portions and further comprises a first cap assembly at the first end portion; and wherein the self-orienting charge cartridge is adapted to extend within the carrier tube of the perforating gun and is configured so that, when the conductor sub of the perforating gun is coupled to the carrier tube and the self-orienting charge cartridge extends therewithin:

the perforating charge is initiable via both the conductor sub and the first cap assembly; and the bearing rotationally supporting the perforating charge in the carrier tube is positioned between the first cap assembly and the second end portion.

31. The self-orienting charge cartridge of claim 30, further comprising:

a charge tube;

wherein the first cap assembly is coupled to the charge tube; and wherein the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supports, via the charge tube, the perforating charge within the carrier tube at the position between the first cap assembly and the second end portion.

32. The self-orienting charge cartridge of claim 30, wherein the self-orienting charge cartridge is adapted to extend within the carrier tube of the perforating gun and is configured so that, when the conductor sub of the perforating gun is coupled to the carrier tube and the self-orienting charge cartridge extends therewithin, the bearing rotationally supporting the perforating charge in the carrier tube extends entirely outside the conductor sub.

* * * * *